US009849685B2

(12) United States Patent
Tsukahara et al.

(10) Patent No.: US 9,849,685 B2
(45) Date of Patent: Dec. 26, 2017

(54) LIQUID SUPPLY DEVICE

(71) Applicant: SEIKO EPSON CORPORATION, Tokyo (JP)

(72) Inventors: Katsutomo Tsukahara, Nagano (JP); Tokujiro Okuno, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/124,957

(22) PCT Filed: Mar. 11, 2015

(86) PCT No.: PCT/JP2015/001349
§ 371 (c)(1),
(2) Date: Sep. 9, 2016

(87) PCT Pub. No.: WO2015/136935
PCT Pub. Date: Sep. 17, 2015

(65) Prior Publication Data

US 2017/0021634 A1 Jan. 26, 2017

(30) Foreign Application Priority Data

Mar. 14, 2014 (JP) ..... 2014-051911

(51) Int. Cl.
*B41J 2/175* (2006.01)

(52) U.S. Cl.
CPC ..... *B41J 2/17526* (2013.01); *B41J 2/1752* (2013.01); *B41J 2/1753* (2013.01); *B41J 2/17513* (2013.01); *B41J 2/17523* (2013.01); *B41J 2/17546* (2013.01); *B41J 2/17553* (2013.01); *B41J 2002/17516* (2013.01)

(58) Field of Classification Search
CPC .. B41J 2/17503; B41J 2/17513; B41J 2/1752; B41J 2/17523; B41J 2/17526; B41J 2/1753; B41J 2/17546; B41J 2/17553; B41J 2002/17516; B41J 2/175
See application file for complete search history.

(56) References Cited

U.S. PATENT DOCUMENTS 6,190,010 B1 * 2/2001 Tanaka ..... B41J 2/17513 347/108
6,520,625 B1 * 2/2003 Kawakami ..... B41J 25/34 347/49
6,736,486 B2 * 5/2004 Nakamura ..... B41J 2/1752 347/49
7,246,882 B2 * 7/2007 Shinada ..... D06M 13/44 347/50

(Continued)

FOREIGN PATENT DOCUMENTS

JP 2000-153619 A 6/2000
JP 2006-305941 A 11/2006

(Continued)

*Primary Examiner* — Anh T. N. Vo
(74) *Attorney, Agent, or Firm* — Global IP Counselors, LLP

(57) ABSTRACT

A liquid supply device configured to supply a liquid to a liquid consuming apparatus comprises a liquid container configured to include a liquid supply portion and to contain the liquid therein; and a liquid supply connection structure supported on an outer wall of the liquid consuming apparatus and connected with the liquid supply portion.

14 Claims, 62 Drawing Sheets

(56) References Cited

U.S. PATENT DOCUMENTS

| | | | | |
|---|---|---|---|---|
| 7,802,877 | B2 * | 9/2010 | Hashii | B41J 2/17503 347/85 |
| 7,922,307 | B2 * | 4/2011 | Kobayashi | B41J 2/175 347/36 |
| 2006/0256169 | A1 | 11/2006 | Kobayashi et al. | |
| 2011/0148998 | A1 | 6/2011 | Kobayashi et al. | |
| 2012/0236086 | A1 | 9/2012 | Kobayashi et al. | |
| 2013/0300808 | A1 | 11/2013 | Kobayashi et al. | |
| 2015/0183222 | A1 | 7/2015 | Kobayashi et al. | |

FOREIGN PATENT DOCUMENTS

| | | | |
|---|---|---|---|
| JP | 2008-246844 | A | 10/2008 |
| JP | 2009-202346 | A | 9/2009 |
| JP | 2012-111167 | A | 6/2012 |
| JP | 2013-226704 | A | 11/2013 |

* cited by examiner

F6I-F6I SECTIONAL VIEW

ENLARGED VIEW OF AREA R6J

F6N-F6N SECTIONAL VIEW

F13-F13 SECTIONAL VIEW

VIEW FROM ARROW F17B

F13a-F13a PARTIAL SECTIONAL VIEW

F18-F18 PARTIAL SECTIONAL VIEW

F20–F20 PARTIAL SECTIONAL VIEW

F22A-F22A PARTIAL SECTIONAL VIEW

F22B-F22B PARTIAL SECTIONAL VIEW

F25A-F25A PARTIAL SECTIONAL VIEW

F25B-F25B PARTIAL SECTIONAL VIEW

F28-F28 SECTIONAL VIEW

F29-F29 SECTIONAL VIEW

F32-F32 SECTIONAL VIEW

F25A-F25A PARTIAL SECTIONAL VIEW

F5B-F5B PARTIAL SECTIONAL VIEW

F38-F38 SECTIONAL VIEW

LIQUID SUPPLY DEVICE

CROSS-REFERENCE TO RELATED APPLICATIONS

The present application claims priority from Japanese patent application 2014-051911 filed on Mar. 14, 2014, the content of which is hereby incorporated by reference into this application.

TECHNICAL FIELD

The present disclosure relates to technology with regard to a liquid supply device configured to supply a liquid to a liquid consuming apparatus.

BACKGROUND ART

An external ink supply device configured to supply ink from outside of a printer has been known as a technique of supplying ink to the printer as a liquid consuming apparatus (for example, Patent Literature 1).

CITATION LIST

Patent Literature

PTL 1: JP 2009-202346A

SUMMARY

Technical Problem

According to the technique described in above Patent Literature 1, the external ink supply device includes an ink bag configured to contain ink, a connection structure (liquid lead-out portion) configured to flow out ink from the ink bag, and an ink supply tube (liquid introduction portion) configured to supply the ink flowed out through the connection structure to the printer. In this external ink supply device, the connection structure is located below the ink bag in the vertical direction. This configuration may provide a difficulty in observing the connection structure for the ink bag, for example, at the time of replacement of the ink bag. There is accordingly a problem of difficulty in attaching and detaching the liquid introduction portion to and from the liquid lead-out portion.

This problem is not characteristic of the ink supply device configured to supply ink to the printer but is commonly found in any liquid supply device configured to supply a liquid to a liquid consuming apparatus.

A first object of the disclosure is accordingly to provide a technique of readily connecting the liquid lead-out portion with the liquid introduction portion. A second object of the disclosure is to provide a technique of ensuring favorable connection between the liquid lead-out portion and the liquid introduction portion. Other needs include, for example, cost reduction, resource saving, easy manufacture and improvement of usability over the prior art.

Solution to Problem

In order to solve at least one of the problems described above, the disclosure may be implemented by aspects described below.

(1) According to one aspect of the disclosure, there is provided a liquid supply device configured to supply a liquid to a liquid consuming apparatus. This liquid supply device comprises a liquid container configured to include a liquid supply portion and to contain the liquid therein; and a liquid supply connection structure supported on an outer wall of the liquid consuming apparatus and connected with the liquid supply portion.

In the liquid supply device of this aspect, the liquid supply connection structure is supported on the outer wall. This configuration facilitates connection of the liquid container with the liquid supply connection structure. This configuration also provides a larger space for the liquid container placed therein, compared with the configuration that the liquid supply connection structure is placed inside of the liquid consuming apparatus. This accordingly allows a large amount of liquid to be contained in the liquid container. This configuration also shortens the flow path of the liquid from the liquid container to the liquid consuming apparatus (liquid supply passage), compared with the external configuration that the liquid container is placed at a location away from the liquid consuming apparatus. This accordingly shortens a time period required for the liquid contained in the liquid container to reach the liquid consuming apparatus through the liquid supply passage after formation of the liquid supply passage by connection of the liquid supply portion of the liquid container with the liquid supply connection structure. This also suppresses a component of the liquid from being vaporized through the liquid supply passage to change the properties of the liquid.

(2) The liquid supply device of the above aspect may further comprise a protective member arranged to cover at least an upper portion of the liquid supply connection structure.

In the liquid supply device of this aspect, the presence of the protective member reduces the possibility that any extraneous substance such as dust adheres to the liquid supply connection structure. This configuration accordingly reduces the possibility that any extraneous substance is included in the liquid supplied from the liquid container to the liquid consuming apparatus.

(3) In the liquid supply device of the above aspect, the liquid container may have a container-side electrical connection structure. The liquid supply device may further comprise an apparatus-side electrical connection structure supported on the outer wall and connected with the container-side electrical connection structure.

In the liquid supply device of this aspect, the apparatus-side electrical connection structure is supported on the outer wall of the liquid consuming apparatus. This configuration facilitates connection of the container-side electrical connection structure with the apparatus-side electrical connection structure.

(4) In the liquid supply device of the above aspect, the protective member may be arranged to cover at least an upper portion of the apparatus-side electrical connection structure.

In the liquid supply device of this aspect, the presence of the protective member reduces the possibility that any extraneous substance such as dust adheres to the apparatus-side electrical connection structure. The presence of the protective member also reduces the likelihood that the user directly touches the liquid supply connection structure. Accordingly this configuration reduces a failure in connection between the container-side electrical connection structure and the apparatus-side electrical connection structure.

(5) In the liquid supply device of the above aspect, the liquid supply connection structure and the apparatus-side electrical connection structure may be arranged adjacent to each other.

The liquid supply device of this aspect enables the user to observe the liquid supply connection structure and the apparatus-side electrical connection structure and connect the corresponding portions of the liquid container.

(6) In the liquid supply device of the above aspect, the outer wall may comprise at least one of a first side wall that forms a first side face relative to a front face of the liquid consuming apparatus and a second side wall that forms a second side face relative to the front face. The liquid supply connection structure and the apparatus-side electrical connection structure may be arranged at positions respectively visible from the front face.

In the liquid supply device of this aspect, the liquid supply connection structure and the apparatus-side electrical connection structure are visible when the liquid consuming apparatus is viewed from the front face. This enables the position of connection of the liquid container to be readily recognized.

(7) In the liquid supply device of the above aspect, the liquid supply connection structure and the apparatus-side electrical connection structure may be arranged side by side in a predetermined direction. The outer wall may comprise at least one of a first side wall that forms a first side face relative to a front face of the liquid consuming apparatus and a second side wall that forms a second side face relative to the front face. The first side wall is a right side wall and the second side wall is a left side wall. When the liquid supply connection structure and the apparatus-side electrical connection structure are supported on the right side wall, an angle a1 between the right side wall and the predetermined direction may be greater than 0 degree and smaller than 90 degrees in a clockwise direction from the right side wall in a vertically downward view of the liquid consuming apparatus. When the liquid supply connection structure and the apparatus-side electrical connection structure are supported on the left side wall, an angle a2 between the left side wall and the predetermined direction may be greater than 0 degree and smaller than 90 degrees in a counterclockwise direction from the left side wall in the vertically downward view of the liquid consuming apparatus.

In the liquid supply device of this aspect, the angle a1 or the angle a2 is greater than 0 degree and is smaller than 90 degrees. This configuration suppresses expansion of the width in the left-side direction that is the direction in which the first side wall and the second side wall are opposed to each other.

(8) In the liquid supply device of the above aspect, in the vertically downward view of the liquid consuming apparatus, multiple sets of the liquid supply connection structures and the apparatus-side electrical connection structures may be arranged on one wall out of the right side wall and the left side wall at the angle a1 or at the angle a2 in a direction in which the front face and a rear face of the liquid consuming apparatus are opposed to each other. The liquid supply connection structure and the apparatus-side electrical connection structure may be provided on the other wall out of the right side wall and the left side wall to be arranged side by side along a direction parallel to the other wall. The liquid container connected with the liquid supply connection structure and the apparatus-side electrical connection structure supported on the other wall may have a larger capacity than capacities of the liquid containers connected with the multiple sets of the liquid supply connection structures and the apparatus-side electrical connection structures supported on the one wall.

In the liquid supply device of this aspect, the liquid container having the larger capacity is arranged parallel to the side wall. This configuration provides substantially equal spaces for mounting the liquid containers formed on the first side wall-side and on the second side-wall side across the liquid consuming apparatus.

(9) The liquid supply device of the above aspect may further comprise a liquid container holder attached to the outer wall and configured to place the liquid container therein. The liquid container holder may have a bottom face and an openable and closable top.

The liquid supply device of this aspect includes the liquid container holder having the bottom face. Even if the liquid is leaked out from the liquid supply connection structure during attachment or detaching of the liquid supply portion to the liquid supply connection structure, this configuration reduces the possibility that the outside of the liquid supply device is stained with the liquid. The top of the liquid container holder is configured to be openable and closable and may thus be opened and closed only when needed. This reduces the possibility that the liquid container is damaged.

All the plurality of components included in each of the aspects of the disclosure described above are not essential, but some components among the plurality of components may be appropriately changed, omitted or replaced with other additional components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the disclosure described above may be combined with part or all of the technical features included in another aspect of the disclosure described above to provide one independent aspect of the disclosure.

For example, one aspect of the disclosure may be implemented as an apparatus comprising one or more elements out of a plurality of elements, i.e., a liquid container and a liquid supply connection structure. Accordingly this apparatus may include a liquid container or may not include the liquid container. This apparatus may include a liquid supply connection structure or may not include the liquid supply connection structure. This aspect solves at least one of various problems, such as downsizing of the apparatus, cost reduction, resource saving, easy manufacture and improvement of usability. Part or all of the technical features in each of the aspects of the liquid container described above may be applied to this apparatus.

The disclosure may be implemented by any of various aspects other than the liquid container, for example, a method of manufacturing the liquid container and a liquid consumption system including the liquid container and a liquid consuming apparatus.

DESCRIPTION OF EMBODIMENTS

A. Embodiment

Figure 1:
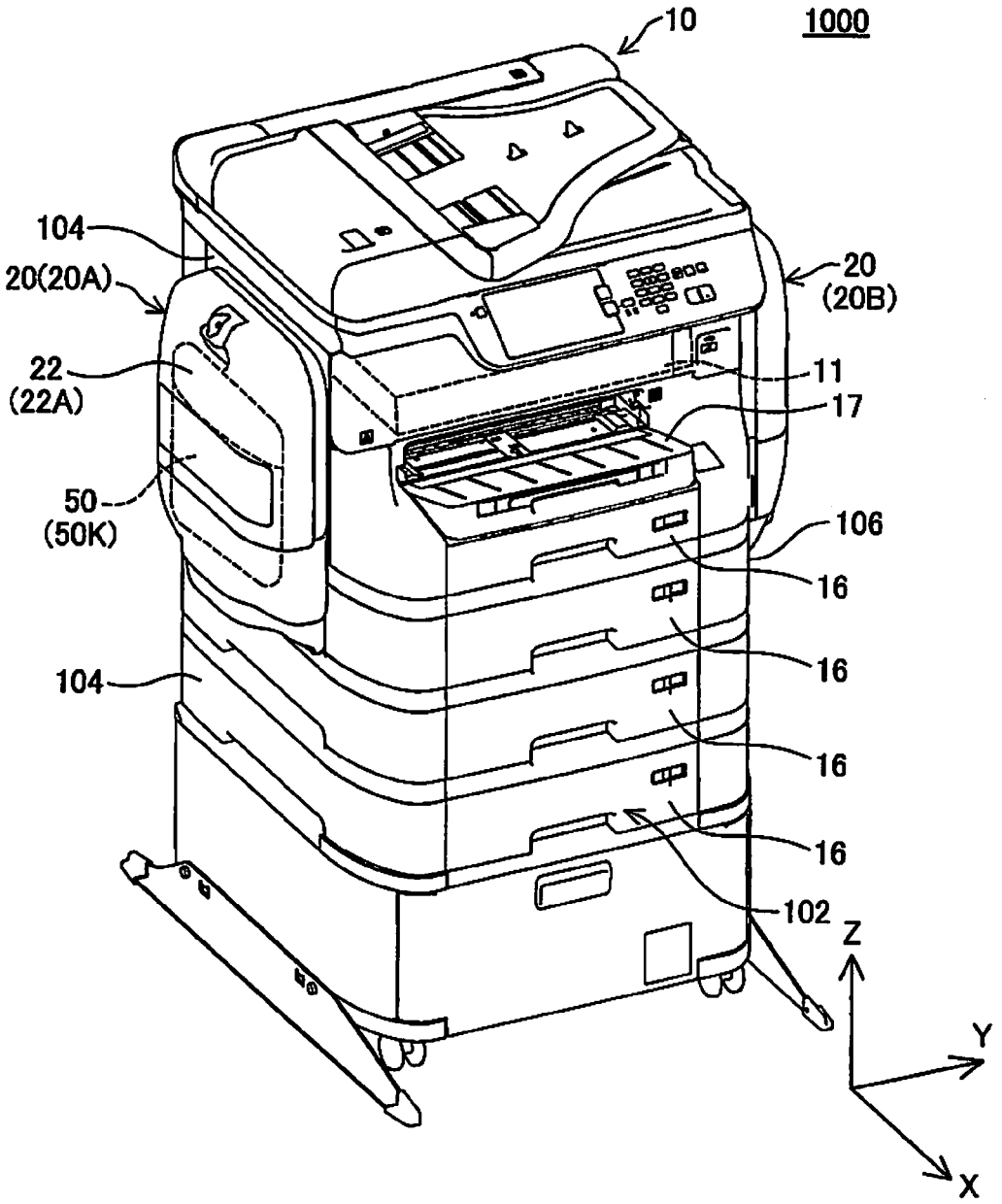
FIG. 1 is a first perspective view illustrating the schematic configuration of a liquid consumption system.
Figure 2:
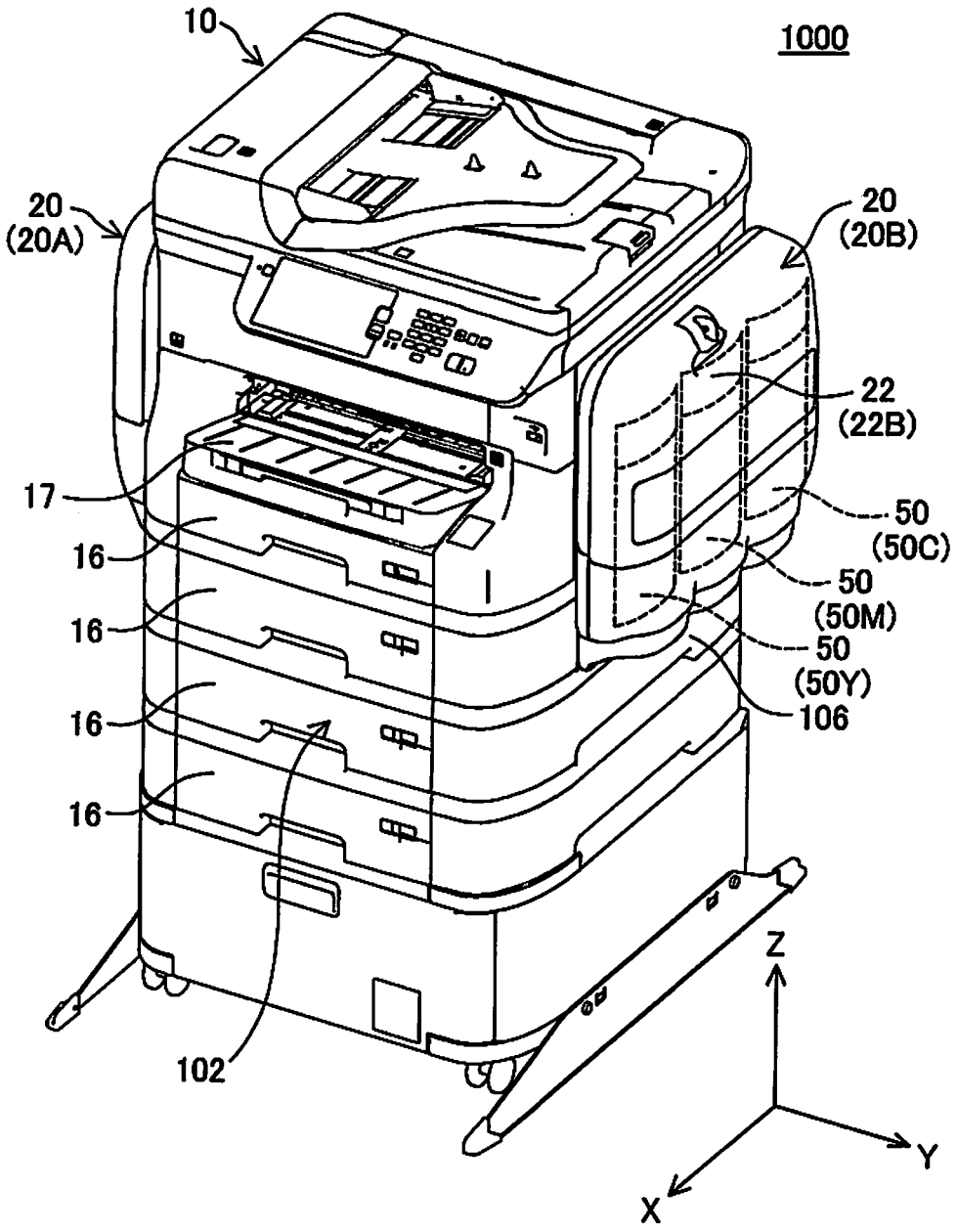
FIG. 2 is a second perspective view illustrating the schematic configuration of the liquid consumption system.
Figure 3:
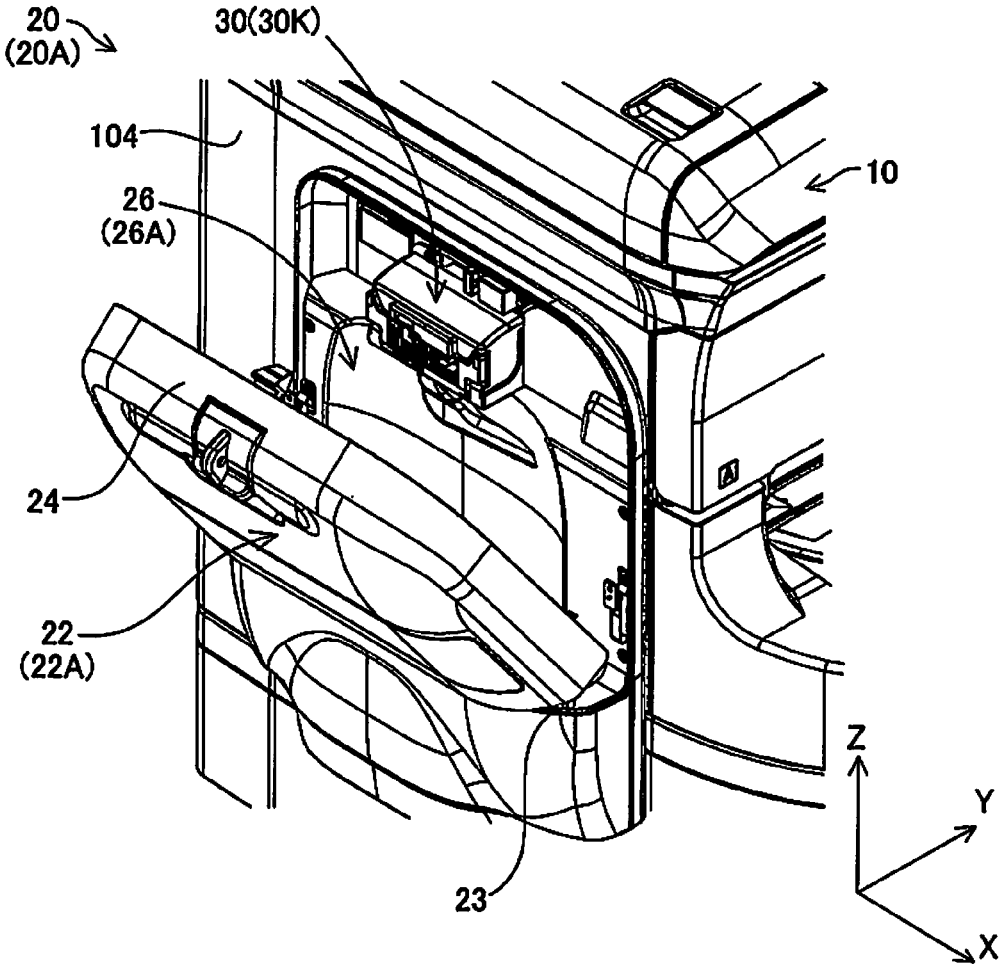
FIG. 3 is a first diagram illustrating a liquid supply device.

A-1. Configuration of Liquid Consumption System:

FIG. 1 is a first perspective view illustrating the schematic configuration of a liquid consumption system 1000. FIG. 2 is a second perspective view illustrating the schematic configuration of the liquid consumption system 1000. FIG. 3 is a first diagram illustrating a liquid supply device 20.

Figure 4:
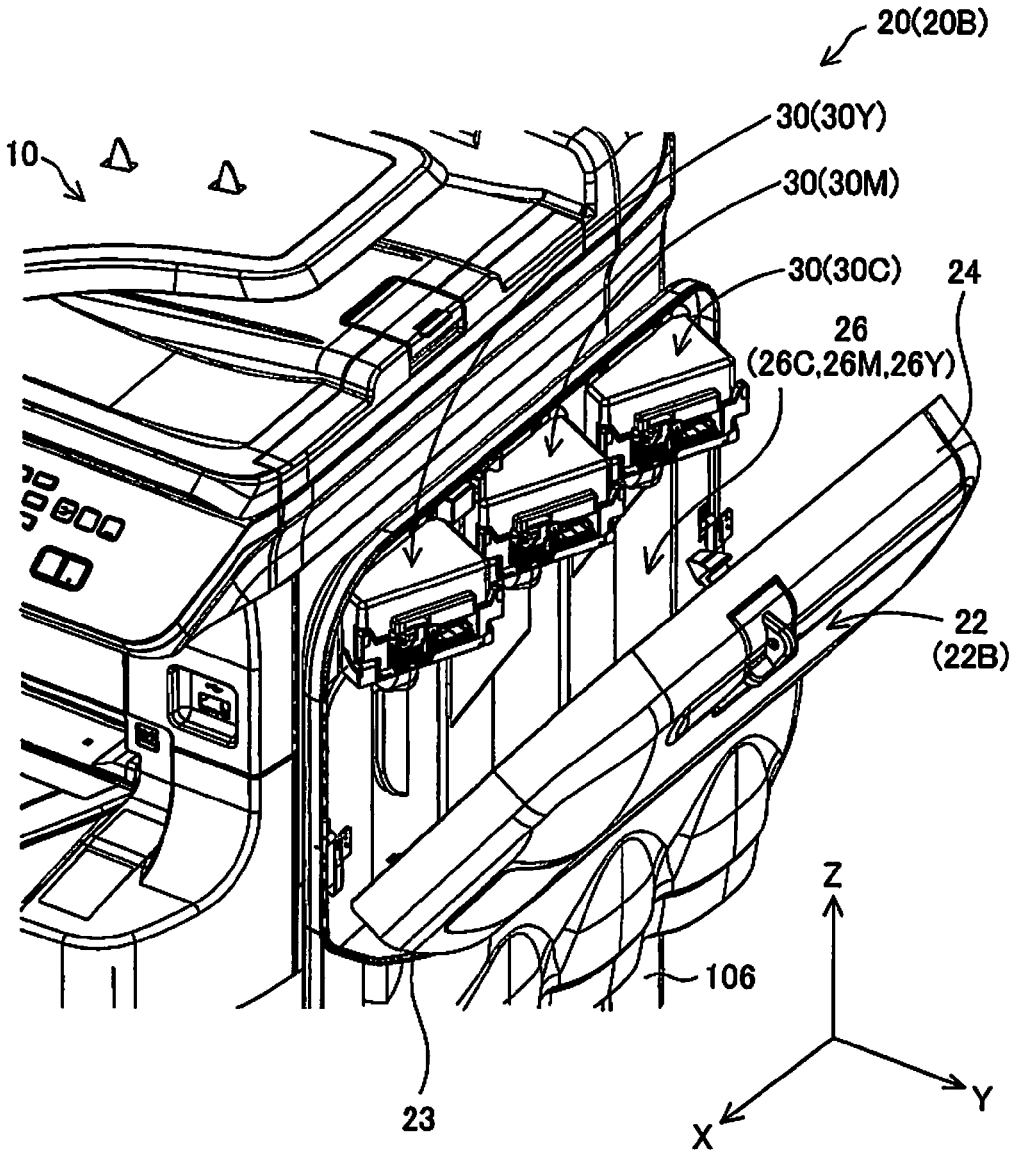
FIG. 4 is a second diagram illustrating the liquid supply device.
Figure 5A:
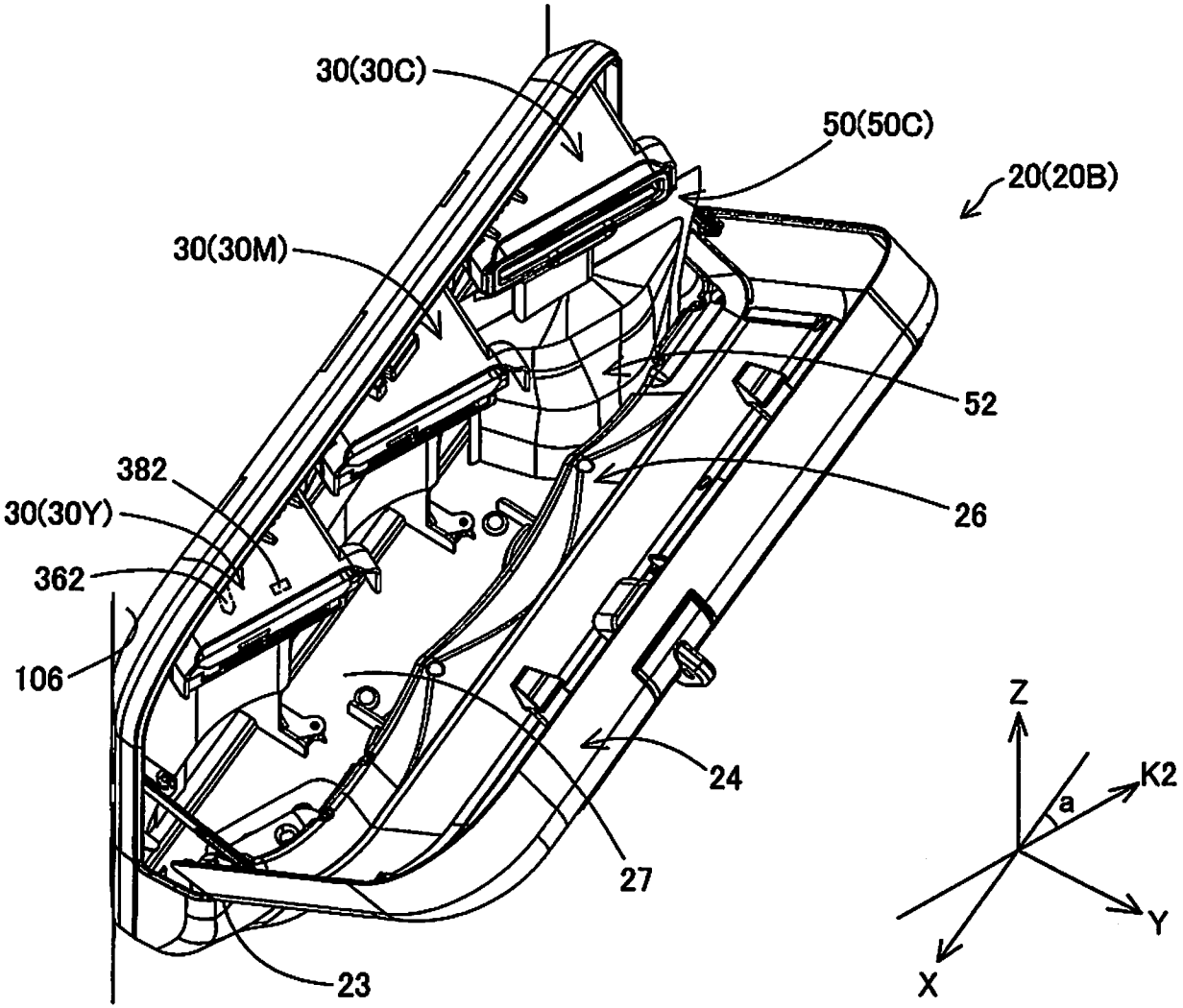
FIG. 5A is a third diagram illustrating the liquid supply device.

FIG. 4 is a second diagram illustrating the liquid supply device 20. FIG. 5A is a third diagram illustrating the liquid supply device 20. FIG. 3 and FIG. 4 illustrate the state that liquid containers 50 described later are demounted. FIG. 5A illustrates the state that one liquid container 50 is mounted. XYZ axes that are orthogonal to one another are illustrated in FIGS. 1 to 5A.

As shown in FIG. 1, the liquid consumption system 1000 includes a printer 10 as a liquid consuming apparatus and two liquid supply devices 20. In the use state of the liquid consumption system 1000, the printer 10 is placed on a horizontal plane defined by an X-axis direction and a Y-axis direction. Accordingly a Z-axis direction is defined as vertical direction (direction of gravity, top-bottom direction); −Z-axis direction is defined as vertically downward and +Z-axis direction is defined as vertically upward. The liquid supply device 20 is configured to supply ink as a liquid to the printer 10. A liquid container 50 (liquid container unit 50) included in the liquid supply device 20 is detachably connected with (mounted to) the printer 10.

The printer 10 is an inkjet printer. The printer 10 includes a recording mechanism 11, paper feed trays 16 and a paper eject tray 17. A plurality of the paper feed trays 16 are provided at positions of different heights in the vertical direction. The paper feed trays 16 are provided on an apparatus first surface (apparatus front face, front face) 102 as the front face of the printer 10. Recording media (for example, sheets of paper) on which images such as letters and characters are printed (recorded) by the printer 10 are placed in the paper feed trays 16.

The recording mechanism 11 includes a record head (not shown) configured to eject ink. The record head is connected with the liquid supply devices 20 through flow pipes such as tubes. The record head uses and ejects ink supplied from the liquid supply device 20 on the recording medium to perform recording (printing). The recording medium after recording is discharged to the paper eject tray 17.

Each of the two liquid supply devices 20 supplies ink to the printer 10 via a liquid introduction portion 362. The two liquid supply devices 20 are respectively provided on an apparatus second surface (also called apparatus first side face or apparatus first side wall) 104 and an apparatus third surface (also called apparatus second side face or apparatus second side wall) 106 that are arranged to intersect with the apparatus first surface (also called apparatus front face or apparatus front wall) 102 of the printer 10. The apparatus first surface 102 to the apparatus third surface 106 are respectively surfaces approximately perpendicular to the installation plane of the printer 10 in the use state of the printer 10. The apparatus second surface 104 and the apparatus third surface 106 are opposed to each other. The liquid supply device 20 provided on the apparatus second surface 104 is also called first liquid supply device 20A, and the liquid supply device 20 provided on the apparatus third surface 106 is also called second liquid supply device 20B. When there is no need to distinguish between the first and the second liquid supply devices 20A and 20B, these are simply called liquid supply devices 20.

As shown in FIG. 1, the first liquid supply device 20A includes one cover member 22 as a liquid container holder, one liquid container 50 and one mounting/demounting unit 30 (shown in FIG. 3). As shown in FIG. 2, the second liquid supply device 20B includes one cover member 22B as a liquid container holder, three liquid containers 50 and three mounting/demounting units 30 (shown in FIG. 4) provided corresponding to the respective liquid containers 50. In the description below, when there is a need to distinguish between the two cover members 22, these are expressed by reference signs "22A" and "22B". When there is a need to distinguish among the four liquid containers 50, these are expressed by reference signs "50K", "50C", "50M" and "50Y". When there is a need to distinguish among the four mounting/demounting units 30, these are expressed by reference signs "30K", "30C", "30M" and "30Y". The numbers of the cover members 22, the liquid containers 50 and the mounting/demounting units 30 are not limited to those described above. For example, the number of the liquid containers 50 may be three or less or may be five or more. The number of the mounting/demounting units 30 may be determined corresponding to the number of the liquid containers 50. The number of the cover members 22 may be one or may be three or more. The mounting/demounting unit 30 may be regarded as a component of the liquid supply device 20 or may be regarded as a component of the printer 10.

The four liquid containers 50 respectively contain (are filled with) different types of inks. According to this embodiment, yellow (Y), magenta (M), cyan (C) and black (K) inks are respectively contained in the different liquid containers 50. The liquid container 50K includes a liquid container body configured to contain black ink. The liquid container 50C includes a liquid container body configured to contain cyan ink. The liquid container 50M includes a liquid container body configured to contain magenta ink. The liquid container 50Y includes a liquid container body configured to contain yellow ink. As shown in FIGS. 3 and 4, the liquid containers 50 are placed in housing spaces 26 defined by the cover members 22 to place the liquid containers 50 therein. More specifically, the liquid container 50K is placed in a housing space 26A (shown in FIG. 3), and the liquid containers 50C, 50M and 50Y are placed in a housing space 26B (shown in FIG. 4). The mounting/demounting units 30 are also placed in the housing spaces 26.

The liquid container 50 is detachably mounted to the mounting/demounting unit 30 shown in FIGS. 3 and 4. The mounting/demounting unit 30K is placed inside of the cover member 22A. The mounting/demounting units 30C, 30M and 30Y are placed inside of the cover member 22B. As shown in FIG. 3, the mounting/demounting unit 30K is provided on the apparatus second surface 104 of the printer 10. As shown in FIG. 4, the mounting/demounting units 30C, 30M and 30Y are provided on the apparatus third surface 106 of the printer 10. When the liquid container 50 is mounted to the mounting/demounting unit 30, the ink contained in the liquid container 50 is supplied to the record head of the printer 10 by means of a supply mechanism (not shown) with pump function of the printer 10.

As shown in FIG. 3, the cover member 22A is attached to the apparatus second surface 104 as the outer wall of the printer 10. As shown in FIG. 4, the cover member 22B is attached to the apparatus third surface 105 as the outer wall of the printer 10. As shown in FIGS. 3 and 4, the cover member 22 is configured to be openable and closable by rotating the other end portion (top) 24 on the vertically upper side about one end portion (bottom) 23 on the vertically lower side as the support point. After consumption of ink contained in the liquid container 50, the user opens the cover member 22 and demounts the used liquid container 50 from the mounting/demounting unit 30. The user then mounts a new liquid container 50 to the mounting/demounting unit 30 and subsequently closes the cover member 22.

As shown in FIG. 5A, the cover member 22 has a bottom face 27 that forms the bottom of the housing space 26. The bottom face 27 is located below the mounting/demounting unit 30 in the direction of gravity. The bottom face 27 is a portion which the bottom of the liquid container 50 (or more specifically the bottom of a liquid container body 52) comes into contact with. A projection may be provided on the bottom face 27, such that the bottom of the liquid container 50 comes into contact with the projection.

As illustrated with regard to the mounting/demounting unit 30Y, the mounting/demounting unit 30 includes a liquid introduction portion 362 as a liquid supply connection structure and an electrical connection structure (supply-side electrical connection structure or an apparatus-side electrical connection structure) 382. A liquid supply portion 57 (shown in FIG. 9) of the liquid container 50 is connected with the liquid introduction portion 362. Ink contained in the liquid container 50 flows through the liquid supply portion 57 to the liquid introduction portion 362. The ink flowing to the liquid introduction portion 362 then flows to the record head of the recording mechanism 11 (shown in FIG. 1). A circuit board 582 (shown in FIG. 9) as a container-side electrical connection structure comes into contact with and is thereby electrically connected with the electrical connection structure 382. The liquid introduction portion 362 and the electrical connection structure 382 are arranged side by side along a K2-axis direction. The K2-axis direction is a direction that is orthogonal to the Z-axis direction and is parallel to a plane (horizontal plane) defined by the X-axis direction and the Y-axis direction. A substrate unit 58 described later may be regarded as the container-side electrical connection structure.

As shown in FIG. 5A, the liquid introduction portion 362 and the electrical connection structure 382 are respectively arranged at positions visible from the apparatus first surface 102. More specifically, the K2-axis direction in which the liquid introduction portion 362 and the electrical connection structure 382 are arranged side by side intersects with the direction perpendicular to the apparatus first surface 102 (X-axis direction) at an angle a that is larger than zero degree and is not greater than 90 degrees. This angle a is an angle formed counterclockwise from the K2 axis to the X axis when the liquid supply device 20 is placed on the apparatus third surface 106 (shown in FIG. 2) that is located on the right side of the apparatus first surface 102. This angle a is also an angle formed clockwise from the K2 axis to the X axis when the liquid supply device 20 is placed on the apparatus second surface 104 (shown in FIG. 1) that is located on the left side of the apparatus first surface 102. In other words, one of the liquid introduction portion 362 and the electrical connection structure 382 placed on a side nearer to the apparatus first surface 102 (for example, the liquid introduction portion 362) is located on the outer side (for example, +Y-axis direction side) of the outer wall (for example, the apparatus third surface 106) where the respective components 362 and 382 are supported, compared with the other placed on a side farther from the apparatus first surface 102 (for example, the electrical connection structure 382).

When the printer 10 is viewed from the apparatus first surface 102, this configuration enables the user to observe the liquid introduction portion 362 and the electrical connection structure 382. The user can thus readily recognize the position of connection where the liquid container 50 is connected with the mounting/demounting unit 30. This angle a is preferably between 15 degrees and 60 degrees inclusive and is more preferably between 20 degrees and 50 degrees inclusive. This configuration enables the position of connection to be readily recognized and suppresses expansion of the housing space 26 in the Y-axis direction. This accordingly allows the capacity of the housing space 26 to be efficiently utilized for placing the mounting/demounting unit 30 therein.

The first liquid supply device 20A (shown in FIG. 3) which the liquid container 50K containing black ink is mounted in may have the angle a equal to zero degree. The second liquid supply device 20B (shown in FIG. 4) which the liquid containers 50C, 50M and 50Y containing yellow and other color inks are mounted in may have the angle a satisfying the above range (greater than zero degree and not greater than 90 degrees). In other words, the direction in which the liquid introduction portion 362 and the electrical connection structure 382 of the first liquid supply device 20A are arranged side by side may be parallel to the outer wall (for example, the apparatus second surface 104 shown in FIG. 1). The liquid container 50K containing black ink is generally filled with a greater amount of ink, compared with the other liquid containers 50C, 50M and 50Y containing color inks. Accordingly the liquid container 50K has the larger outer shape than the other liquid containers 50C, 50M and 50Y. The respective components of the liquid container 50K provided corresponding to the liquid introduction portion 362 and the electrical connection structure 382 of the first liquid supply device 20A are, however, also arranged parallel to the apparatus second surface 104. This configuration suppresses the outer shape of the first liquid supply device 20A from being significantly different from the second outer shape of the second liquid supply device 20B.

Figure 5B:
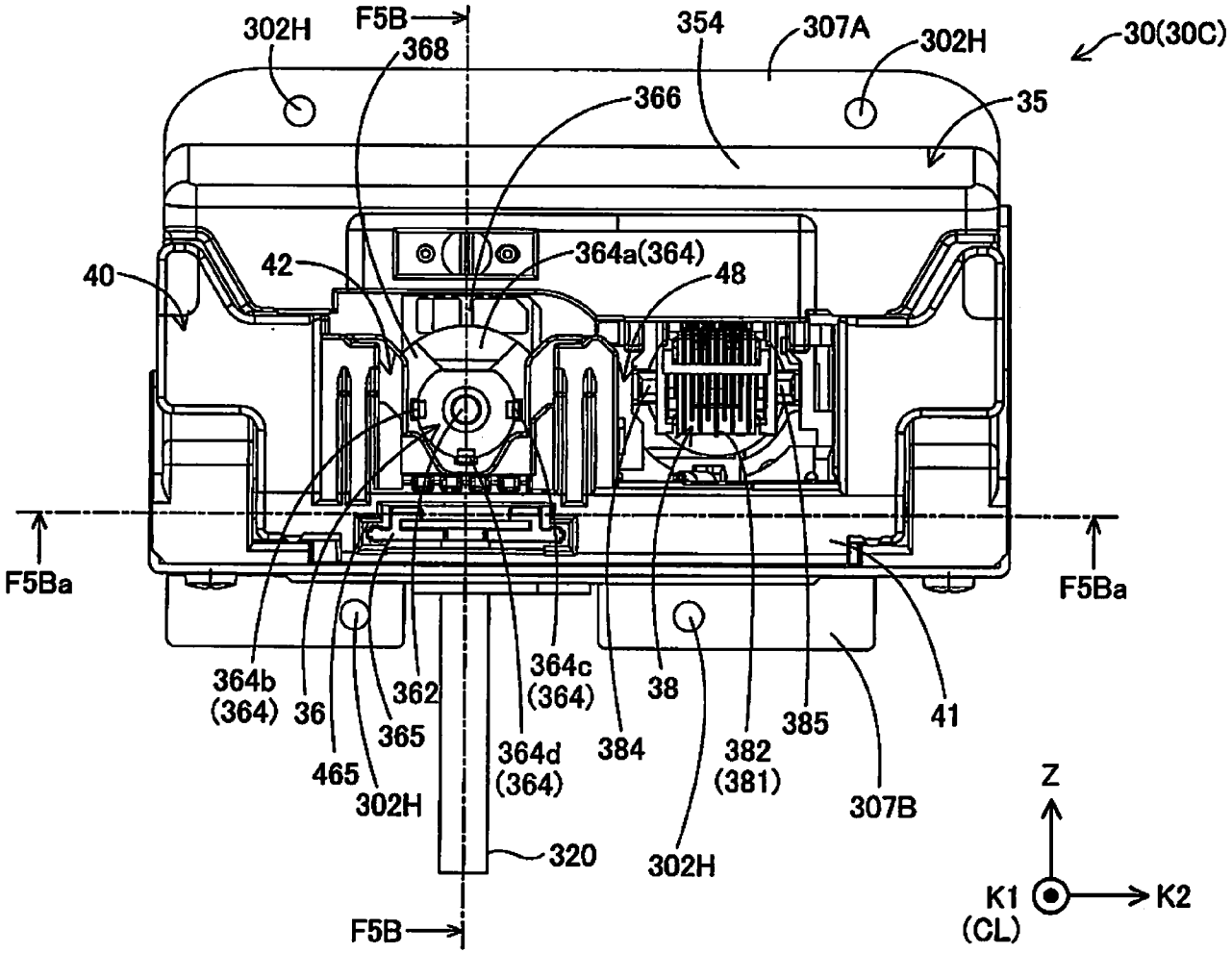
FIG. 5B is a front view illustrating a mounting/demounting unit.
Figure 5C:
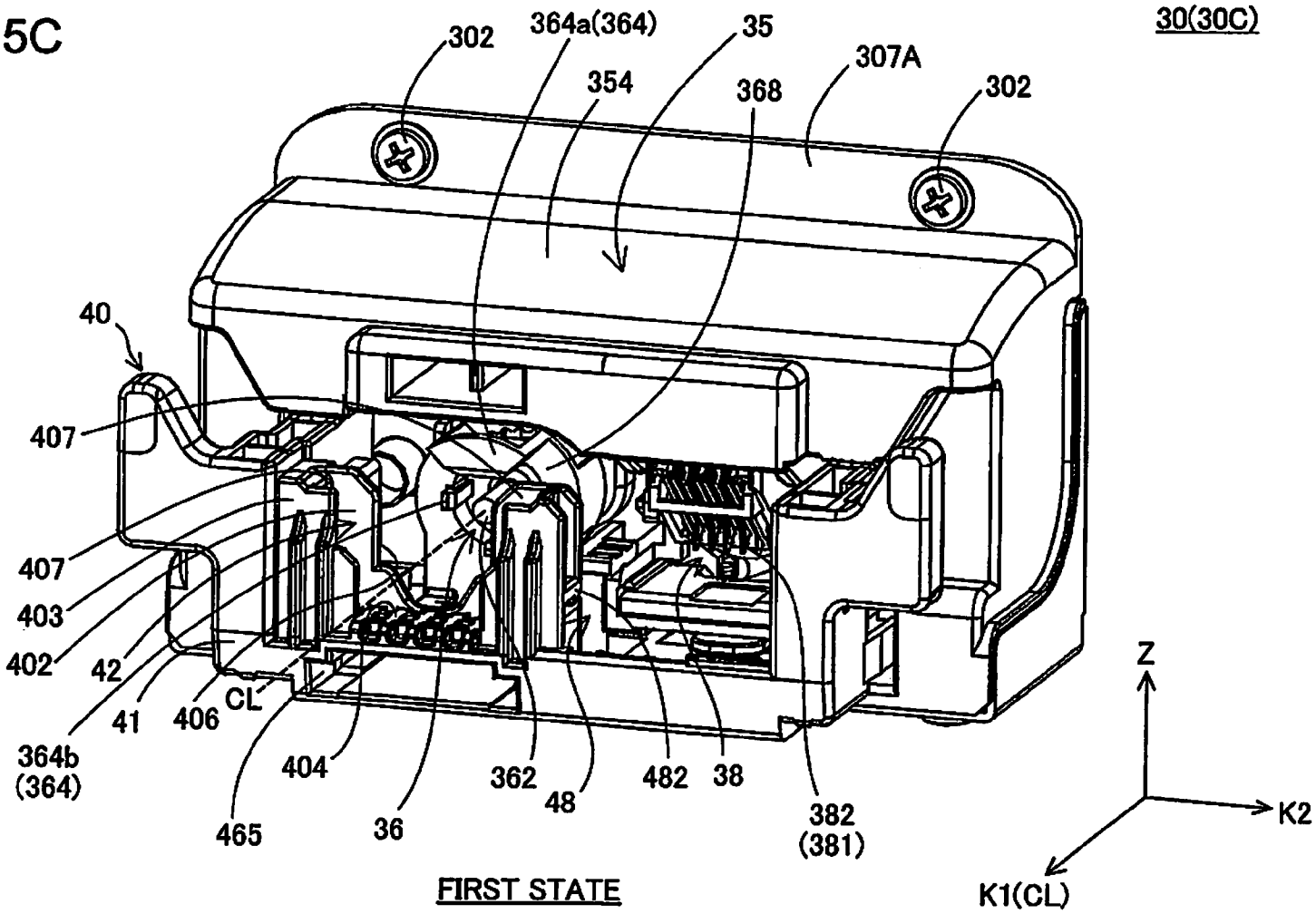
FIG. 5C is a diagram illustrating a first state in which a movable member is protruded outward relative to a stationary member.
Figure 6A:
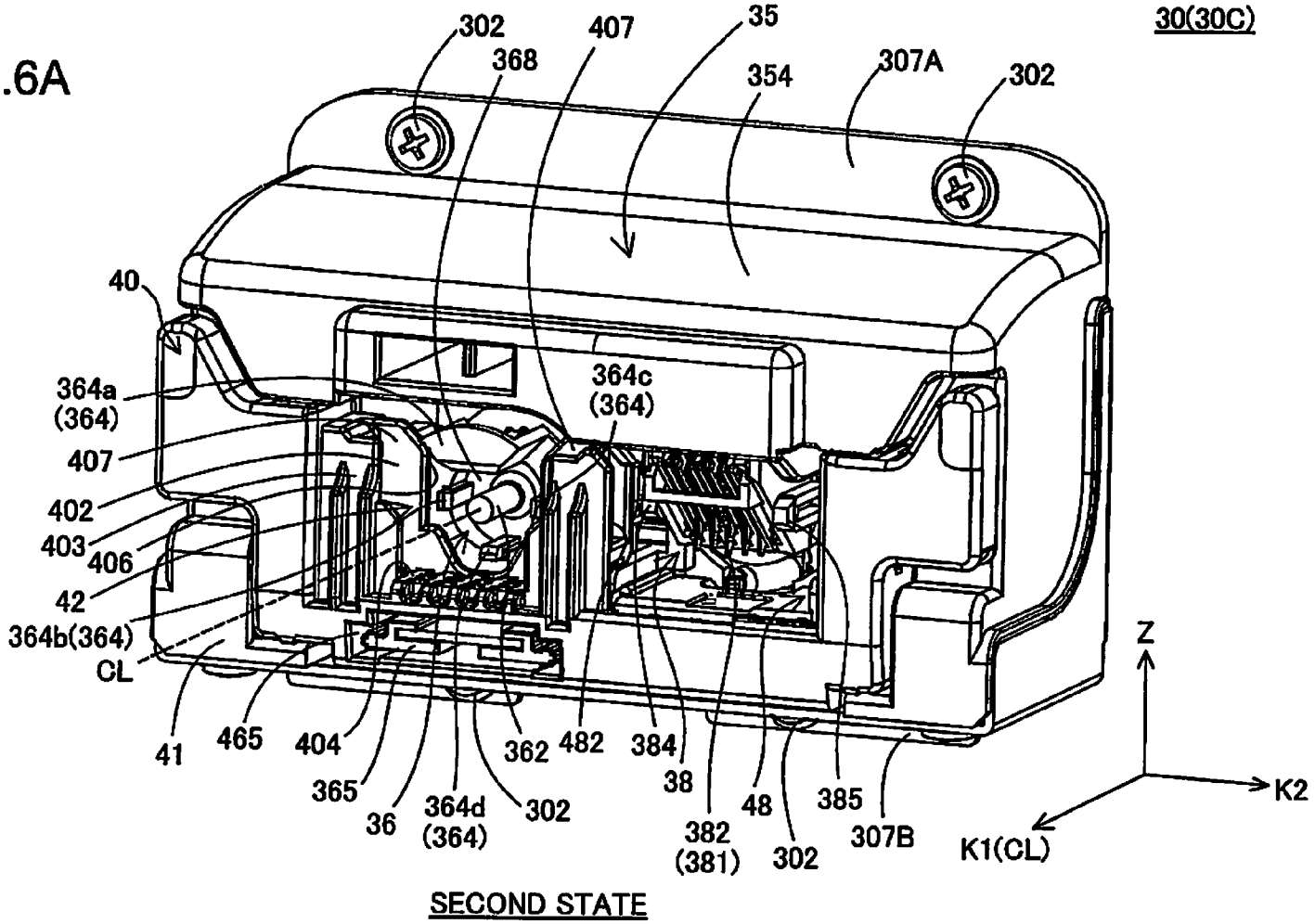
FIG. 6A is a diagram illustrating a second state in which the movable member is placed in the stationary member.
Figure 6B:
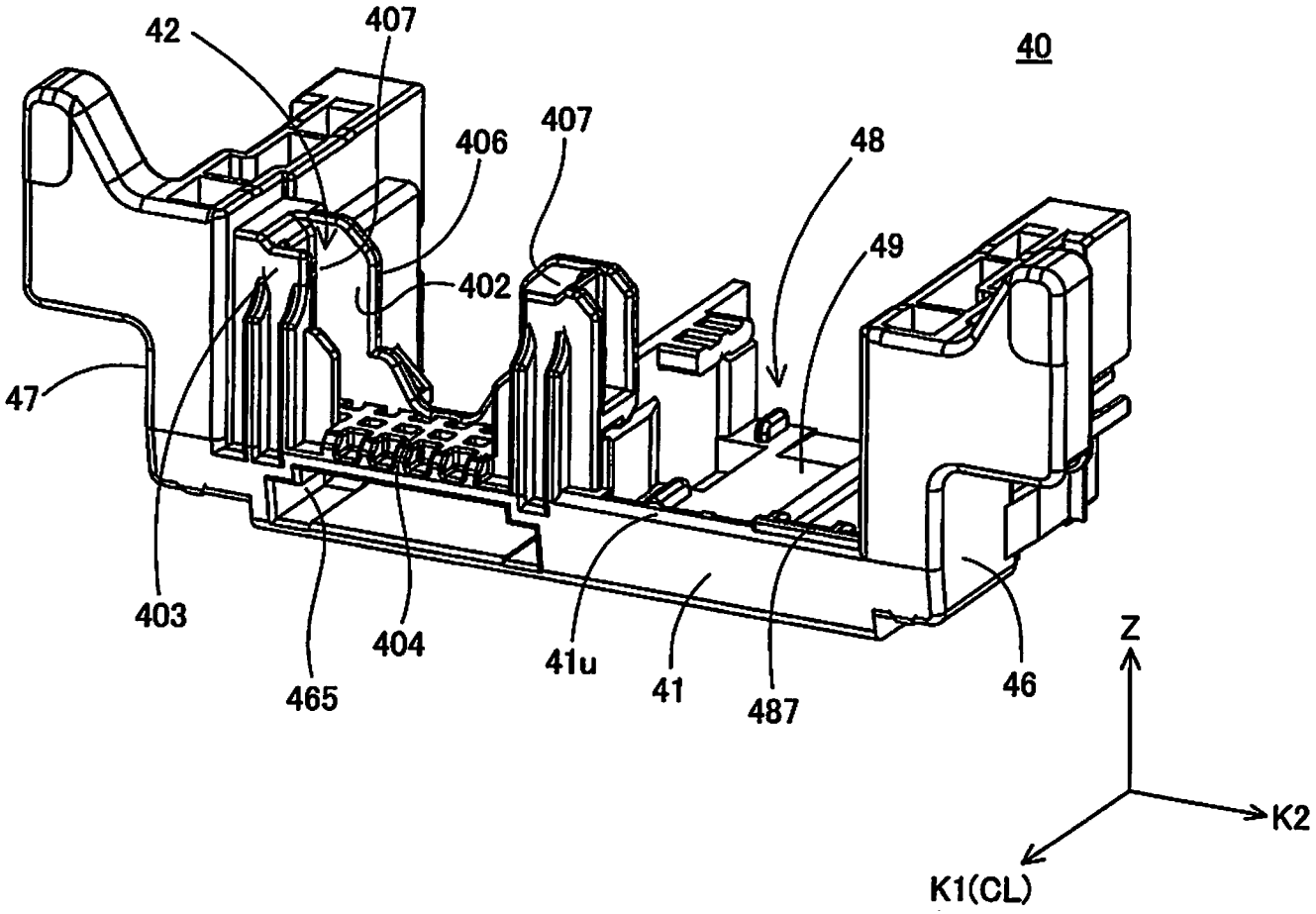
FIG. 6B is a first perspective view illustrating the movable member.
Figure 6C:
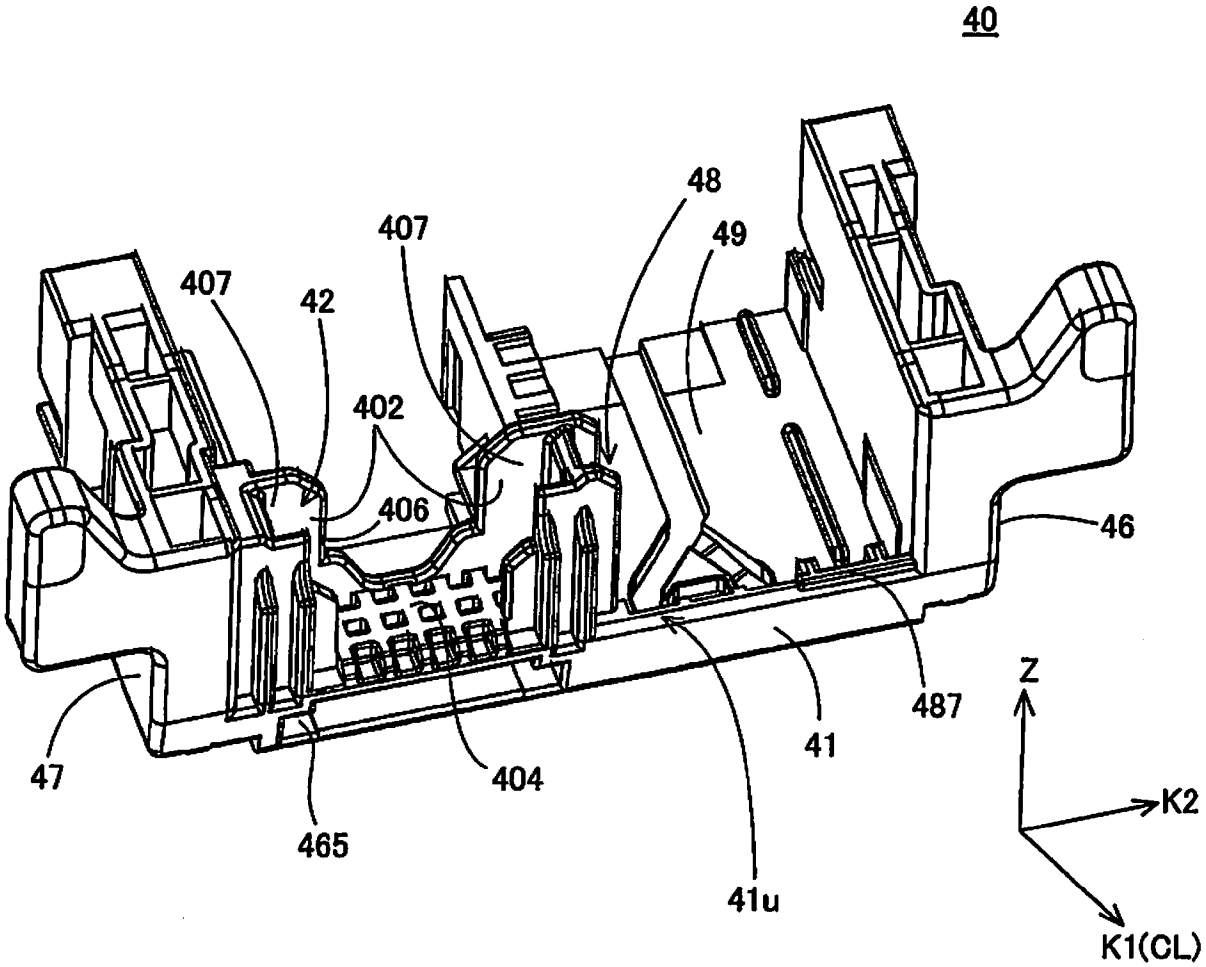
FIG. 6C is a second perspective view illustrating the movable member.
Figure 6D:
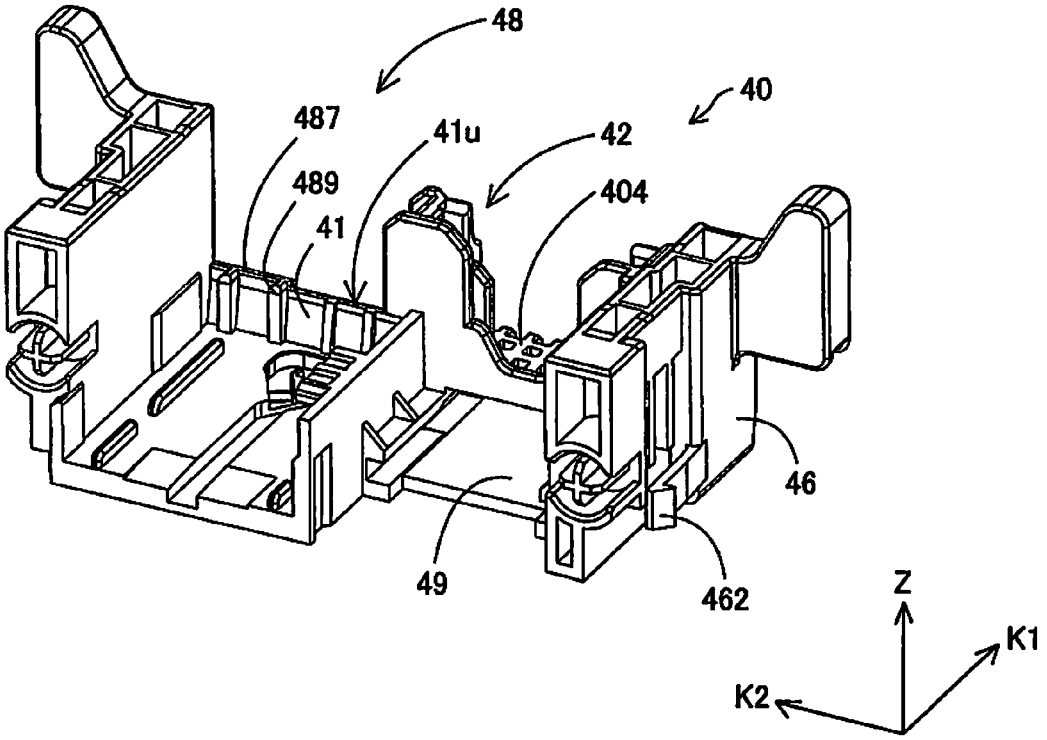
FIG. 6D is a third perspective view illustrating the movable member.

A-2. General Configuration of Mounting/Demounting Unit 30:

FIG. 5B is a front view illustrating the mounting/demounting unit 30. FIG. 5C is a first perspective view illustrating the mounting/demounting unit 30. FIG. 6A is a second perspective view illustrating the mounting/demounting unit 30. FIG. 5C illustrates a first state (set state) in which a movable member 40 is protruded outward relative to a stationary member 35. FIG. 6A illustrates a second state (mounted state) in which the movable member 40 is placed in the stationary member 35. FIG. 6B is a first perspective view illustrating the movable member 40. FIG. 6C is a second perspective view illustrating the movable member 40. FIG. 6D is a third perspective view illustrating the movable member 40. The configuration is described with regard to the mounting/demounting unit 30C as an example with reference to FIGS. 5B to 6D. The other mounting/demounting units 30K 30M and 30Y have similar configurations to that of the mounting/demounting unit 30C. As shown in FIG. 5C, the mounting/demounting unit 30 includes the stationary member 35 and the movable member (first support assembly) 40. The movable member 40 is movable in a +K1-axis direction and in a −K1-axis direction (first direction, connection direction).

The liquid container 50 is mounted to the mounting/demounting unit 30 by the following two operations. The state that the liquid container 50 is mounted to the mounting/demounting unit 30 is also called "mounted state (connected state)". The mounted state (connected state) denotes the state that the liquid supply portion 57 (flow portion 57) of the liquid container 50 described later is connected with the liquid introduction portion (liquid introduction needle) 362 of the mounting/demounting unit 30 and that the circuit board 582 of the liquid container 50 is electrically connected with the electrical connection structure 382 of the mounting/demounting unit 30. In the mounted state, the ink contained in the liquid container 50 is allowed to flow toward the printer 10.

First Operation:

The user makes the mounting/demounting unit 30 in the first state and subsequently sets the liquid container 50 on the movable member 40.

Second Operation:

After the first operation, the user presses the movable member 40 toward the stationary member 35 via the liquid container 50 and thereby makes the mounting/demounting unit 30 in the second state.

In the second state of the mounting/demounting unit 30, a lock mechanism restricts the motion of the movable member 40 in the +K1-axis direction relative to the stationary member 35. Pressing the movable member 40 inward (in the −K1-axis direction or first direction) relative to the stationary member 35 in the second state releases the lock by the lock mechanism. This enables the movable member 40 to be moved relative to the stationary member 35 such as to be protruded outward (in the +Z-axis direction) and changes over the state of the mounting/demounting unit 30 from the second state to the first state.

As shown in FIG. 5B, the stationary member 35 includes a first mounting wall 307A protruded upward in the direction of gravity and a second mounting wall 307B protruded downward in the direction of gravity. Two through holes 302H are formed in the first mounting wall 307A, and two through holes 302H are formed in the second mounting wall 307B. Screws 302 (shown in FIG. 5C) as fixing members are inserted into the respective through holes 302H. The mounting/demounting unit 30 (or more specifically the stationary member 35) is fixed to the surfaces 104 and 106 of the printer 10 (shown in FIGS. 3 and 4) by the four screws 302. More specifically, the mounting/demounting unit 30K (shown in FIG. 3) is fixed to the second surface 104 by a plurality of screws 302. The mounting/demounting units 30C, 30M and 30Y (shown in FIG. 4) are fixed to the third surface 106 by a plurality of screws 302.

As shown in FIG. 5B, the stationary member 35 includes a liquid introduction mechanism 36 and a contact mechanism (electrical connection unit) 38. The liquid introduction mechanism 36 and the contact mechanism 38 are respectively fixed to the stationary member 35, so as to be supported on the outer wall (for example, apparatus third surface 106) via the stationary member 35.

The liquid introduction mechanism 36 and the contact mechanism 38 are arranged side by side along the K2-axis direction. The liquid introduction portion (liquid supply connection structure) 362 of the liquid introduction mechanism 36 and the electrical connection structure (apparatus-side electrical connection structure) 382 of the contact mechanism 38 are arranged adjacent to each other in the K2-axis direction. With regard to the K2-axis direction, a direction from the liquid introduction mechanism 36 toward the contact mechanism 38 is +K2-axis direction, and a direction from the contact mechanism 38 toward the liquid introduction mechanism 36 is −K2-axis direction. In the mounting/demounting unit 30, the Z-axis direction is also called "height direction", the K1-axis direction is also called "width direction", and the K2-axis direction is also called "depth direction".

The liquid introduction mechanism 36 includes a liquid introduction main body 368, the liquid introduction portion 362 and supply portion positioning structures 364. The liquid supply portion of the liquid container 50 described later is connected with the liquid introduction portion 362, so as to allow the ink contained in the liquid container 50 to flow. The liquid introduction portion 362 communicates with a record head of the printer 10 through a liquid flow tube 320. The liquid flow tube 320 is a flexible hose. The liquid supply portion (liquid lead-out portion) 57 (shown in FIG. 9) of the liquid container 50 is moved in the −K1-axis direction (first direction) accompanied with the motion of the movable member 40, so as to be connected with the liquid introduction portion 362.

As shown in FIG. 5C, the liquid introduction portion 362 is formed in a needle-like shape in which ink is allowed to flow. The liquid introduction portion 362 is extended along a center axis CL. The direction along this center axis CL (in which the liquid introduction portion 362 is extended) is defined as K1-axis direction. The K1-axis direction is orthogonal to the Z-axis direction and the K2-axis direction. A plane defined by the K1-axis direction and the K2-axis direction is parallel to a plane defined by the X-axis direction and the Y-axis direction shown in FIG. 1. With regard to the K1-axis direction, an outward direction of the printer 10 is +K1-axis direction, and an inward direction of the printer 10 is −K1-axis direction. The liquid introduction portion 362 and the supply portion positioning structures 364 are provided on the liquid introduction main body 368 such as to be protruded in the +K1-axis direction from the liquid introduction main body 368.

As shown in FIG. 5B, the supply portion positioning structures 364 are arranged to surround the liquid introduction portion 362 about the center axis CL (shown in FIG. 5C). The supply portion positioning structures 364 serve to position the liquid supply portion 57 in a direction intersecting with the K1-axis direction (direction along a plane parallel to the Z-axis direction and the K2-axis direction according to this embodiment) in the process of connecting the liquid supply portion (liquid lead-out portion) 57 with the liquid introduction portion 362.

The supply portion positioning structures 364 include a first supply portion positioning structure 364*a*, a second supply portion positioning structure 364*b*, a third supply portion positioning structure 364*c* and a fourth supply portion positioning structure 364*d*. The first to the fourth supply portion positioning structures 364*a* to 364*d* are members respectively protruded from the liquid introduction main body 368. The first supply portion positioning structure 364*a* is projected on the +K1-axis direction side of the other supply portion positioning structures 364*b* to 364*d*. The first supply portion positioning structure 364*a* is located immediately above the liquid introduction portion 362 and is projected on the +K1-axis direction side of the liquid introduction portion 362. In other words, the first supply portion positioning structure 364*a* is arranged to overlay the liquid introduction portion 362.

The first supply portion positioning structure 364*a* is located above the liquid introduction portion 362 in the direction of gravity (on the +Z-axis direction side of the liquid introduction portion 362). The second supply portion positioning structure 364*b* is located on the −K2-axis direction side of the liquid introduction portion 362. The third supply portion positioning structure 364*c* is located on the +K2-axis direction side of the liquid introduction portion 362. The fourth supply portion positioning structure 364*d* is located below the liquid introduction portion 362 in the direction of gravity (on the −Z-axis direction side of the liquid introduction portion 362). The first and the fourth supply portion positioning structures 364*a* and 364*d* are opposed to each other across the liquid introduction portion 362 in the direction of gravity. The second and the third supply portion positioning structures 364*b* and 364*c* are opposed to each other across the liquid introduction portion 362 in the K2-axis direction.

The first to the fourth supply portion positioning structures 364*a* to 364*d* respectively have planes that are arranged to face the liquid introduction portion 362. The liquid supply portion 57 of the liquid container 50 abuts on these planes, so that the liquid supply portion 57 is positioned relative to the liquid introduction portion 362 in a plane direction perpendicular to the K1-axis direction.

As shown in FIG. 5B and FIG. 6A, the liquid introduction main body 368 further has a guide structure 365 located below the liquid introduction portion 362 in the direction of gravity. The guide structure 365 is a plate-like member extended in the +K1-axis direction from a lower end of the liquid introduction main body 368. The guide structure 365 is placed in a guiding portion 465 that is included in the movable member 40 and is provided as a through hole as described later. The guide structure 365 is placed in the guiding portion 465 with some backlash in the Z-axis direction. This configuration allows the position of the movable member 40 to be finely adjusted relative to the liquid introduction portion 362 in the Z-axis direction when the movable member 40 is moved in the K1-axis direction.

As shown in FIGS. 5B to 6A, the contact mechanism 38 includes the electrical connection structure (apparatus-side electrical connection structure) 382 with a plurality of (nine in this embodiment) apparatus-side terminals 381 and a plurality of (two in this embodiment) apparatus-side board positioning structures 384 and 385. In the mounted state of the liquid container 50, the apparatus-side terminals 381 of the electrical connection structure 382 come into contact with and are thereby electrically connected with a circuit board of the liquid container 50. This allows for communication of various pieces of information (for example, the color of ink and the date of manufacture of the liquid container 50) between the circuit board of the liquid container 50 and the printer 10. The apparatus-side terminal 381 is formed from an elastically deformable metal leaf spring. The apparatus-side board positioning structures 384 and 385 are arranged with the apparatus-side terminals 381 of the electrical connection structure 382 placed therebetween in the K2-axis direction (in the direction in which the liquid introduction mechanism 36 and the contact mechanism 38 are arranged side by side). The apparatus-side board positioning structures 384 and 385 serve to determine the final position of the circuit board of the liquid container 50 relative to the electrical connection structure 382 in the process of mounting the liquid container 50 to the mounting/demounting unit 30. The apparatus-side board positioning structures 384 and 385 are members extended along the K1-axis direction. The details of the apparatus-side board positioning structures 384 and 385 will be described later.

The stationary member 35 includes a protective member 354 serving as a cover portion. The protective member 354 is arranged to cover at least the upper portion of the liquid introduction mechanism 36. The protective member 354 is also arranged to cover at least the upper portion of the contact mechanism 38. In other words, the protective member 354 is located above the liquid introduction portion 362 of the liquid introduction mechanism 36 and the electrical connection structure 382 of the contact mechanism 38 and is arranged to be protruded in the +K1-axis direction (direction opposite to the first direction) from the wall surface of the printer 10 (for example, the apparatus third surface 106 shown in FIG. 2). This configuration reduces the possibility that any extraneous substance such as dust entering the housing space 26 from above the mounting/demounting unit 30 in the course of opening and closing the cover member 22 adheres to the liquid introduction portion 362 and the electrical connection structure 382. This accordingly reduces the possibility that any extraneous substance is included in the ink supplied from the liquid container 50 to the printer 10. This also reduces the likelihood that any extraneous substance adheres to the electrical connection structure 382. This reduces failure in connection between the electrical connection structure 382 and the circuit board of the liquid container 50 described later. The presence of the protective member 354 also reduces the likelihood that the user directly touches the liquid introduction portion 362 and the electrical connection structure 382. This reduces the possibility that the liquid introduction portion 362 and the electrical connection structure 382 are damaged.

As shown in FIG. 5C, the movable member 40 is configured to be movable along the K1-axis direction relative to the stationary member 35. The movable member 40 includes a base portion 41, a supply portion support structure 42 and a board support structure 48. The base portion 41 forms a front face (front wall) of the movable member 40 located on the +K1-axis direction side. The base portion 41 is arranged approximately parallel to the Z-axis direction and the K2-axis direction. The supply portion support structure 42 and the board support structure 48 are respectively connected with the base portion 41. The supply portion support structure 42 and the board support structure 48 are members respectively extended in the +Z-axis direction (upward) from the base portion 41. The guiding portion 465 that is a hole passing through in the K1-axis direction is formed in the base portion 41. The guiding portion 465 is formed immediately below the supply portion support structure 42.

The supply portion support structure 42 is a member configured to determine the position of the liquid container 50 (more specifically, its liquid supply portion) relative to the liquid introduction portion 362. The supply portion support structure 42 comes into contact with a container body support assembly 51 of the liquid container 50 described later and thereby supports the container body support assembly 51 such that a liquid container body 52 is located below the container body support assembly 51 in the direction of gravity. When the mounting/demounting unit 30 is viewed along the K1-axis direction, the supply portion support structure 42 is provided at a position overlapping the liquid introduction portion 362. The supply portion support structure 42 is provided to form a recessed shape toward the −Z-axis direction. The supply portion support structure 42 has grooves 407 formed on respective sides in the K2-axis direction. Insertion of positioning structures of the liquid container 50 described later into the grooves 407 restricts the motion of the liquid supply portion of the liquid container 50 and roughly positions the liquid container 50 relative to the mounting/demounting unit 30. More specifically, the motion of the liquid supply portion of the liquid container 50 is restricted by a plurality of surfaces defining and forming the supply portion support structure 42 (for example, a first support surface 402, a second support surface 403 and a third support surface 404). A cutout portion 406 is formed in the first support surface 402 of the supply portion support structure 42 located on the liquid introduction portion 362-side. The cutout portion 406 is formed in a concave shape that is open on the +Z-axis direction side. When the mounting/demounting unit 30 is viewed along the K1-axis direction, the cutout portion 406 is provided at a position overlapping the liquid introduction portion 362. In the first state where the movable member 40 is moved to the most +K1-axis direction side relative to the stationary member 35, the cutout portion 406 is located on the +K1-axis direction side of the liquid introduction portion 362. As shown in FIG. 6A, a leading end of the liquid introduction portion 362 is located inside of the cutout portion 406 in the second state.

The board support structure 48 is a member configured to determine the position of the liquid container 50 (more specifically, its circuit board) relative to the contact mechanism 38. When the mounting/demounting unit 30 is viewed along the K1-axis direction, the board support structure 48 is provided at a position overlapping the contact mechanism 38. The board support structure 48 is provided to form a recessed shape toward the −Z-axis direction. The motion of the circuit board of the liquid container 50 is restricted by a plurality of surfaces defining and forming the board support structure 48 (for example, a first board support surface 482).

As shown in FIG. 6D, part of a bottom 41*u* of the board support structure 48 (top of the base portion 41) forms an apparatus-side rotation restriction element 487. The apparatus-side rotation restriction element 487 is a member projected on the +Z-axis direction side of the remaining part of the bottom 41*u*. The apparatus-side rotation restriction element 487 abuts on the liquid container 50 to restrict rotation of the liquid container 50. The board support structure 48 also has an apparatus-side restriction element 489 provided on a rear face of the base portion 41. The apparatus-side restriction element 489 is a rib formed from the bottom to the top of the rear face of the base portion 41. The apparatus-side restriction element 489 abuts on the liquid container 50 to restrict the motion of the liquid container 50 in the +K1-axis direction (direction opposite to the first direction).

As shown in FIGS. 6B to 6D, the movable member 40 further includes a first side face (first side wall) 46, a second side face (second side wall) 47 and a bottom 49 (bottom wall 49). The base portion 41, the first side face 46 and the second side face 47 are members respectively extended in the +Z-axis direction from the bottom 49. The first side face 46 and the second side face 47 are opposed to each other. The first side face 46 and the second side face 47 are approximately parallel to the Z-axis direction and the K1-axis direction. The bottom 49 is approximately parallel to the K1-axis direction and the K2-axis direction.

As shown in FIG. 6D, a locking pawl 462 is provided on the first side face 46. A locking pawl 472 (shown in FIG. 6G) is provided on the second side face 47, like the first side face 46. The locking pawls 462 and 472 are locked to the stationary member 35, so as to prevent an excessive motion of the movable member 40 in the +K1-axis direction. This configuration prevents the movable member 40 from being dropped off from the stationary member 35.

A-3. General Configuration of Liquid Introduction Mechanism 36

Figure 6E:
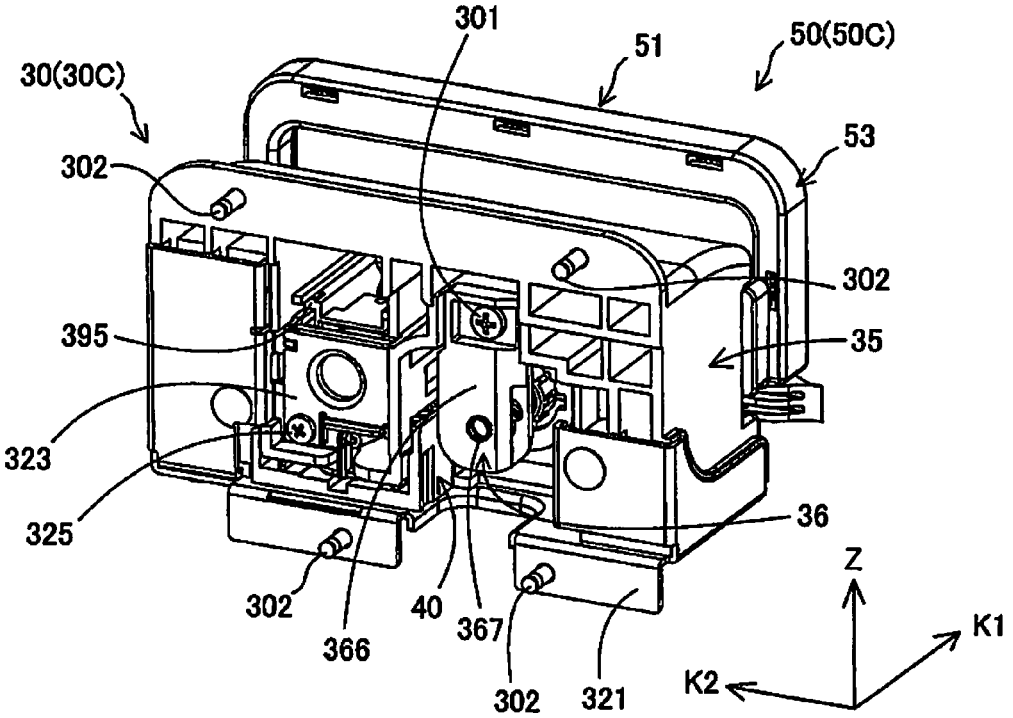
FIG. 6E is a perspective view illustrating the mounting/demounting unit.
Figure 6F:
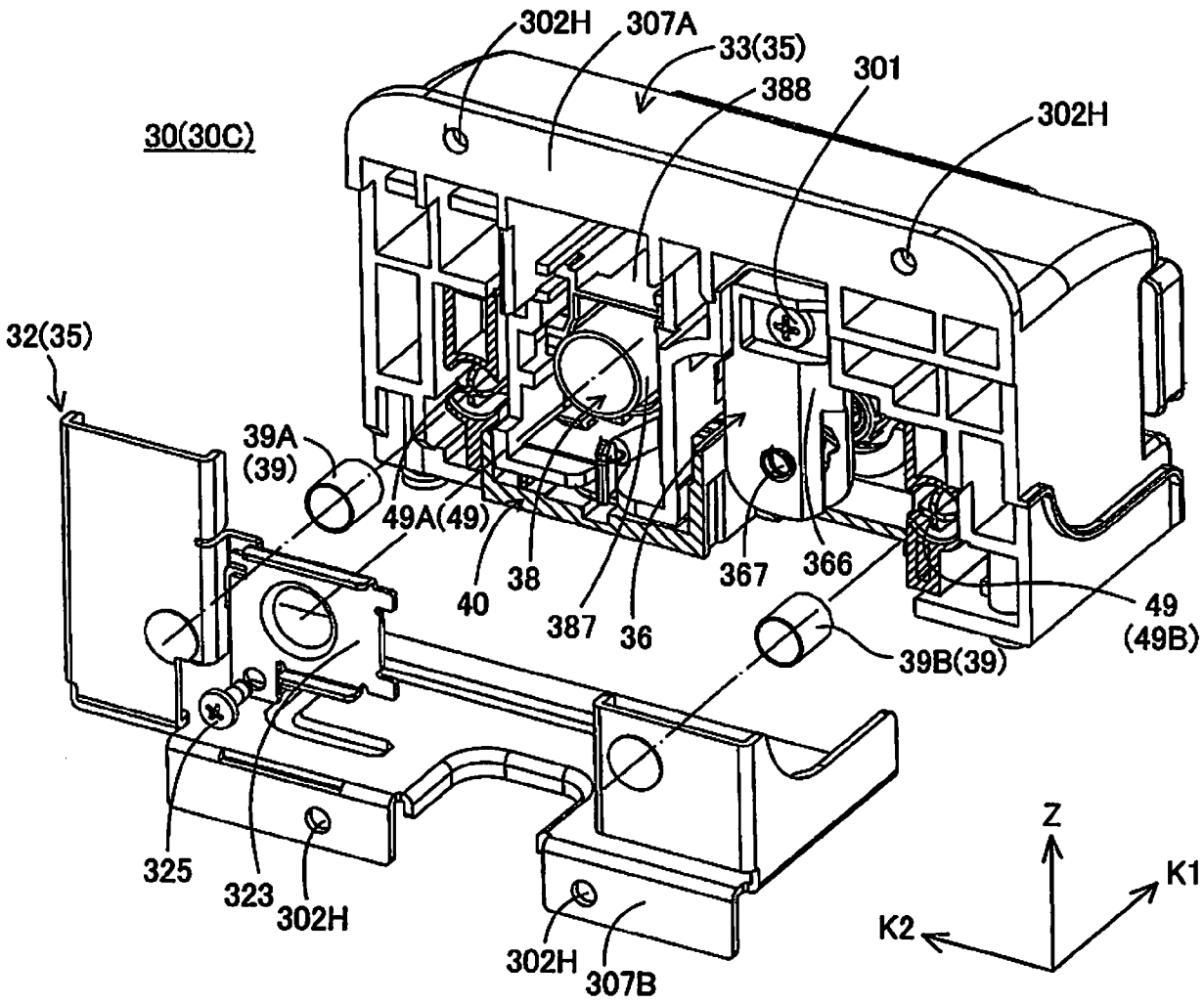
FIG. 6F is an exploded perspective view illustrating the mounting/demounting unit.
Figure 6G:
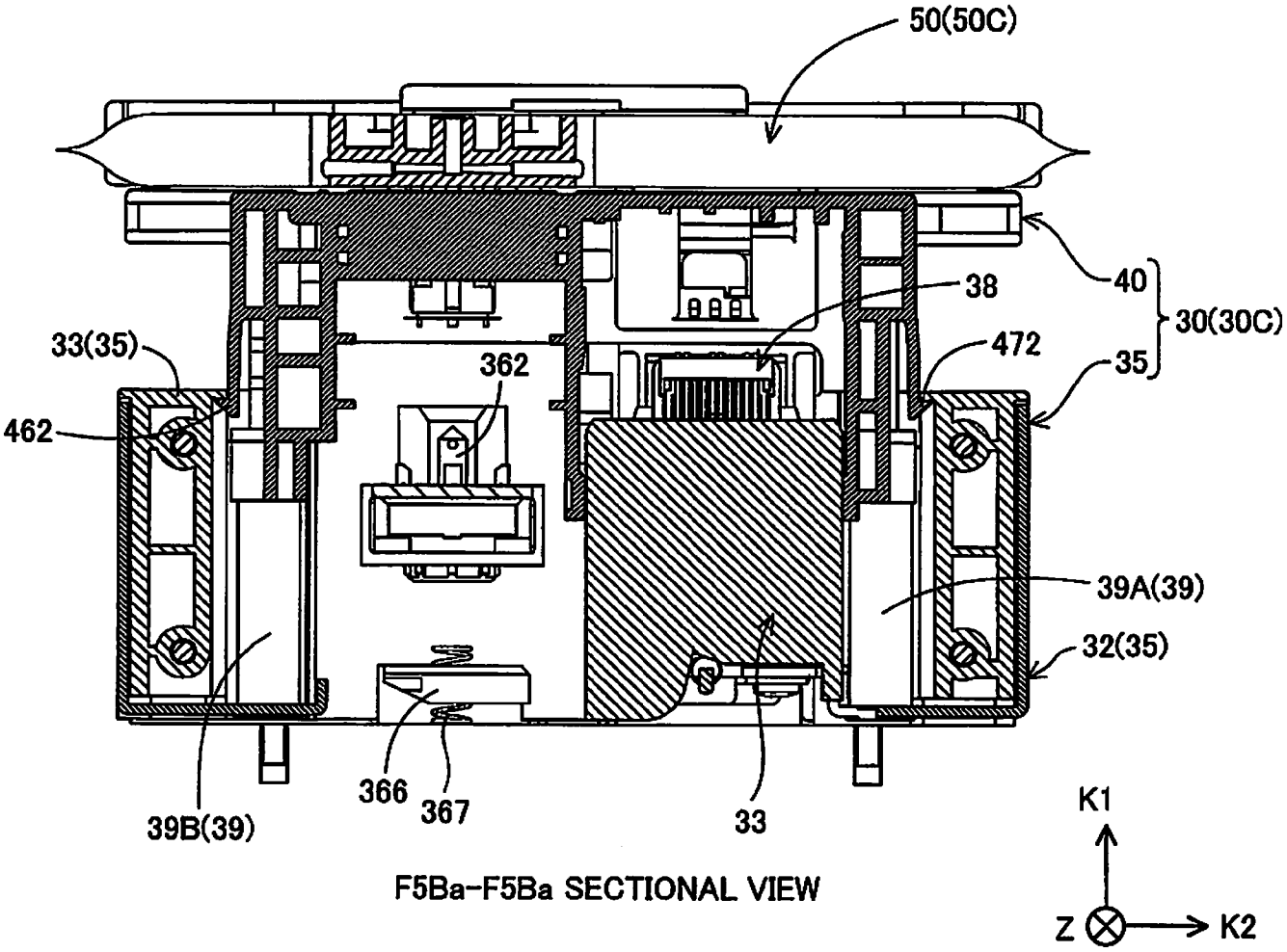
FIG. 6G is an F5Ba-F5Ba sectional view of FIG. 5B.

FIG. 6E is a perspective view illustrating the mounting/demounting unit 30. FIG. 6F is an exploded perspective view illustrating the mounting/demounting unit 30. FIG. 6G is an F5Ba-F5Ba sectional view of FIG. 5B. For the purpose of better understanding, a container body support assembly 51 of the liquid container 50 set to the mounting/demounting unit 30 is also illustrated in FIG. 6E. For the purpose of better understanding, a −K1-axis direction end face of the movable member 40 is shown by single hatching in FIG. 6F. For the purpose of better understanding, the liquid container 50 is also illustrated in FIG. 6G.

As shown in FIGS. 6E and 6F, the liquid introduction mechanism 36 is attached to the stationary member 35 (more specifically its second stationary member 33) by means of a screw 301. The liquid introduction mechanism 36 includes a fixation structure 366 as a second support structure directly attached to the stationary member 35 and a coil spring 367 as a pressing member.

The coil spring 367 is inserted through the fixation structure 366. The coil spring 367 has one end projected on the −K1-axis direction side of the fixation structure 366 and the other end projected on the +K1-axis direction side of the fixation structure 366. The liquid introduction portion 362 is pressed in the +K1-axis direction by the coil spring 367. The fixation structure 366 supports the liquid introduction mechanism 36 including the liquid introduction portion 362 to be displaceable in a direction intersecting with the first direction (−K1-axis direction). According to this embodiment, the direction intersecting with the first direction is a direction along a plane parallel to the K2-axis direction and the Z-axis direction. The details of this configuration will be described later.

As shown in FIG. 6F, the stationary member 35 includes a first stationary member 32, a second stationary member 33 and a sheet metal 323. A second mounting wall 307B is provided on the first stationary member 32, and a first mounting wall 307A is provided on the second stationary member 33. The first stationary member 32 serves as an auxiliary member to support the second stationary member 33. Two coil springs 39A and 39B are placed as pressing members between the first stationary member 32 and the movable member 40. The coil springs 39A and 39B are arranged with the contact mechanism 38 and the liquid introduction mechanism 36 placed therebetween in the K2-axis direction. When there is no need to distinguish between the two coil springs 39A and 39B, these are expressed by a reference sign "39".

The coil spring 39 has one end arranged to abut on the first stationary member 32 and the other end arranged to abut on the movable member 40. A spring receiver 49A of the movable member 40 is inserted in the other end of the coil spring 39A, and a spring receiver 49B of the movable member 40 is inserted in the other end of the coil spring 39B. When there is no need to distinguish between the two spring receivers 49A and 49B, these are expressed by a reference sign "49".

When the mounting/demounting unit 30 is in the second state shown in FIG. 6A, the coil spring 39 presses the movable member 40 in the +K1-axis direction. In the second state, a non-illustrated lock mechanism restricts the motion of the movable member 40 in the +K1-axis direction. When the lock mechanism is unlocked, the movable member 40 is pressed toward the +K1-axis direction by the pressing force of the coil spring 39, so that the mounting/demounting unit 30 shifts to the first state shown in FIG. 5C. As shown in FIG. 6G, the locking pawls 462 and 472 are locked to the stationary member 35, in order to prevent the movable member 40 from being excessively moved in the +K1-axis direction relative to the stationary member 35. This configuration prevents the movable member 40 from being dropped off from the stationary member 35.

As shown in FIGS. 6E and 6F, the sheet metal 323 is attached to the second stationary member 33 by means of a screw 325.

A-4. Detailed Configuration of Contact Mechanism 38 and Mounting/Demounting Unit 30

Figure 6H:
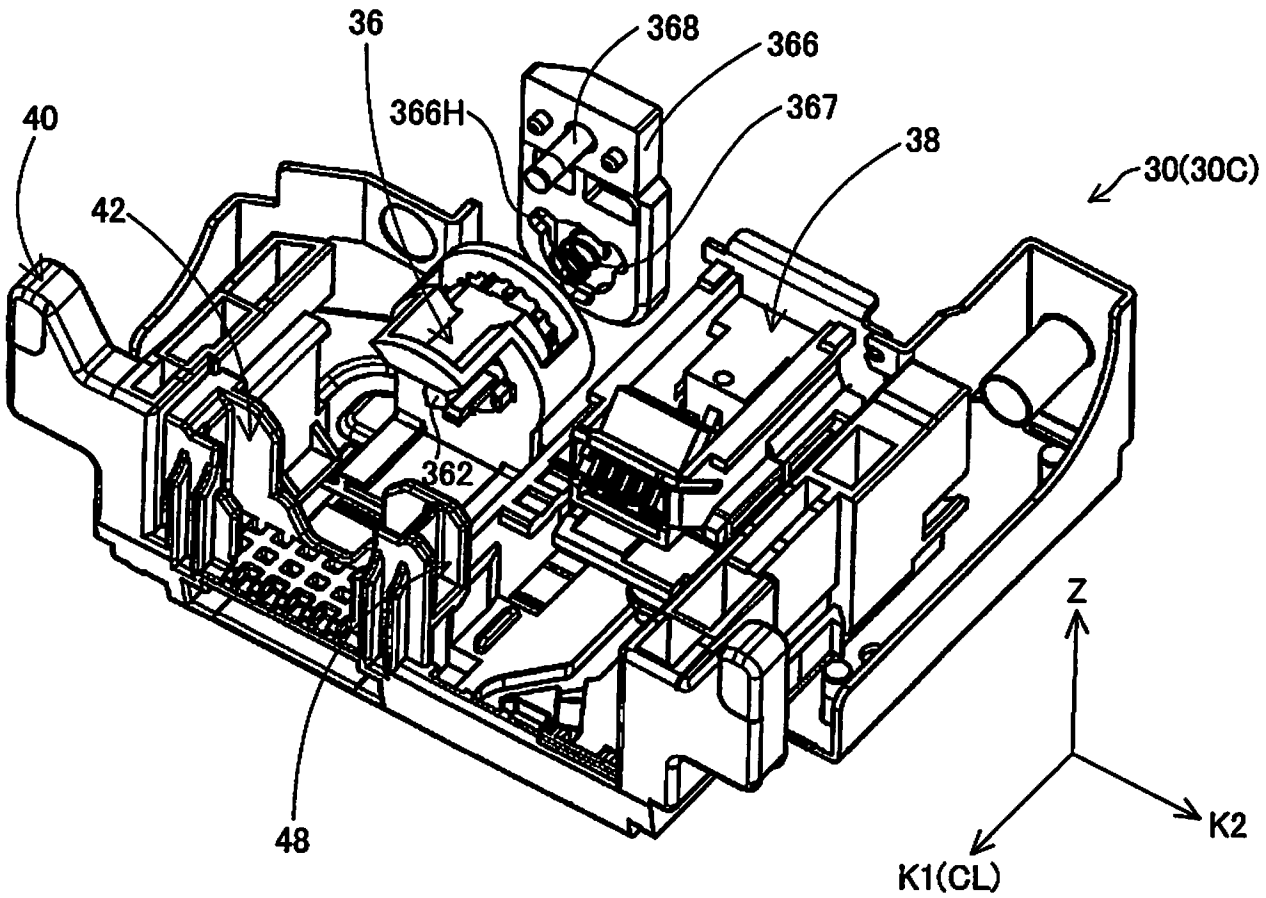
FIG. 6H is a perspective view illustrating part of the mounting/demounting unit.
Figure 6I:
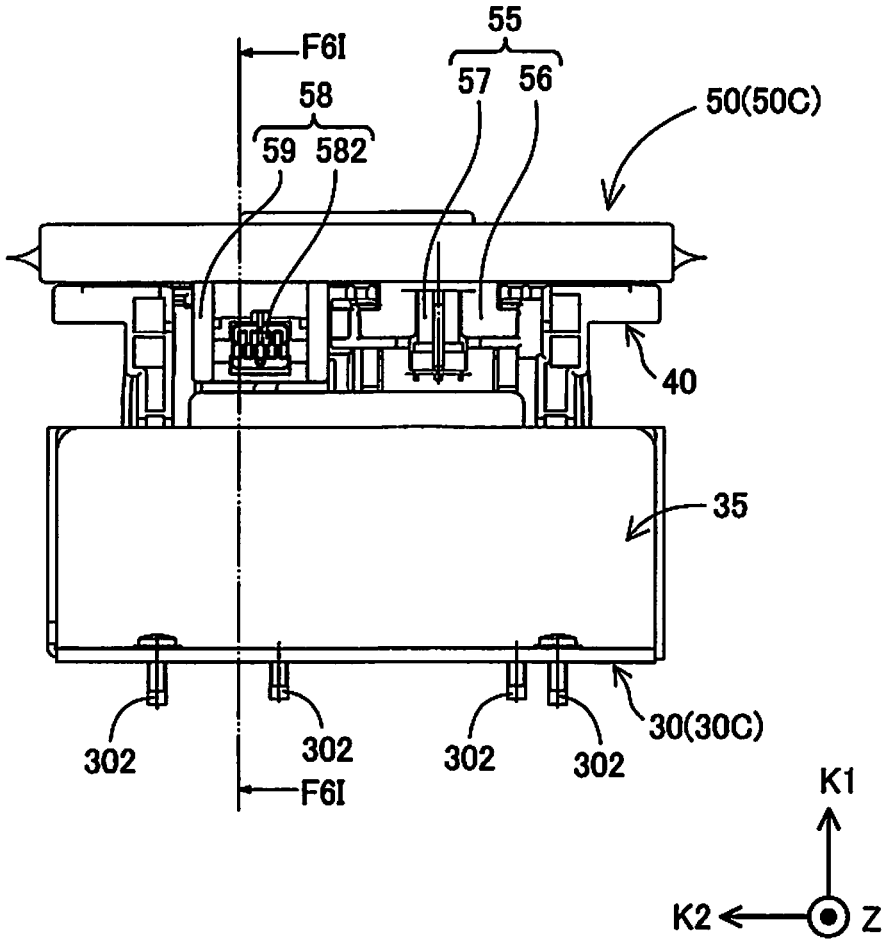
FIG. 6I is a top view illustrating the mounting/demounting unit.
Figure 6J:
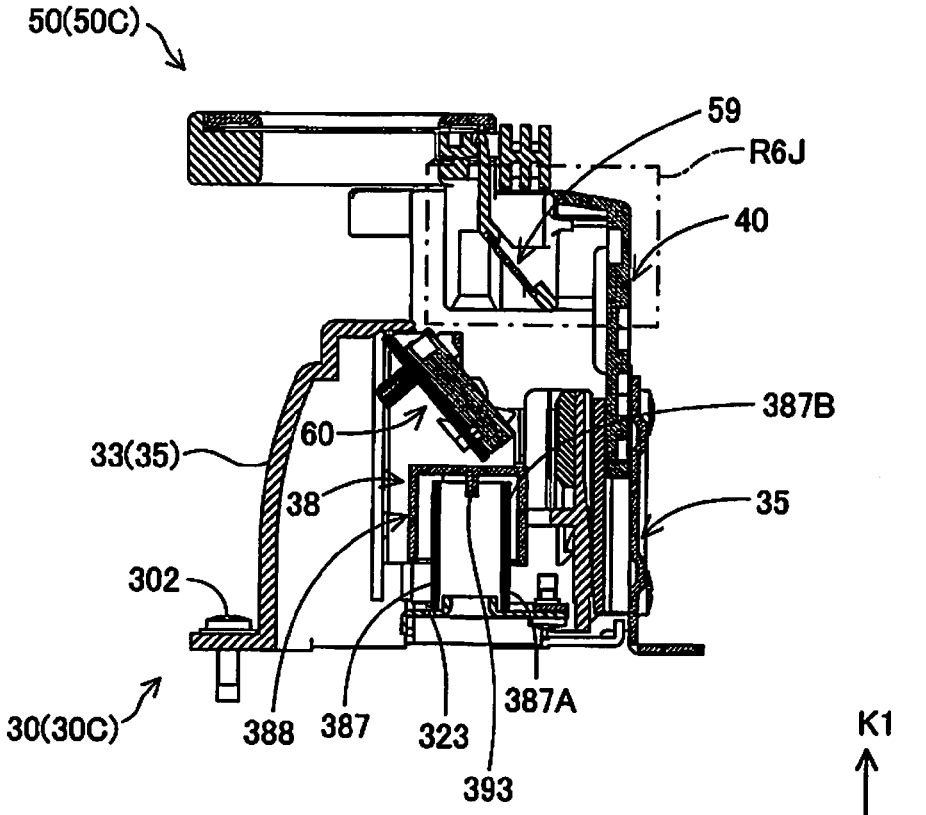
FIG. 6J is an F6I-F6I sectional view of FIG. 6I.
Figure 6K:
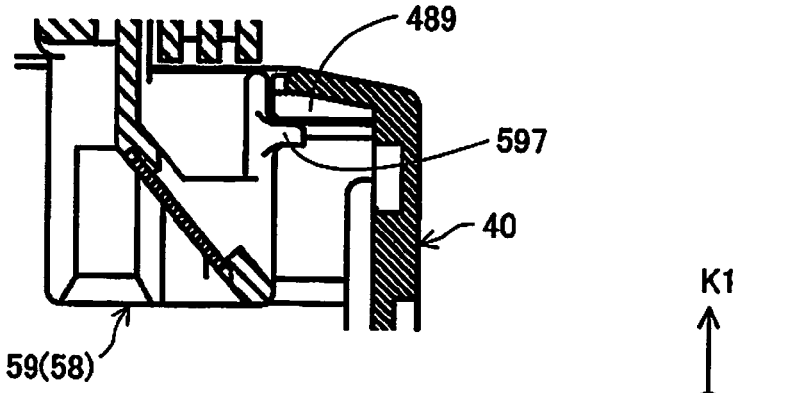
FIG. 6K is a partial enlarged view of an area R6J in FIG. 6J.
Figure 6L:
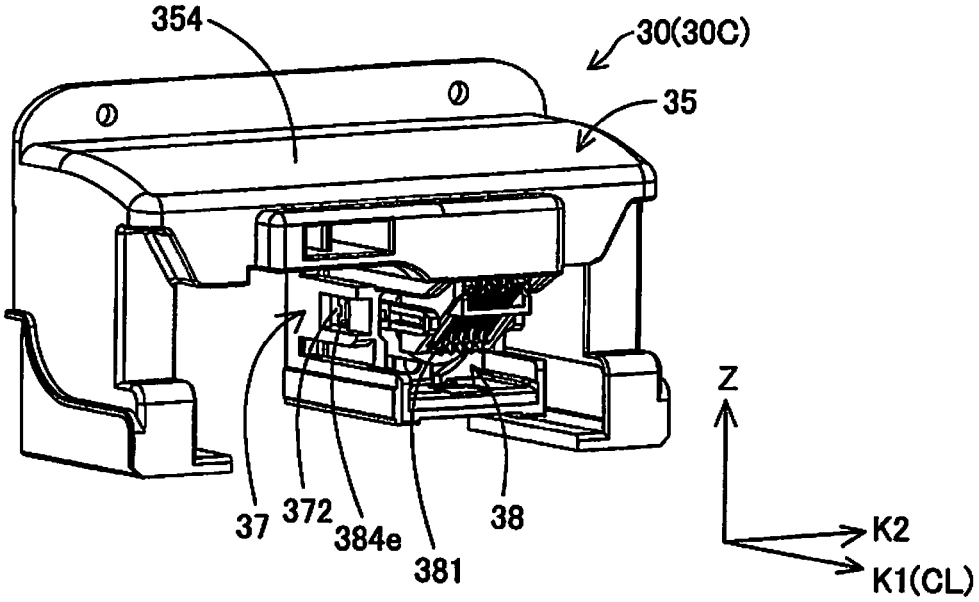
FIG. 6L is a perspective view illustrating the state that a contact mechanism is mounted to the stationary member.
Figure 6M:
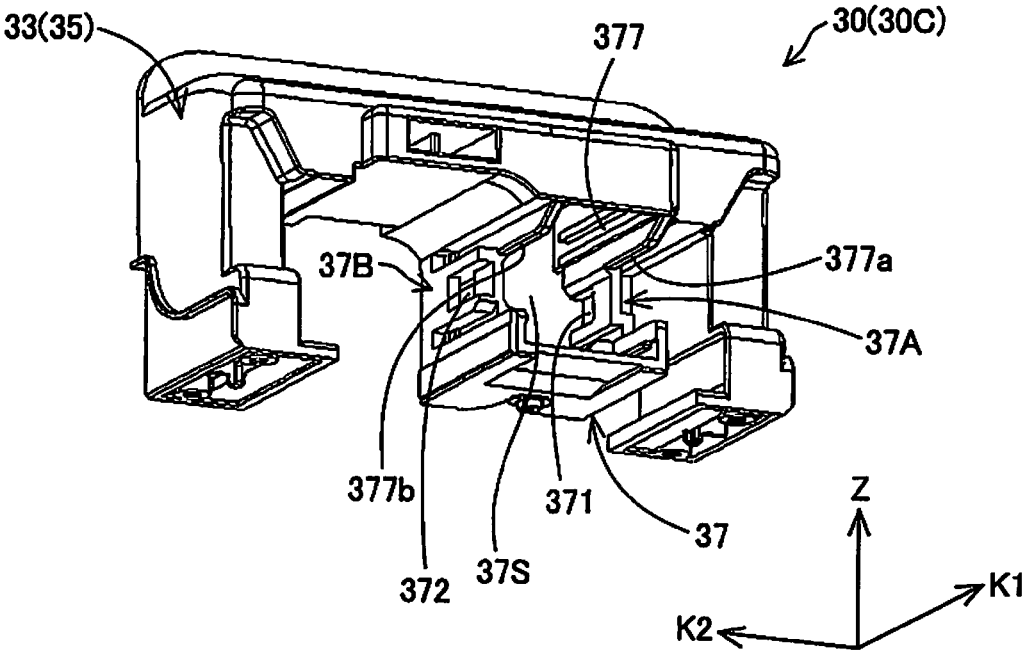
FIG. 6M is a perspective view illustrating the stationary member.
Figure 6N:
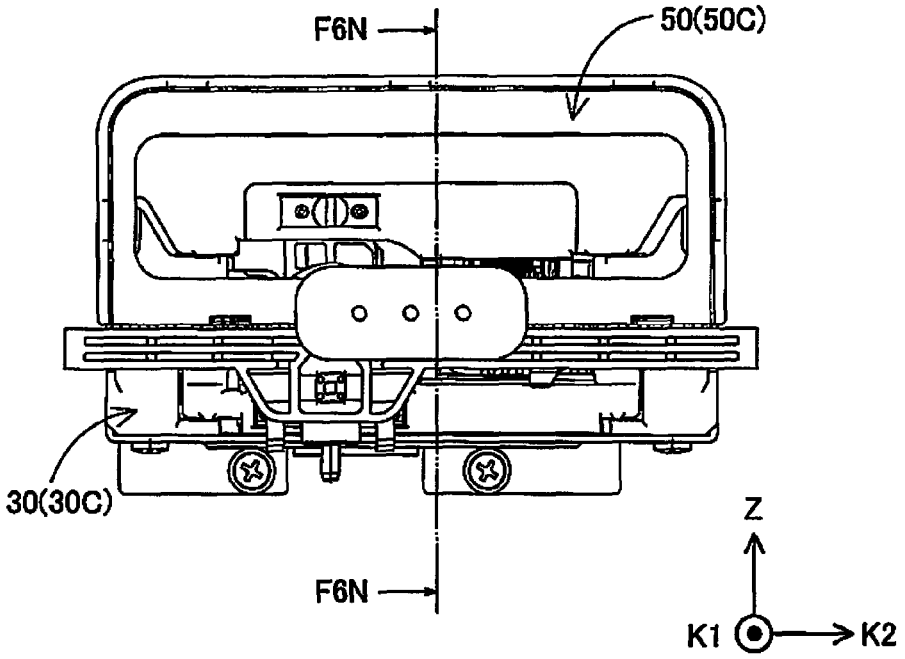
FIG. 6N is a front view illustrating the mounting/demounting unit.
Figure 6O:
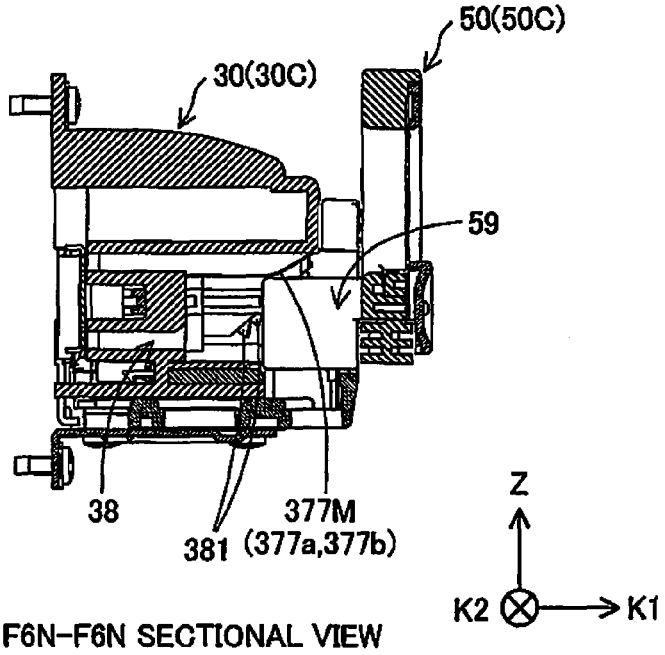
FIG. 6O is an F6N-F6N sectional view of FIG. 6N.
Figure 6P:
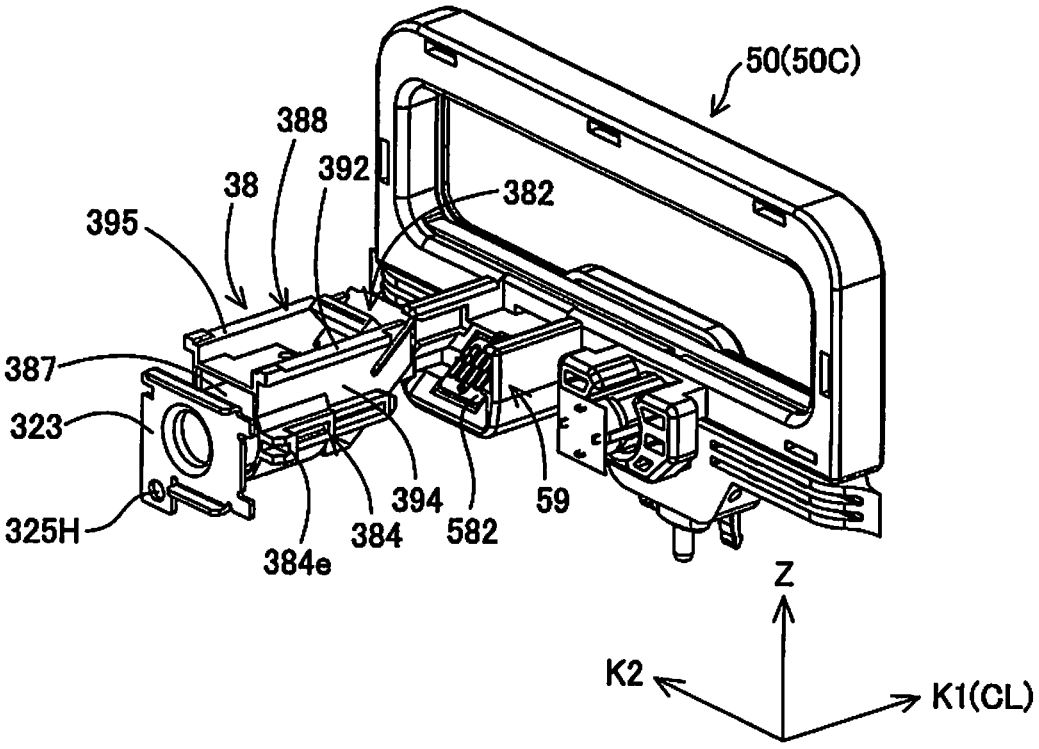
FIG. 6P is a perspective view illustrating the contact mechanism.
Figure 6Q:
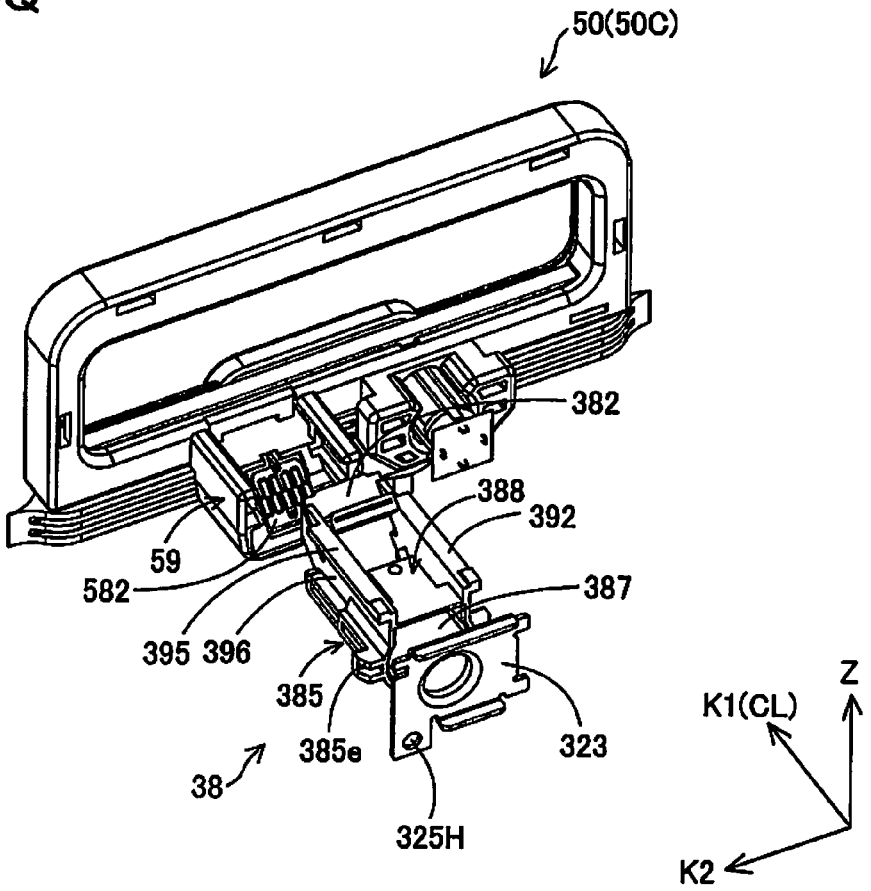
FIG. 6Q is a perspective view illustrating the contact mechanism.
Figure 6R:
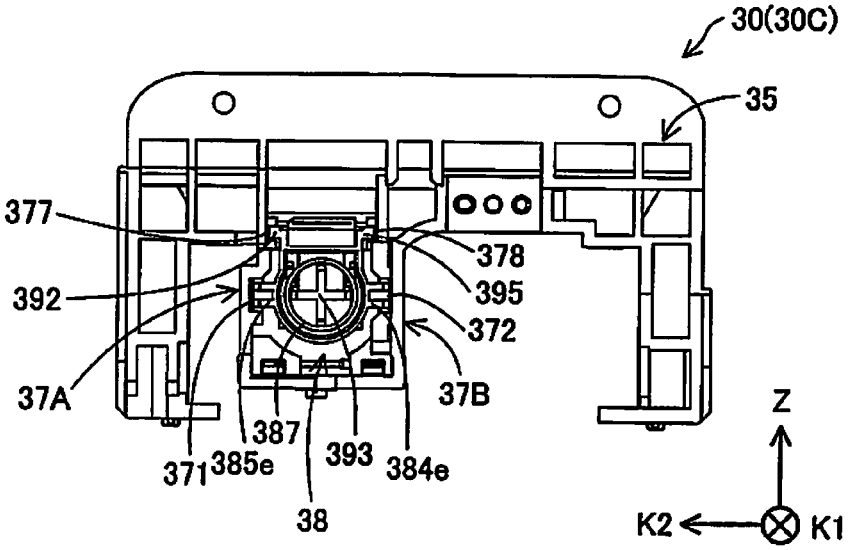
FIG. 6R is a rear view of FIG. 6E.
Figure 6S:
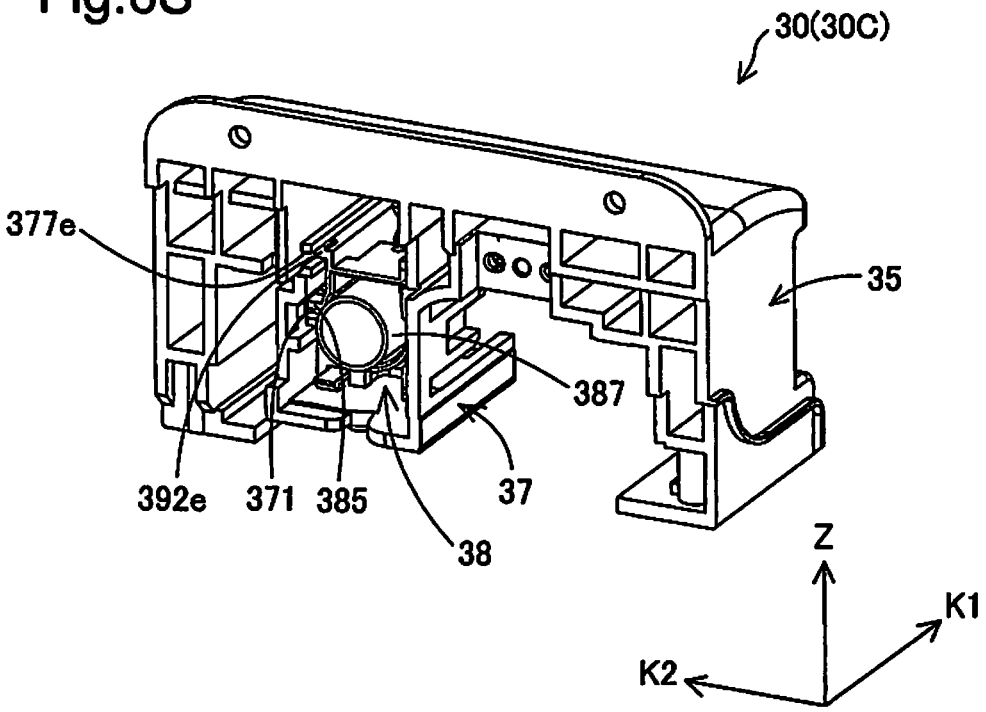
FIG. 6S is a perspective view of FIG. 6R.
Figure 6T:
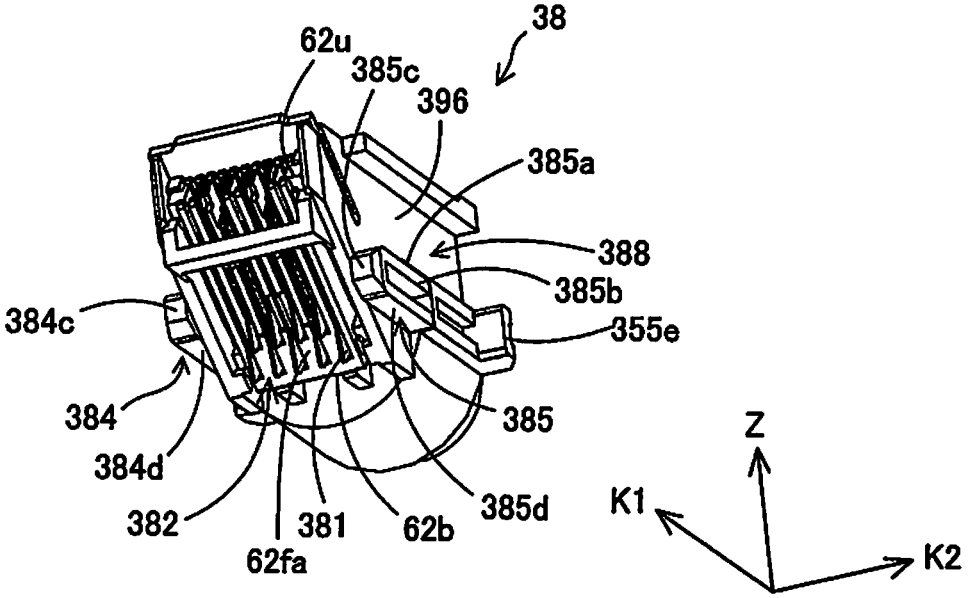
FIG. 6T is a perspective view illustrating the contact mechanism.
Figure 6U:
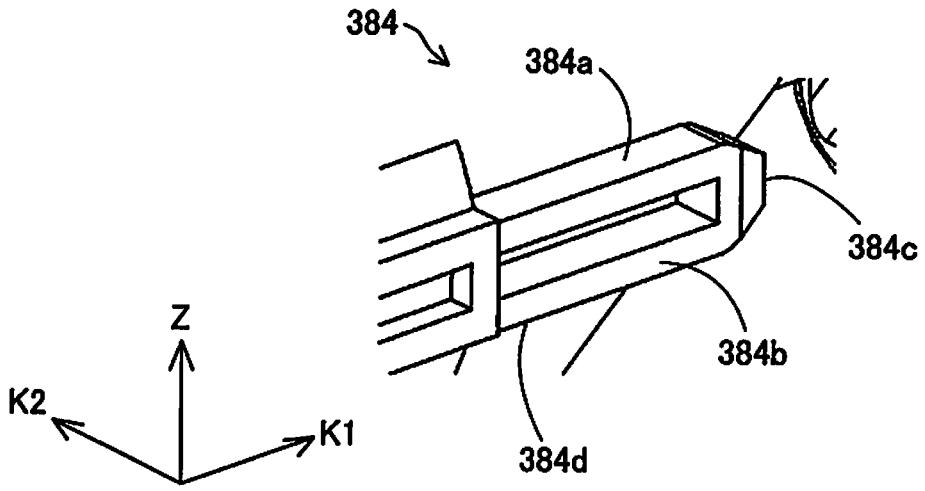
FIG. 6U is an enlarged view illustrating an apparatus-side board positioning structure of the contact mechanism.
Figure 6V:
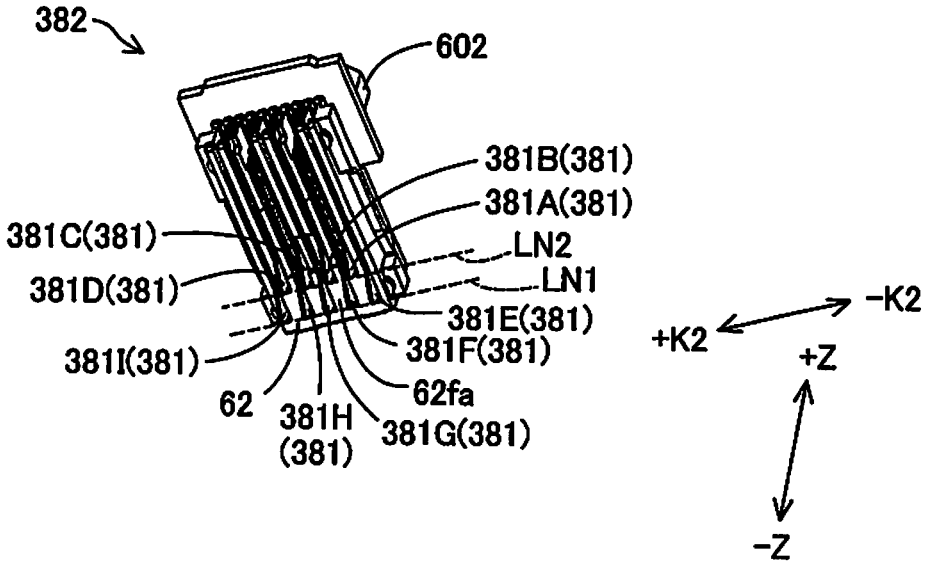
FIG. 6V is a perspective view illustrating an electrical connection structure.

The detailed configuration of the contact mechanism 38 and the mounting/demounting unit 30 is described with reference to FIGS. 6H to 6V, in addition to FIG. 6E, FIG. 6F and FIG. 6G. FIG. 6H is a perspective view illustrating part of the mounting/demounting unit 30. FIG. 6I is a top view illustrating the mounting/demounting unit 30. FIG. 6J is an F6I-F6I sectional view of FIG. 6I. FIG. 6K is a partial enlarged view of an area R6J in FIG. 6J. FIG. 6L is a perspective view illustrating the state that the contact mechanism 38 is mounted to the stationary member 35. FIG. 6M is a perspective view illustrating the stationary member 35. FIG. 6N is a front view illustrating the mounting/ demounting unit 30C. FIG. 6O is an F6N-F6N sectional view of FIG. 6N. FIG. 6P is a perspective view illustrating the contact mechanism 38. FIG. 6Q is a perspective view illustrating the contact mechanism 38. FIG. 6R is a rear view of FIG. 6E. FIG. 6S is a perspective view of FIG. 6R. FIG. 6T is a perspective view illustrating the contact mechanism 38. FIG. 6U is an enlarged view illustrating the apparatus-side board positioning structure 384 of the contact mechanism 38. FIG. 6V is a perspective view illustrating the electrical connection structure 382. The liquid container 50 is also illustrated in FIG. 6I. Part of the liquid container 50 is also illustrated in FIGS. 6N, 6P and 6Q. The sheet metal 323 and the coil spring 325 shown in FIG. 6E are omitted from the illustration of FIG. 6R.

As shown in FIGS. 6L and 6M, the second stationary member 33 has a fixation structure 37 which the contact mechanism 38 is mounted to. The contact mechanism 38 is mounted to the fixation structure 37 with some backlash. This configuration causes the electrical connection structure 382 of the contact mechanism 38 to be displaceable in a direction intersecting with the first direction (−K1-axis direction) (in the embodiment, a direction along a plane parallel to the Z-axis direction and the K2-axis direction). The details of this configuration will be described later.

As shown in FIG. 6M, the fixation structure 37 has a receiving space 37S configured to receive the contact mechanism 38 therein. The fixation structure 37 has a first partition wall 37A and a second partition wall 37B arranged to define the receiving space 37S. The first partition wall 37A forms a side face on the −K2-axis direction side of the receiving space 37S. The second partition wall 37B forms a side face on the +K2-axis direction side of the receiving space 37S.

The first partition wall 37A includes a first mounting portion 377 (right-side first mounting portion 377), a second mounting portion 371 (right-side second mounting portion 371) and an apparatus-side upper restriction portion 377*a*. The first and second mounting portions 377 and 371 are portions to which the contact mechanism 38 is mounted. The first mounting portion 377 is a groove arranged to face the receiving space 37S. The second mounting portion 371 is a through hole arranged to receive part of the contact mechanism 38 therein. The second mounting portion 371 may, however, be formed in any other shape to receive part of the contact mechanism 38 therein and may be formed as a groove. The apparatus-side upper restriction portion 377*a* is a surface facing down in the direction of gravity. The apparatus-side upper restriction portion 377*a* abuts on the substrate unit 58 when the substrate unit 58 of the liquid container 50 (shown in FIG. 7) is connected with the electrical connection structure 382 of the contact mechanism 38, so as to restrict the upward motion of the substrate unit 58 in the direction of gravity (Z-axis direction).

The second partition wall 37B has a similar configuration to that of the first partition wall 37A with difference only in their positions. More specifically, the second partition wall 37B includes a first mounting portion 378 (left-side first mounting portion 378) shown in FIG. 6R, a second mounting portion 372 (left-side second mounting portion 372) shown in FIG. 6M and an apparatus-side upper restriction portion 377*b* (shown in FIG. 6M). The first mounting portion 378 has the same configuration as that of the first mounting portion 377 of the first partition wall 37A, and the second mounting portion 372 has the same configuration as that of the second mounting portion 371 of the first partition wall 37A. The apparatus-side upper restriction portion 377*b* has the same configuration as that of the apparatus-side upper restriction portion 377*a* of the first partition wall 37A. When there is no need to distinguish between the two apparatus-side upper restriction portions 377*a* and 77*b*, these are expressed by a reference sign "377M".

As shown in FIG. 6O, the apparatus-side upper restriction portion 377M is located above the apparatus-side terminals 381 in the direction of gravity. The apparatus-side upper restriction portion 377M has a tapered +K1-axis direction end. The apparatus-side upper restriction portion 377M has a −K1-axis direction end that forms a horizontal plane. The +K1-axis direction end of the apparatus-side upper restriction portion 377M is located on the +K1-axis direction side of the apparatus-side terminals 381.

As shown in FIG. 6P, the contact mechanism 38 includes a coil spring 387 as a pressing member, the electrical connection structure 382 (shown in FIG. 5B), and a holding member 388 configured to hold the electrical connection structure 382.

As shown in FIG. 6J, a convex (spring receiver) of the sheet metal 323 is inserted in one end 387A of the coil spring 387. The one end 387A of the coil spring 387 is accordingly supported by the sheet metal 323. The other end 387B of the coil spring 387 is placed inside of the holding member 388. As shown in FIG. 6J and FIG. 6R, a rib 393 as a spring receiver is provided inside of the holding member 388. The other end 387B of the coil spring 387 is placed inside of the holding member 388 via an opening formed in a rear wall (wall on the −K1-axis direction side) of the holding member 388. The rib 393 is inserted in the other end 387B. This configuration causes the other end 387B of the coil spring 387 to be supported by the holding member 388. The coil spring 387 presses the holding member 388 in the +K1-axis direction.

As shown in FIGS. 6P, 6Q and 6T, the holding member 388 includes a first side wall 394 and a second side wall 396. The first side wall 394 and the second side wall 396 are opposed to each other. The first side wall 394 is located on the −K2-axis direction side, and the second side wall 396 is located on the +K2-axis direction side. The first side wall 394 and the second side wall 396 are surfaces approximately along the direction of gravity (Z-axis direction).

As shown in FIG. 6P and FIG. 6Q, the contact mechanism 38 includes a first contact-side positioning structure (apparatus-side board positioning structure) 384 and a second contact-side positioning structure (apparatus-side board positioning structure) 385 serving as the positioning structures (apparatus-side board positioning structures). The first and the second contact-side positioning structures 384 and 385 serve to position the circuit board 582 of the liquid container 50 (more specifically its liquid container side terminals 581 shown in FIG. 13A) and the apparatus-side terminals 381 of the electrical connection structure 382 relative to each other. More specifically, the liquid container-side terminals 581 and the apparatus-side terminals 381 are positioned relative to each other in the −K1-axis direction (first direction) and in a direction intersecting with the −K1-axis direction (direction along a plane parallel to the Z-axis direction and the K1-axis direction).

The first and the second contact-side positioning structures 384 and 385 are arranged with the electrical connection structure 382 placed therebetween in the K2-axis direction. The first and the second contact-side positioning structures 384 and 385 have similar configurations with difference only in their positions.

The first and the second contact-side positioning structures 384 and 385 are members respectively extended along the K1-axis direction (connecting direction). As shown in FIG. 6P, the first contact-side positioning structure 384 is protruded outward from the first side wall 394. As shown in FIG. 6Q, the second contact-side positioning structure 385 is protruded outward from the second side wall 396.

As shown in FIG. 6P, the first contact-side positioning structure 384 has a locking element 384*e* on its −K1-axis direction end. As shown in FIG. 6Q, the second contact-side positioning structure 385 has a locking element 385*e* on its −K1-axis direction end. The locking element 384*e* is locked to the wall surface of the second mounting portion 372 as shown in FIGS. 6L and 6M, and the locking element 385*e* is locked to the wall surface of the second mounting portion 371 (not shown). This configuration restricts the motion in the +K1-axis direction of the holding member 388 that is pressed in the +K1-axis direction by the coil spring 387 (shown in FIG. 6J).

As shown in FIG. 6U, the first contact-side positioning structure 384 has first to fourth restriction elements 384*a* to 384*d* on its +K1-axis direction end. The first to the fourth restriction elements 384*a* to 384*d* serve to position the substrate unit 58 (shown in FIG. 9) of the liquid container 50 relative to the electrical connection structure 382. More specifically, the first contact-side positioning structure 384 achieves positioning in the first direction (−K1-axis direction) and in a direction intersecting with the first direction (direction parallel to a plane defined by the Z-axis direction and the K2-axis direction).

As shown in FIG. 6U, the first restriction element 384*a* forms a top face of the first contact-side positioning structure 384. The second restriction element 384*b* forms a side face of the first contact-side positioning structure 384. As shown in FIGS. 6T and 6U, the third restriction element 384*c* forms a leading edge face of the first contact-side positioning structure 384. The fourth restriction element 384*d* forms a bottom face of the first contact-side positioning structure 384. The first restriction element 384*a* is located on the +Z-axis direction side. The second restriction element 384*b* is located on the −K2-axis direction side. The third restriction element 384*c* is located on the +K1-axis direction side. The fourth restriction element 384*d* is located on the −Z-axis direction side. The respective restriction elements 384*a* to 384*d* are approximately planar surfaces.

As shown in FIG. 6T, the second contact-side positioning structure 385 has a similar configuration to that of the first contact-side positioning structure 384. More specifically, the second contact-side positioning structure 385 has a first restriction element 385*a*, a second restriction element 385*b*, a third restriction element 385*c* and a fourth restriction element 385*d*. The first to the fourth restriction elements 385*a* to 385*d* serve to position the substrate unit 58 (shown in FIG. 9) of the liquid container 50 relative to the electrical connection structure 382. More specifically, like the first contact-side positioning structure 384, the second contact-side positioning structure 385 achieves positioning in the first direction (−K1-axis direction) and in the direction intersecting with the first direction (direction parallel to the plane defined by the Z-axis direction and the K2-axis direction). The first restriction element 385*a* forms a top face of the second contact-side positioning structure 385. The second restriction element 385*b* forms a side face of the second contact-side positioning structure 385. The third restriction element 385*c* forms a leading edge face of the second contact-side positioning structure 385. The fourth restriction element 385*d* forms a bottom face of the second contact-side positioning structure 385. The first restriction element 385*a* is located on the +Z-axis direction side. The second restriction element 385*b* is located on the +K2-axis direction side. The third restriction element 385*c* is located on the +K1-axis direction side. The fourth restriction element 385*d* is located on the −Z-axis direction side. The respective restriction elements 385*a* to 385*d* are approximately planar surfaces.

As shown in FIG. 6T, the electrical connection structure 382 is held on the +K1-axis direction side of the holding member 388. As shown in FIG. 6V, the electrical connection structure 382 includes a terminal holder 62 held on the holding member 388, nine apparatus-side terminals 381A to 381I held on the terminal holder 62 and a connector 602 held on the terminal holder 62. When there is no need to distinguish among the nine apparatus-side terminals 381A to 381I, these are expressed by a reference sign "381".

As shown in FIG. 6T, a surface 62*fa* of the terminal holder 62 is inclined such that a lower end 62*b* is located on the −K1-axis direction side of an upper end 62*u*. Respective one ends of the apparatus-side terminals 381 are exposed on the surface 62*fa*. Respective other ends of the apparatus-side terminals 381 are electrically connected with the connector 602 (shown in FIG. 6V). The connector 602 is electrically connected with a controller of the printer 10 via wiring.

As shown in FIG. 6V, the plurality of apparatus-side terminals 381A to 381I that constitute an apparatus-side terminal group are arranged in two lines LN1 and LN2 formed at different locations in the Z-axis direction. The lines LN1 and LN2 are parallel to the K2-axis direction.

As shown in FIG. 6P and FIG. 6Q, the first side wall 394 has a support wall portion 392 protruded in the −K2-axis direction (outward). The support wall portion 392 is provided on the top of the first side wall 394. The support wall portion 392 is a member extended along the K1-axis direction. The second side wall 396 has a support wall portion 395 protruded in the +K2-axis direction (outward). The support wall portion 395 is formed in a similar configuration to that of the support wall portion 392 of the first side wall 394.

The first contact-side positioning structure 384, the second contact-side positioning structure 385, the support wall portion 392 and the support wall portion 395 provided in the holding member 388 as described above are members configured to support the holding member 388 to the second stationary member 33 to be displaceable in an in-plane direction perpendicular to the K1-axis direction. The mechanism for such displacement is described in detail below.

As shown in FIG. 6R, the support wall portion 392 is inserted into the first mounting portion 377 of the fixation structure 37, while the support wall portion 395 is inserted into the first mounting portion 378 of the fixation structure 37. The locking element 385*e* is inserted into the second mounting portion 371, while the locking element 384*e* is inserted into the second mounting portion 372. The support wall portions 392 and 395 are inserted into the first mounting portions 377 and 378 with some clearance (backlash) in at least the direction of gravity (Z-axis direction). The locking elements 385*e* and 384*e* are inserted into the second mounting portions 371 and 372 with some clearance (backlash) in at least the K2-axis direction. This configuration causes the holding member 388 provided to hold the electrical connection structure 382 to be mounted to the stationary member 35 such as to be displaceable in an in-plane direction (the Z-axis direction and the K2-axis direction) perpendicular to the K1-axis direction.

As shown in FIG. 6K, a restriction element 597 provided as a projection on a circuit board holding structure 59 of the liquid container 50 described later abuts on the apparatus-side restriction element 489 provided in the movable member 40. This restricts the motion of the liquid container 50 in the +K1-axis direction (direction opposite to the first direction).

Figure 7:
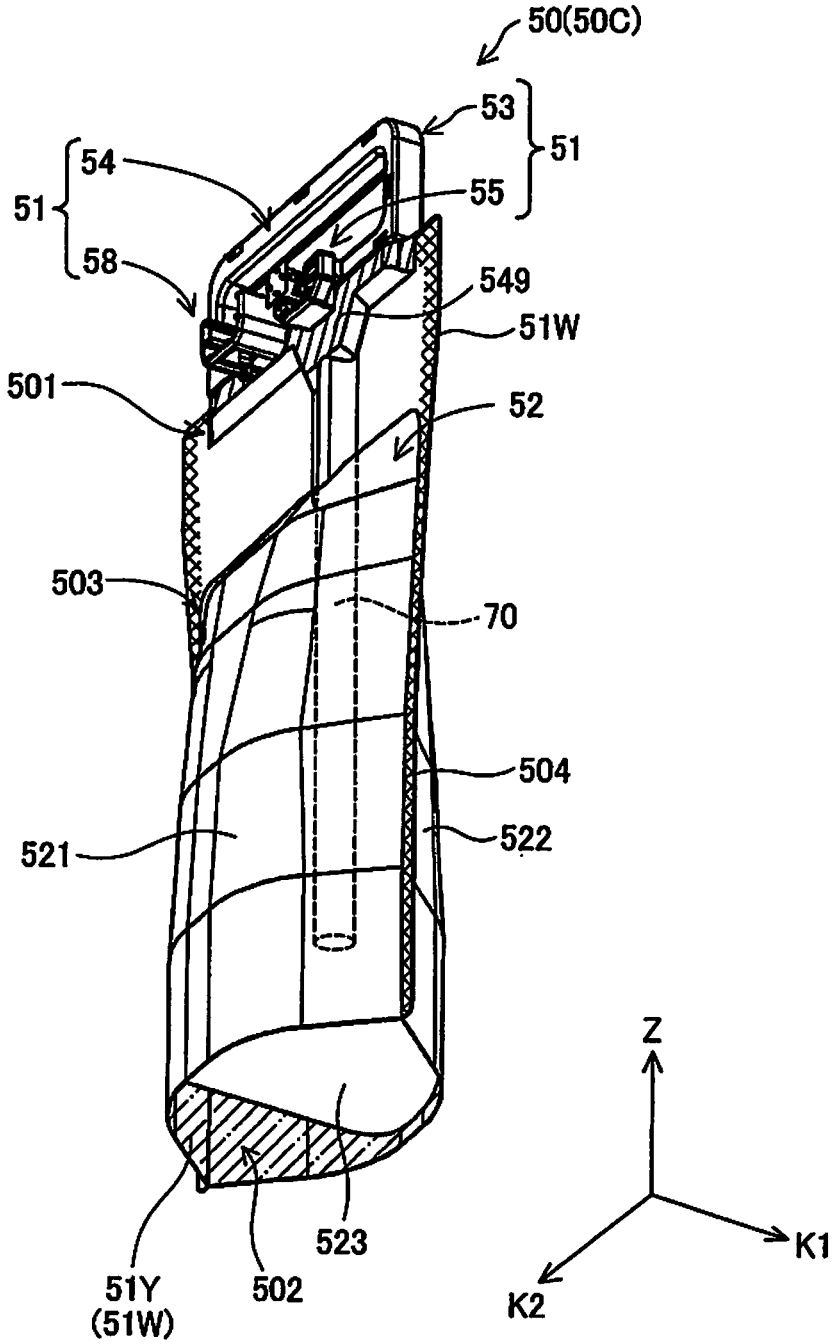
FIG. 7 is a first perspective view illustrating a liquid container.
Figure 8:
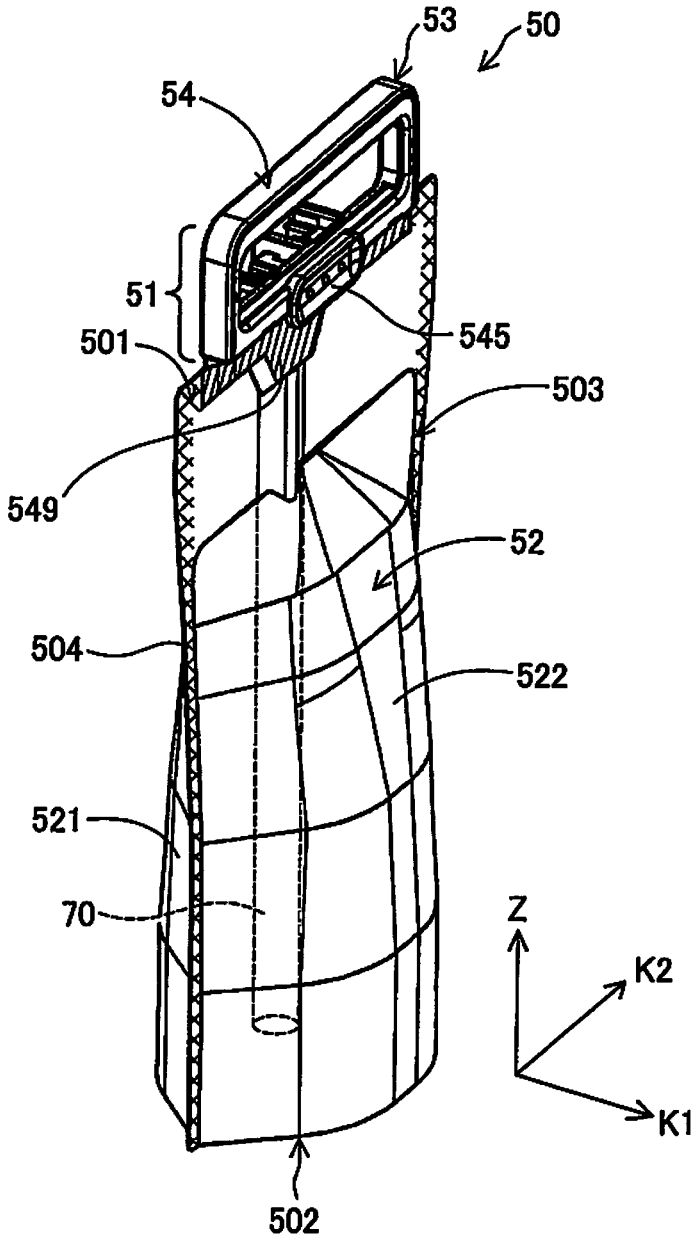
FIG. 8 is a second perspective view illustrating the liquid container.

A-5. Configuration of Liquid Container 50:

FIG. 7 is a first perspective view illustrating the liquid container 50. FIG. 8 is a second perspective view illustrating the liquid container 50. The Z axis, the K1 axis and the K2 axis in the state that the liquid container 50 is mounted to the mounting/demounting unit 30 (in the mounted state) are shown in FIGS. 7 and 8. FIGS. 7 and 8 illustrate the liquid container 50 in the state that the liquid container 50 is filled with ink as the liquid but is not yet mounted to the mounting/demounting unit 30 (prior to consumption of ink by the printer 10) (unused state or initial state). The Z axis, the K1 axis and the K2 axis that are orthogonal to one another are also shown as appropriate in subsequent drawings. The configuration is described with regard to the liquid container 50C as an example with reference to FIG. 7 and subsequent drawings. The other liquid containers 50K, 50M and 50Y have similar configurations to that of the liquid container 50C.

The Z axis, the K1 axis and the K2 axis that are orthogonal to one another may be defined as follows. In the state that the liquid container 50 is connected with the printer 10, the Z axis direction is the direction of gravity (vertical direction). The +Z-axis direction is upward in the direction of gravity (upward in the vertical direction), and the −Z-axis direction is downward in the direction of gravity (downward in the vertical direction). The K1-axis direction that is the direction along the K1 axis is the horizontal direction. The −K1-axis direction is the connecting direction (moving direction or first direction) of the liquid container 50 in the process of connecting the liquid container 50 with the printer 10. As described later, in the process of connecting the liquid container 50 to the printer 10, moving a liquid supply unit 55 described later (shown in FIG. 7) in the connecting direction (−K1-axis direction) causes the liquid supply unit 55 (more specifically, its liquid supply portion 57) to be connected with the liquid introduction portion (liquid receiving portion) 362 provided in the printer 10 and causes the substrate unit 58 (more specifically, its electrical connection structure 582) to be connected with the electrical connection structure 382 (shown in FIG. 5C) provided in the printer 10. The +K1-axis direction is the demounting direction in the process of demounting the liquid container 50 from the printer 10. The connecting direction is the −K1-axis direction that is the horizontal direction according to this embodiment, but this is not restrictive. The connecting direction may be any direction including a horizontal direction component. The K2-axis direction is a direction that is orthogonal to the direction of gravity (Z-axis direction) and the K1-axis direction.

As shown in FIG. 7, the liquid container 50 includes a liquid container body (liquid containing bag) 52 and a container body support assembly 51 attached to the liquid container body 52. The liquid container body 52 is configured to contain ink as the liquid. The liquid container body 52 is attached to the container body support assembly 51 in the state that the outer surface is exposed. In other words, the liquid container body 52 is not placed in a case or the like but is configured to be visible from outside. The volume of the liquid container body 52 decreases with reduction of ink contained therein.

The liquid container body 52 includes a first sheet 521, a second sheet 522 and a third sheet 523. The first to the third sheets 521 to 523 are configured to define a space for containing ink inside thereof. One end of the liquid container body 52 to which the container body support assembly 51 is attached is defined as one end 501 (one end portion or upper end), and an opposite end opposed to the one end 501 is defined as the other end 502 (other end portion or bottom end). One edge (+K2-axis direction edge) of the liquid container body 52 is defined as first side edge 503 (first side edge portion), and the other edge (−K2-axis direction edge) is defined as second side edge 504 (second side edge portion).

As shown in FIG. 7 and FIG. 8, in the mounted state of the liquid container 50, the first sheet 521 and the second sheet 522 form side faces of the liquid container body 52. In the mounted state of the liquid container 50, the third sheet 523 forms a bottom face of the liquid container body 52. The first sheet 521 and the second sheet 522 are arranged to face each other. Respective peripheral areas 51W of the first sheet 521 and the second sheet 522 are partly welded to each other. More specifically, one end 501-portions, first side edge 503-portions and second side edge 504-portions of the respective peripheral areas 51W are welded. For the purpose of better understanding, the welded portions of the first and the second sheets 521 and 522 are shown by cross-hatching in FIGS. 7 and 8. The container body support assembly 51 is welded to the one end 501 of the liquid container body 52 (more specifically, the respective one ends of the first and the second sheets 521 and 522). In other words, the container body support assembly 51 is a member attachable to the one end 501 of the liquid container body 52. For the purpose of better understanding, the welded portions of the container body support assembly 51 to the first and the second sheets 521 and 522 are shown by solid-line single hatching in FIGS. 7 and 8.

As shown in FIG. 7, a peripheral area 51Y of the third sheet 523 is welded to portions of the peripheral areas 51W of the first and the second sheets 521 and 522. The welded portions of the third sheet 523 to the first and the second sheets 521 and 522 are shown by one-dot chain line single hatching. As described above, the liquid container body 52 of the embodiment is in such a form that the three sheets 521, 522 and 523 are bonded by welding or the like (pouch-like form having a bottom face).

The first to the third sheets 521 to 523 are respectively flexible members. The material employed for the first to the third sheets 521 to 523 may be, for example, polyethylene terephthalate (PET), nylon or polyethylene. A laminated structure by stacking a plurality of films may be employed to form the first to the third sheets 521 to 523. In this laminated structure, for example, an outer layer may be formed from PET or nylon having excellent impact resistance and an inner layer may be formed from polyethylene having excellent ink resistance. Additionally, a film including a deposition layer of aluminum or the like may be used as one component of the laminated structure. This enhances the gas barrier property and thereby suppresses, for example, a change in concentration of ink contained in the liquid container body 52. The material of the liquid container body 52 may be determined arbitrarily as described above.

The shapes and the sizes of the respective liquid container bodies 52 may be set arbitrarily. For example, the liquid container body 52 containing black ink may have a larger capacity (larger size) than that of the liquid container body 52 containing another color (for example, cyan) ink. In another example, the liquid container body 52 is in the form that the first to the third sheets 521 to 523 are bonded by welding or the like according to the embodiment, but may be in such a form that the first and the second sheets 521 and 522 are bonded by welding or the like with omission of the third sheet 523 (pillow-like form). As described above, the liquid container body 52 and the operation member 53 are provided as separate members. This configuration allows the type (shape, size and material) of the liquid container body 52 to be readily changed, while using the same operation member 53. The shape, the size and the material of the liquid container body 52 may thus be set according to, for example, the properties and the amount of the liquid contained in the liquid container body 52. This enhances the flexibility of design.

The container body support assembly 51 includes an operation member (handle portion) 53, a liquid supply unit 55 and a substrate unit 58. The operation member 53 is a frame-like member that is open in the K1-axis direction. The operation member 53 includes a grip portion 54 located on a +Z-axis direction end and a pressed portion 545 located on a −Z-axis direction end (shown in FIG. 8). The grip portion 54 is a portion gripped by the user to support (hold) the liquid container 50. The grip portion 54 is extended along the K2-axis direction. The grip portion 54 of the operation member 53 is formed in a rectangular frame-like shape according to this embodiment but may be formed in a C shape or in a T shape.

The pressed portion 545 is a portion pressed by the user in the process of connecting the liquid container 50 with the printer 10. In other words, the pressed portion 545 is a manually pressed portion. The user presses the pressed portion 545 in the −K1-axis direction (connecting direction), so as to move the movable member 40 (shown in FIG. 6I) with the liquid container 50 set thereon in the −K1-axis direction. The pressed portion 545 is provided on the opposite side of the operation member 53 opposite to the side where the liquid supply unit 55 and the substrate unit 58 are provided. The pressed portion 545 is provided on a −Z-axis direction end of the operation member 53. The pressed portion 545 is provided to be protruded outward (in the +K1-axis direction) from the operation member 53. This configuration facilitates discrimination of the pressed portion 545 from the remaining part.

As shown in FIG. 7, the liquid supply unit 55 and the substrate unit 58 are provided on a −Z-axis direction end of the operation member 53. The liquid supply unit 55 and the substrate unit 58 are arranged side by side in the K2-axis direction. The liquid supply unit 55 serves to supply ink contained in the liquid container body 52 to outside (for example, the liquid introduction portion 362 shown in FIG. 5B). The substrate unit 58 serves to be electrically connected with the apparatus-side terminals 381 of the contact mechanism 38. The liquid supply unit 55 and the substrate unit 58 are provided to be protruded outward (in the −K1-axis direction) from the operation member 53. The liquid supply unit 55 and the substrate unit 58 are protruded in the same direction. The protruding direction of the substrate unit 58 and the protruding direction of the liquid supply portion 57 may not be necessarily identical with each other but may be arranged approximately parallel to each other. The substrate unit 58 and the liquid supply unit 55 are protruded from the operation member 53 toward the same direction (−K1-axis direction) relative to the operation member 53.

Figure 9:
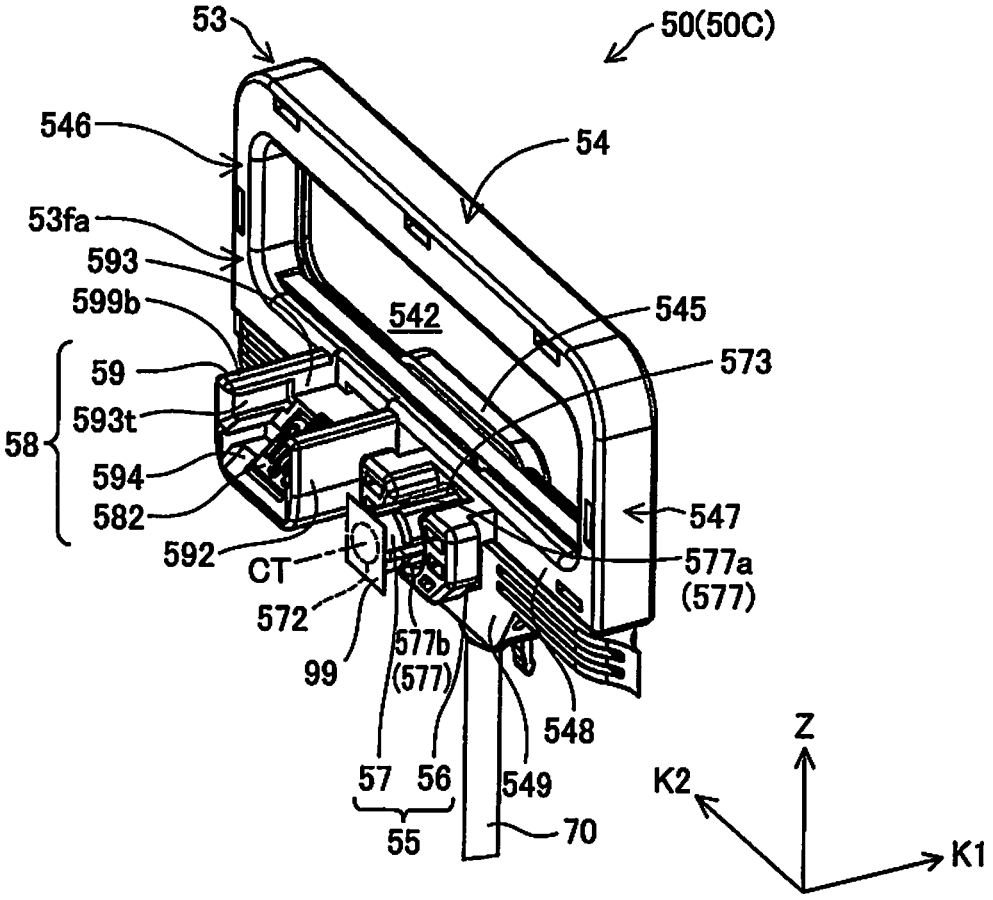
FIG. 9 is a first perspective view illustrating part of the liquid container.
Figure 10:
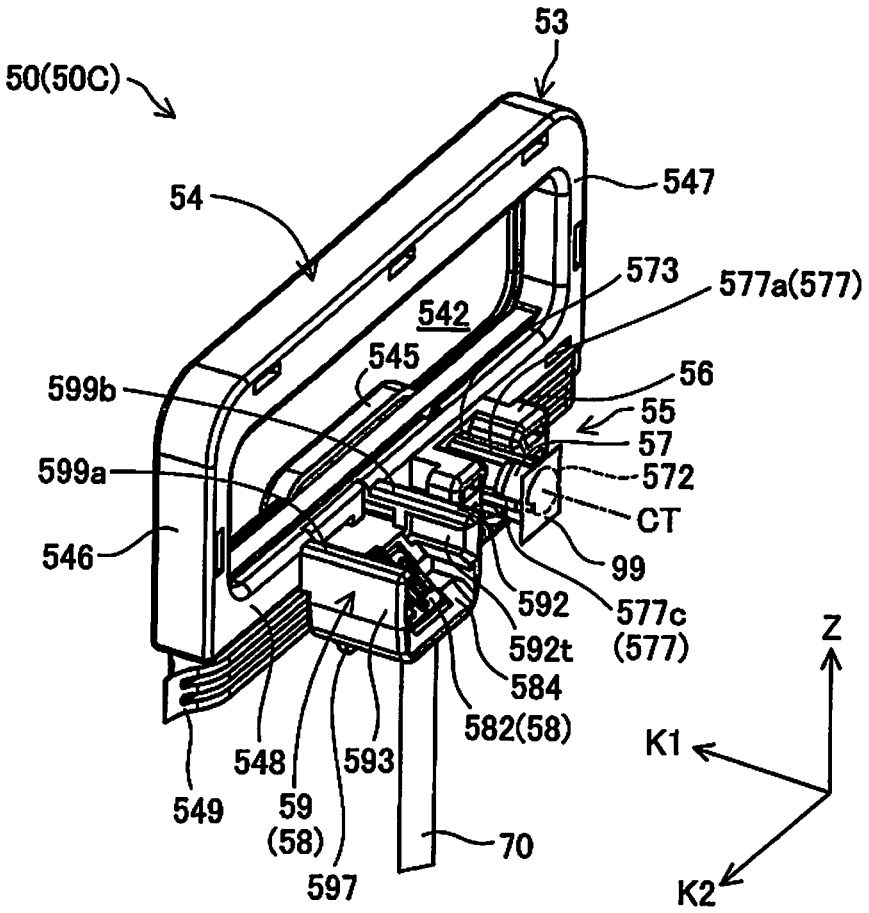
FIG. 10 is a second perspective view illustrating part of the liquid container.
Figure 11:
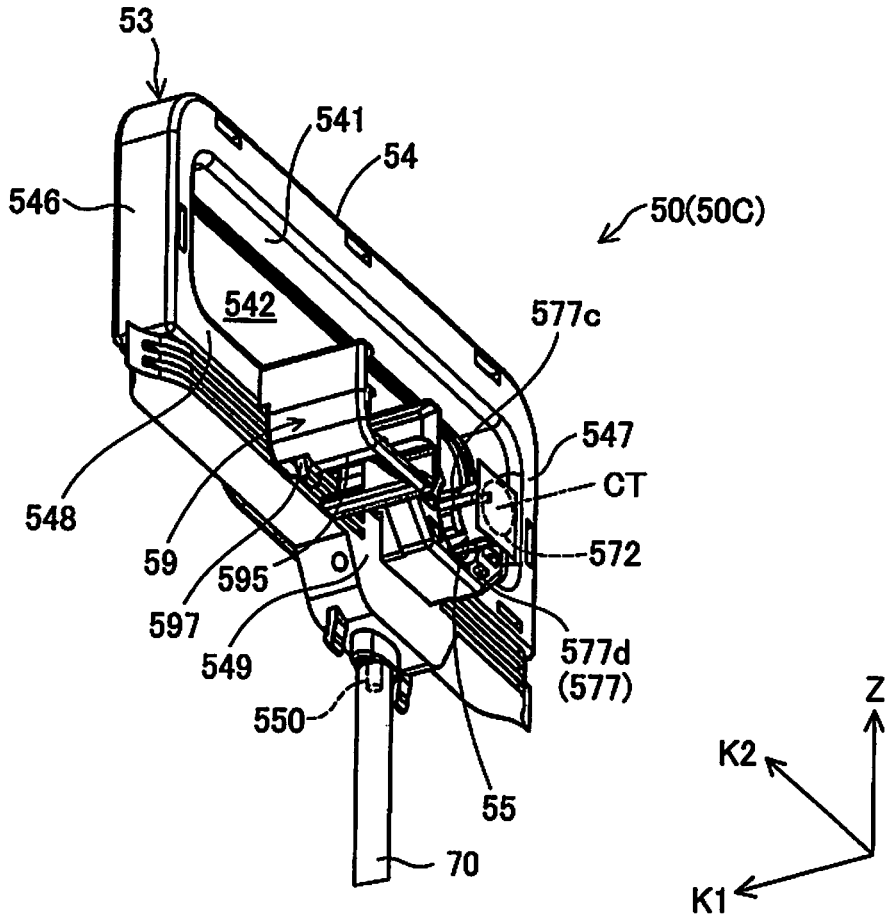
FIG. 11 is a third perspective view illustrating part of the liquid container.
Figure 12:
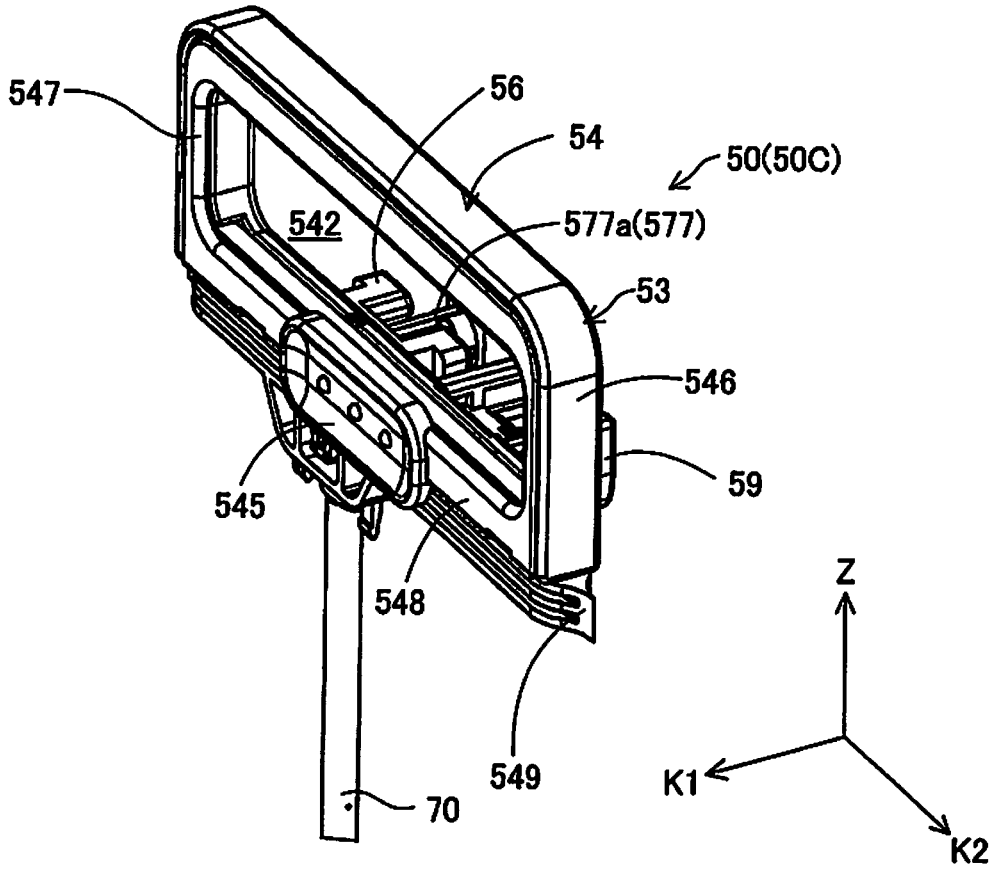
FIG. 12 is a fourth perspective view illustrating part of the liquid container.
Figure 13:
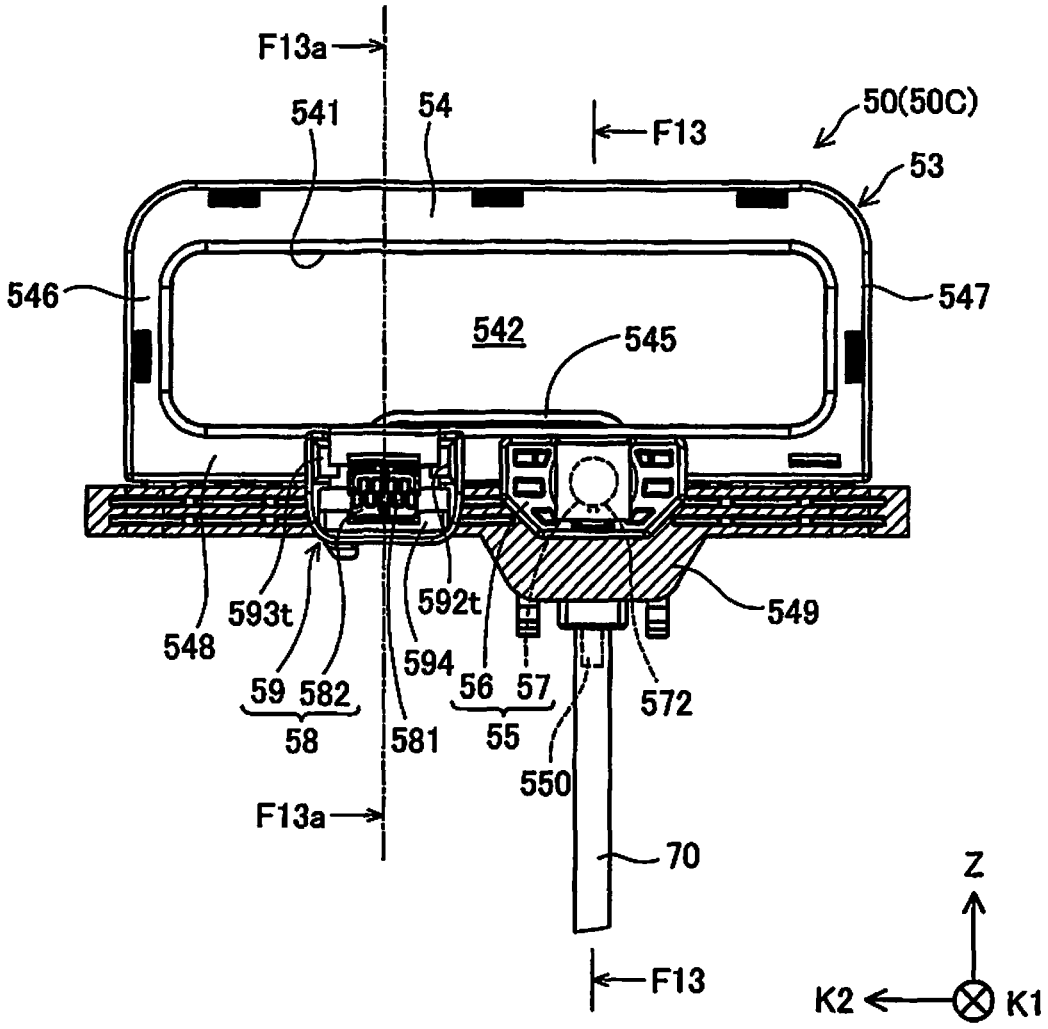
FIG. 13 is a front view illustrating part of the liquid container.
Figure 14:
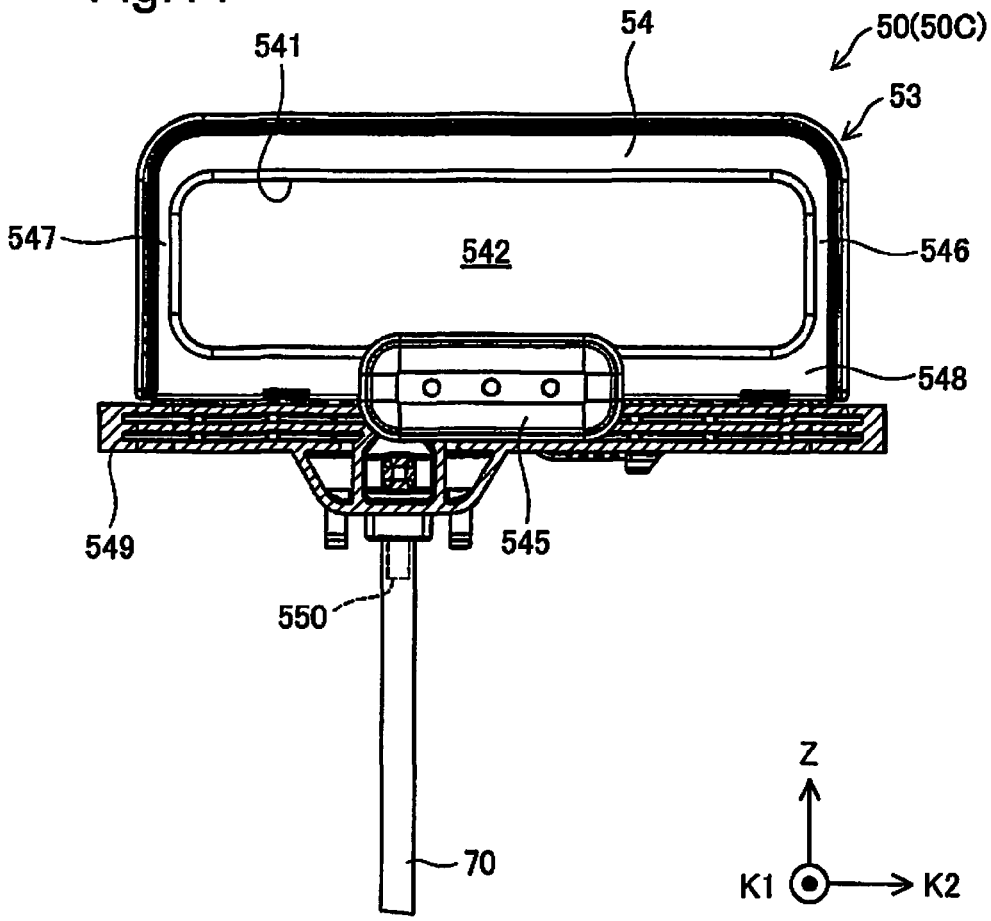
FIG. 14 is a rear view illustrating part of the liquid container.
Figure 15:
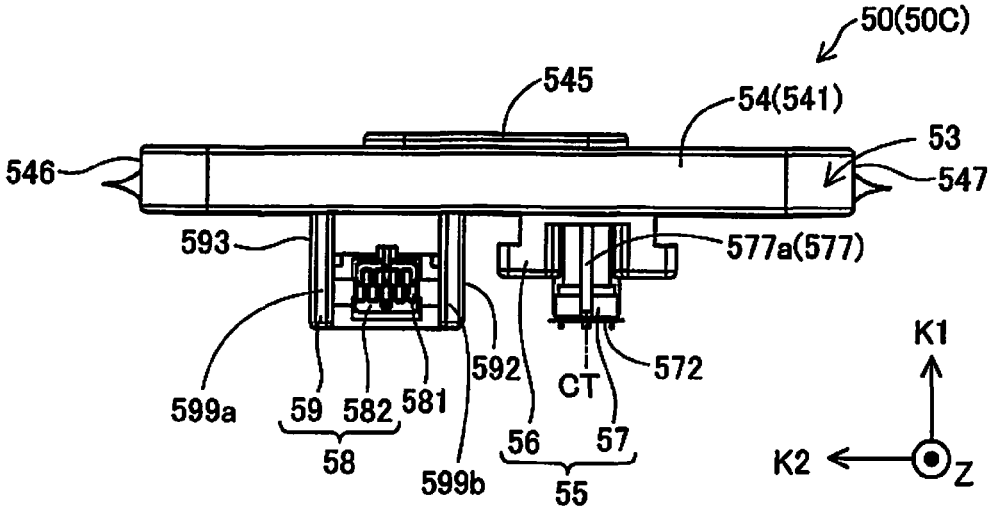
FIG. 15 is a top view illustrating part of the liquid container.
Figure 16:
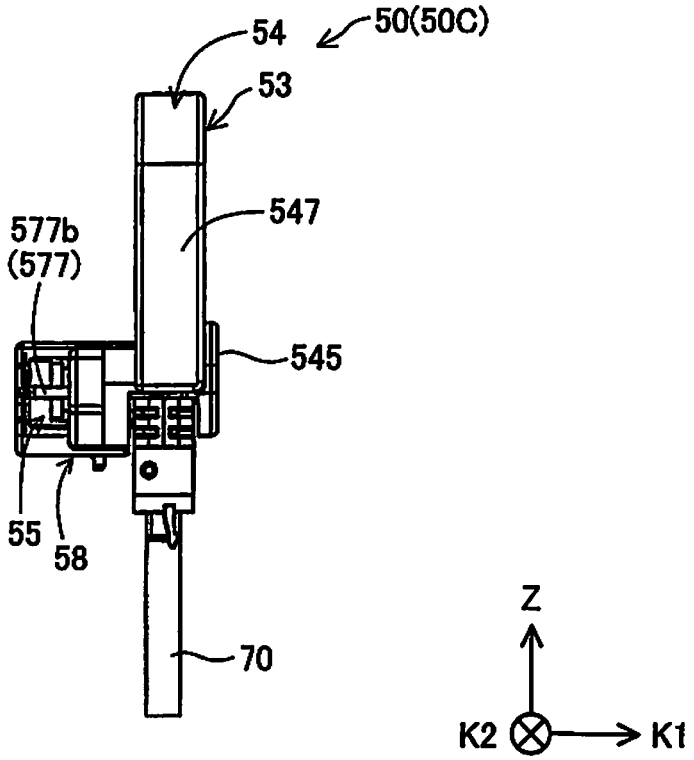
FIG. 16 is a right side view illustrating part of the liquid container.
Figure 17A:
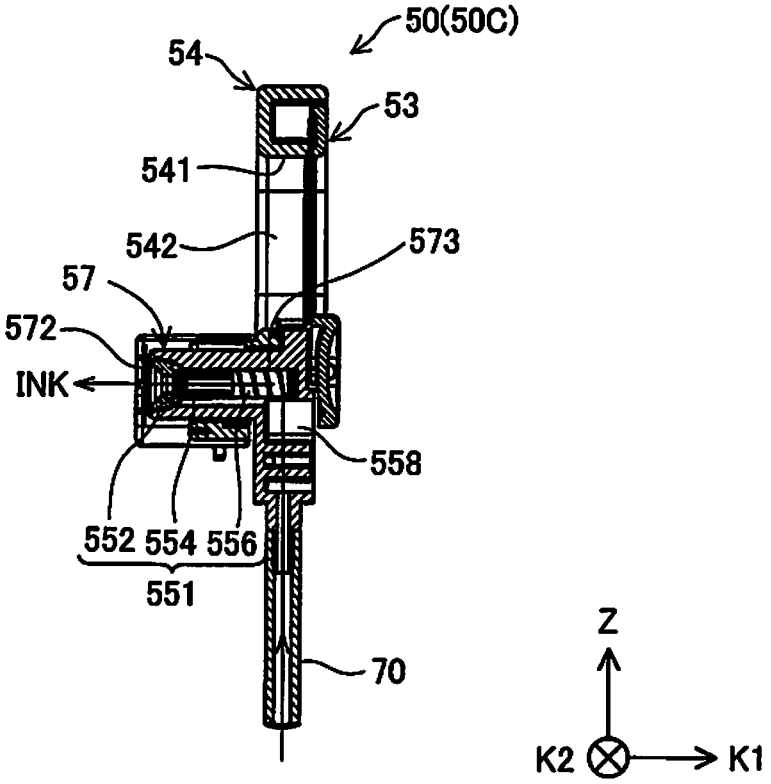
FIG. 17A is an F13-F13 sectional view of FIG. 13.
Figure 17B:
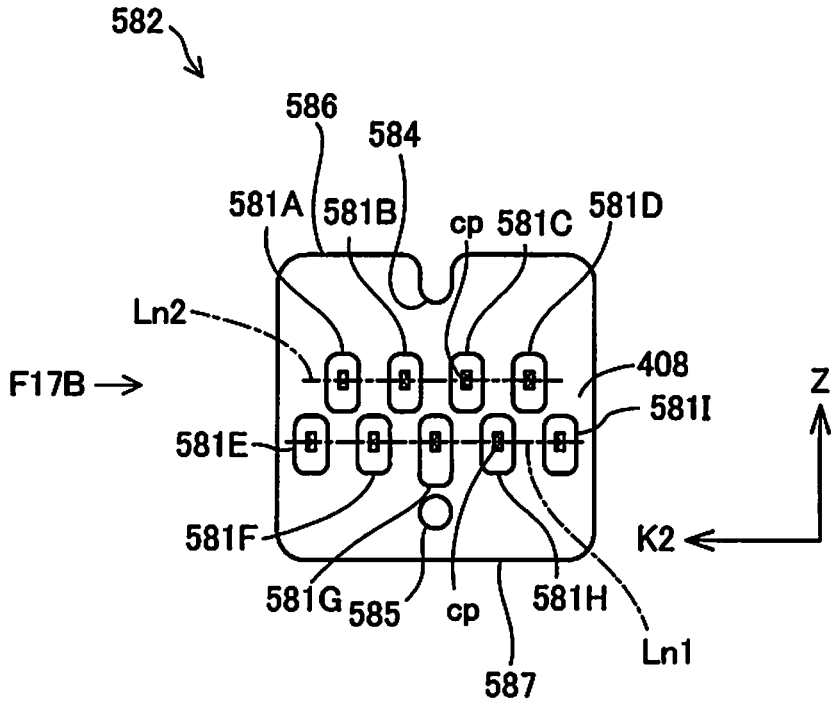
FIG. 17B is a front view illustrating a circuit board.
Figure 17C:
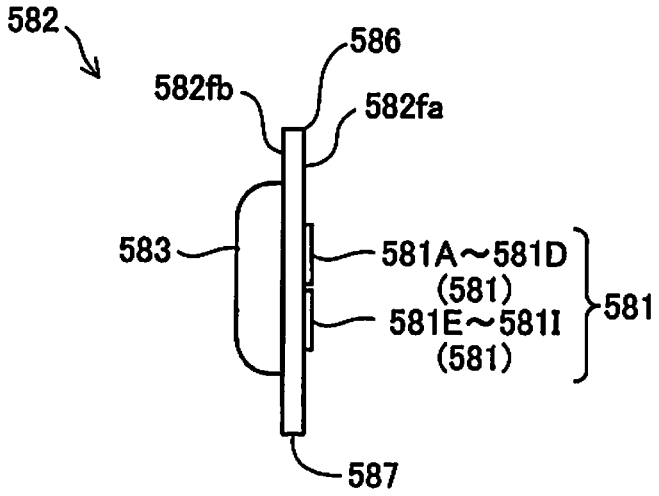
FIG. 17C is a view from an arrow F17B in FIG. 17B.
Figure 17D:
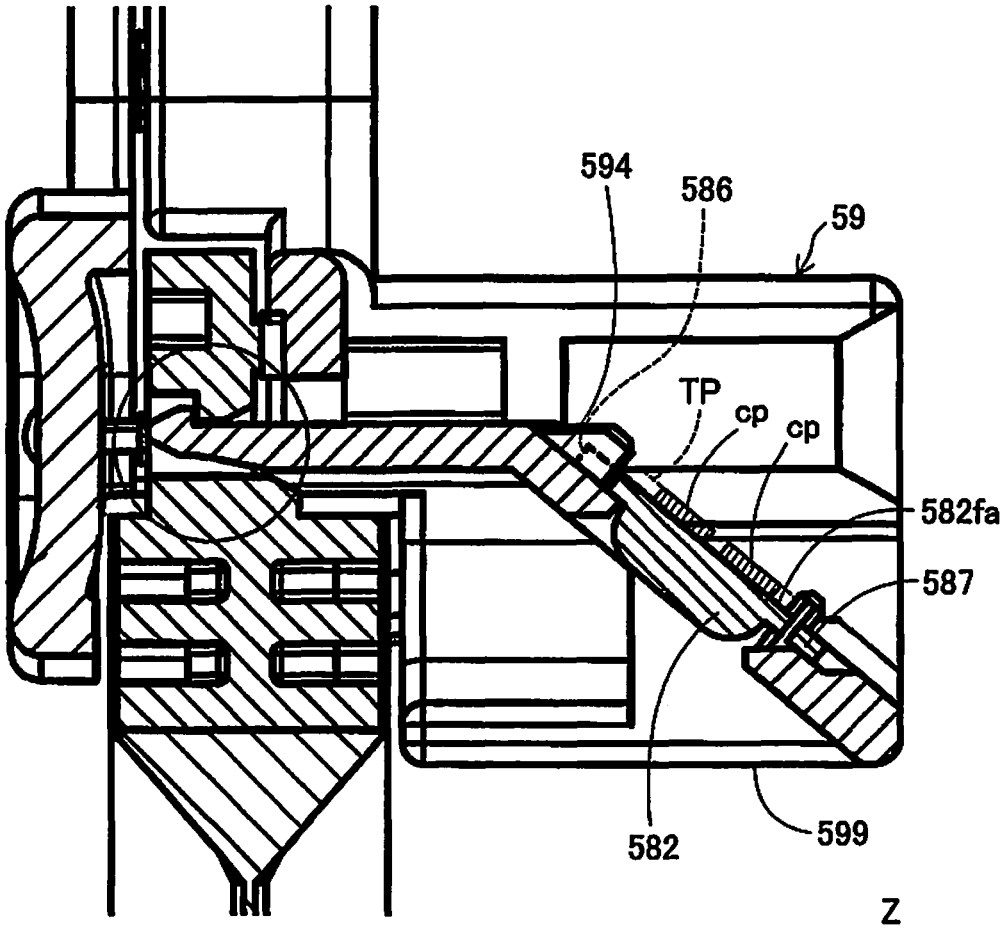
FIG. 17D is an F13*a*-F13*a* partial sectional view of FIG. 13.
Figure 17D:
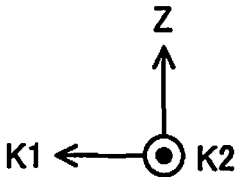
Figure 17E:
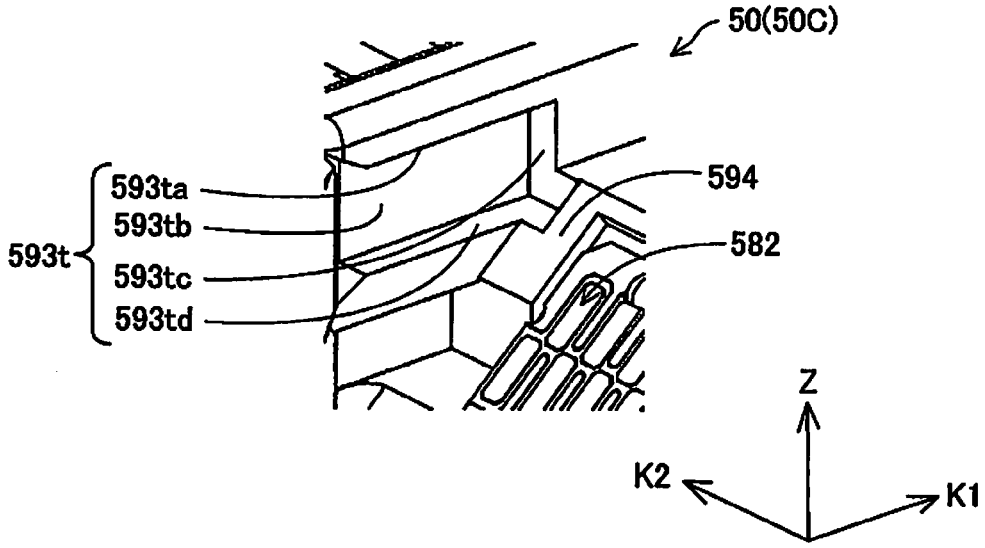
FIG. 17E is a perspective view illustrating a groove.
Figure 17F:
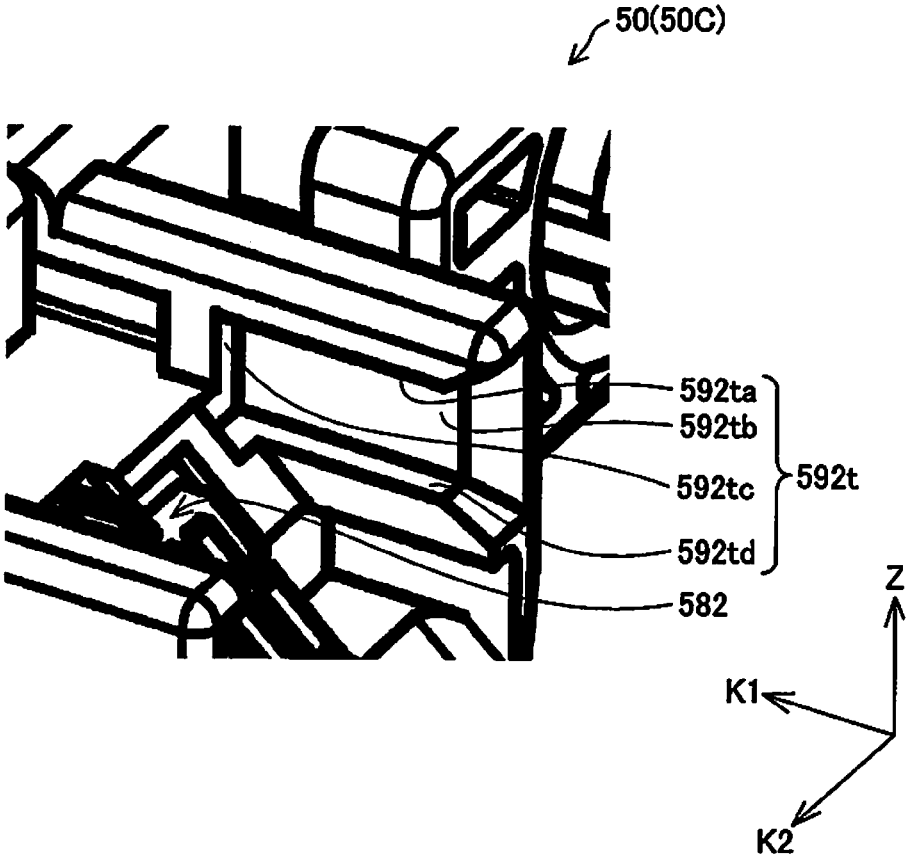
FIG. 17F is a perspective view illustrating a groove.

FIG. 9 is a first perspective view illustrating part of the liquid container 50. FIG. 10 is a second perspective view illustrating part of the liquid container 50. FIG. 11 is a third perspective view illustrating part of the liquid container 50. FIG. 12 is a fourth perspective view illustrating part of the liquid container 50. FIG. 13 is a front view illustrating part of the liquid container 50. FIG. 14 is a rear view illustrating part of the liquid container 50. FIG. 15 is a top view illustrating part of the liquid container 50. FIG. 16 is a right side view illustrating part of the liquid container 50. FIG. 17A is an F13-F13 sectional view of FIG. 13. FIG. 17B is a front view illustrating the circuit board 582. FIG. 17C is a view from an arrow F17B in FIG. 17B. FIG. 17D is an F13*a*-F13*a* partial sectional view of FIG. 13. FIG. 17E is a perspective view illustrating a groove 593*t*. FIG. 17F is a perspective view illustrating a groove 592*t*. The liquid container body 52 of the liquid container 50 is omitted from the illustration in FIGS. 9 to 17A.

With regard to the operation member 53, the Z-axis direction is also called "height direction", the K1-axis direction is also called "thickness direction", and the K2-axis direction is also called "width direction". According to this embodiment, the "height direction", "thickness direction" and "width direction" of the operation member 53 correspond to the "height direction", "thickness direction" and "width direction" of the liquid container 50. According to this embodiment, the dimensions of the liquid container 50 decrease in the sequence of the height, the width and the thickness.

As shown in FIGS. 9 and 10, the operation member 53 includes a first connecting portion 546, a second connecting portion 547, a base portion 548 and a mounting portion 549 to which the liquid container body 52 is mounted by welding or the like, in addition to the grip portion 54.

The grip portion 54, the first connecting portion 546, the second connecting portion 547 and the base portion 548 are respectively in rod-like shapes. The grip portion 54, the first connecting portion 546, the second connecting portion 547 and the base portion 548 form a frame-like member. Accordingly a receiving space 542 in an approximately rectangular shape is defined and formed in the operation member 53 to receive the user's hand. As shown in FIG. 11, the grip portion 54 has a grip surface (support surface) 541 that is exposed to the receiving space 542. The grip surface 541 is a plane approximately perpendicular to the Z-axis direction in the mounted state.

As shown in FIG. 9, the base portion 548 is extended along the K2-axis direction. The liquid supply unit 55 and the substrate unit 58 are attached to the base portion 548. The liquid supply unit 55 and the substrate unit 58 are accordingly linked with each other via the base portion 548. The liquid supply unit 55 and the substrate unit 58 accordingly move in conjunction with the motion of the base portion 548. This configuration allows the user to operate the motions of the liquid supply unit 55 and the substrate unit 58 used for connecting the liquid container 50 with the printer 10 by simply operating the motion of one member (base portion 548 according to this embodiment). The term "linked" herein means that members linked with each other are connected to be movable in conjunction with each other.

The mounting portion 549 is located on the opposite side that is opposite to the side where the grip portion 54 is located across the base portion 548. The mounting portion 549 is arranged adjacent to the base portion 548. The mounting portion 549 is extended along the K2-axis direction. The mounting portion 549 is a portion which one end 501 of the liquid container body 52 (shown in FIG. 7) is mounted to (or joined with) by welding or the like. As shown in FIG. 13 and FIG. 17A, the mounting portion 549 has a lead-out portion 550 configured to cause ink contained in the liquid container body 52 to be flowed to the liquid supply portion 57. Connecting a flow path member 70 with the lead-out portion 550 causes ink flowing in the flow path member 70 to be flowed to the liquid supply portion 57 described later via the lead-out portion 550. For the purpose of better understanding, part of the mounting portion 549 to which the liquid container body 52 is mounted is shown by single hatching in FIGS. 13 and 14.

As shown in FIGS. 9 and 10, the liquid supply unit 55 includes the liquid supply portion (liquid lead-out portion) 57 and a container body-side support structure 56. The container body-side support structure 56 is provided separately from the liquid supply portion 57, a small clearance is formed between the container body-side support structure 56 and the liquid supply portion 57.

The liquid supply portion 57 is configured to cause the ink contained in the liquid container body 52 to be flowed to the printer 10. The liquid supply portion 57 includes a liquid supply port 572 on one end and a supply connecting portion 573 on the other end. The liquid supply port 572 is arranged to communicate with inside of the liquid container body 52 and causes the ink contained in the liquid container body 52 to be flowed out to the outside (printer 10). The liquid supply portion 57 is extended from the operation member 53 to face in a first direction (−K1-axis direction) that is a direction intersecting with the direction of gravity (Z-axis direction) in the process of supplying ink to the printer 10. The liquid introduction portion 362 (shown in FIG. 5B) is inserted into the liquid supply port 572 in the mounted state of the liquid container 50. The liquid supply port 572 defines a plane (surface defined by the Z-axis direction and the K2-axis direction). The liquid supply port 572 is open toward the first direction (−K1-axis direction, connecting direction). The opening direction herein is a direction that is perpendicular to the plane defined by the liquid supply port 572 and is a direction toward outside. The liquid supply port 572 is, however, not necessarily limited to the configuration that the liquid supply port 572 is open toward the first direction but may be open toward a direction including a first direction component.

The supply connecting portion 573 is connected with the operation member 53. The liquid supply portion 57 is a tubular member (ring-shaped member) extended along the K1-axis direction (center axis CT direction).

The liquid supply portion 57 has a center axis CT. The center axis CT is parallel to the K1-axis direction. With regard to the K1-axis direction, a direction from the liquid supply port 572 toward the supply connecting portion 573 is +K1-axis direction, and a direction from the supply connecting portion 573 toward the liquid supply port 572 is −K1-axis direction.

As shown in FIG. 15, the liquid supply port 572 is arranged at a position that does not overlap with the operation member 53 when the liquid container 50 is viewed from the +Z-axis direction (i.e., from the side where the grip portion 54 is located).

As shown in FIG. 9, in the unused state of the liquid container 50, the liquid supply port 572 is closed by a film 99. This configuration suppresses leakage of ink from the liquid supply port 572 to outside before the liquid container 50 is mounted to the mounting/demounting unit 30 (shown in FIG. 5). The film 99 is broken by the liquid introduction portion 362 (shown in FIG. 5B) in the process of mounting the liquid container 50 to the mounting/demounting unit 30.

As shown in FIGS. 9 to 11, positioning structures 577 are provided to surround the outer circumference of the liquid supply portion 57 about the center axis CT. The positioning structures 577 abut on the supply portion positioning structures 364 of the liquid introduction portion 362 (shown in FIG. 5B) so as to position the liquid supply portion 57 relative to the liquid introduction portion 362 in the process of connecting the liquid container 50 with the printer 10. The positioning structures 577 may be regarded as part of the liquid supply portion 57.

The positioning structures 577 include a first container-side positioning structure 577*a*, a second container-side positioning structure 577*b*, a third container-side positioning structure 577*c* and a fourth container-side positioning structure 577*d*. The first to the fourth container-side positioning structures 577*a* to 577*d* are members protruded from the liquid supply portion 57 (protruded members). The first to the fourth container-side positioning structures 577*a* to 577*d* are members extended along the K1-axis direction. Respective −K1-axis direction ends of the first to the fourth container-side positioning structures 577*a* to 577*d* are arranged near to the liquid supply port 572.

The first container-side positioning structure 577*a* is located on the upper side of the liquid supply portion 57 in the direction of gravity (on the +Z-axis direction side). The second container-side positioning structure 577*b* is located on the −K2-axis direction side of the liquid supply portion 57. The third container-side positioning structure 577*c* is located on the +K2-axis direction side of the liquid supply portion 57. The fourth container side positioning structure 577*d* is located on the lower side of the liquid supply portion 57 in the direction of gravity (on the −Z-axis direction side). The first and the fourth container-side positioning structures 577*a* and 577*d* are opposed to each other in the Z-axis direction. The second and the third container-side positioning structures 577*b* and 577*c* are opposed to each other in the K2-axis direction.

As shown in FIG. 17A, a valve mechanism 551 is placed inside of the liquid supply portion 57 to open and close a liquid flow path formed by the liquid supply portion 57. The valve mechanism 551 includes a valve seat 552, a valve element 554 and a spring 556. The valve seat 552, the valve element 554 and the spring 556 are placed in the liquid supply portion 57 to be arranged in this sequence from the liquid supply port 572 toward the supply connecting portion 573 of the liquid supply portion 57.

The valve seat 552 is an approximately annula53 r member. The valve seat 552 is formed from an elastic body, for example, a rubber or an elastomer. The valve seat 552 is pressed into the liquid supply portion 57. The valve element 554 is an approximately cylindrical member. The valve element 554 is arranged to close a hole formed in the valve seat 552 (valve hole) in the state before mounting of the liquid container 50 to the mounting/demounting unit 30. The spring 556 is a compression coil spring. The spring 556 presses the valve element 554 in a direction toward the valve seat 552. In the mounted state of the liquid container 50, the liquid introduction portion 362 (shown in FIG. 5B) presses the vale element 554 toward the supply connecting portion 573, so as to move the valve element 554 toward the supply connecting portion 573. The valve element 554 is accordingly separated from the valve seat 552 to set the valve mechanism 551 in the open position. In the open position of the valve mechanism 551, the ink contained in the liquid container body 52 (shown in FIG. 7) is allowed to flow through the flow path member 70, an inner flow path 558 of the operation member 53 and the liquid supply portion 57 to outside.

As shown in FIG. 9, the container body-side support structure 56 is configured to roughly position the liquid container body 52 including the liquid supply port 572 relative to the printer 10 in the process of connecting the liquid container 50 with the printer 10. The container body-side support structure 56 is in a recessed shape that is open on the +Z-axis direction side. The container body side support structure 56 is arranged to surround the circumference of the liquid supply portion 57 about the center axis CT except the Z-axis direction side (upper side in the direction of gravity). The container body-side support structure 56 is arranged at a position adjacent to the liquid supply port 572 of the liquid supply portion 57. When the operation member 53 is formed from a material that is not readily deformable, the container body-side support structure 56 may be provided in the operation member 53 at a position some distance away from the liquid supply port 572. The container body-side support structure 56 is protruded in the −K1-axis direction from the operation member 53.

The container body-side support structure 56 is placed inside of the supply portion support structure 42 of the mounting/demounting unit 30 (shown in FIG. 5C) in the process of connecting the liquid container 50 with the printer 10. This configuration causes a plurality of surfaces defining and forming the supply portion support structure 42 (for example, the first support surface 402, the second support surface 403 and the third support surface 404 shown in FIG. 5C) to abut on the container body-side support structure 56. This restricts the motion of the liquid supply portion 57 and roughly positions the liquid container 50. The container body-side support structure 56 abuts on the third support surface 404 when the liquid container 50 is set in the movable member 40 of the mounting/demounting unit 30, so that the liquid container body 52 is supported by the movable member 40 to be suspended below the grip portion 54 in the direction of gravity by the dead weight.

The liquid supply unit 55 serves to supply the ink contained in the liquid container body 52 (shown in FIG. 7) to the printer 10. The liquid supply unit 55 may thus be regarded as "liquid supply assembly". The liquid supply unit 55 provided as the liquid supply assembly includes the liquid supply portion (liquid flow portion) 57 with the liquid supply port 572 and the container body-side support structure 56 on one end.

As shown in FIGS. 9 and 10, the substrate unit 58 includes a circuit board 582 as a container-side electrical connection structure and a circuit board holding structure 59 as a holder structure (placement structure). As shown in FIG. 9, the circuit board holding structure 59 is configured to position the circuit board 582 relative to the printer 10 in the process of connecting the liquid container 50 with the printer 10. The circuit board holding structure 59 is provided integrally with the operation member 53. According to this embodiment, the circuit board holding structure 59 is integrally molded with the operation member 53, so as to be provided integrally with the operation member 53. The term "provided integrally" means that the circuit board holding structure 59 is provided in the operation member 53 to be in conjunction with the motion of the operation member 53. According to another embodiment, the circuit board holding structure 59 may be attached to the operation member 53 by welding or the like, so as to be provided integrally with the operation member 53.

The circuit board holding structure 59 and the liquid supply portion 57 are arranged side by side in a direction (K2-axis direction) that intersects with the first direction (−K1-axis direction). The circuit board holding structure 59 is configured to hold (support or place) the circuit board 582. In other words, the circuit board holding structure 59 is configured to place contacts cp of the circuit board 582. The circuit board holding structure 59 is configured to hold (place) the circuit board 582 (its contacts cp) to be located above the liquid container body 52 in the process of connecting the liquid container 50 with the printer 10. The circuit board holding structure 59 is a member having rigidity. More specifically, the circuit board holding structure 59 has such a level of rigidity that does not allow for displacement of the circuit board 582 when the liquid container 50 is set in the movable member 40 of the mounting/demounting unit 30. The circuit board holding structure 59 may be formed from, for example, a material such as ABS resin or polystyrene (PS). The circuit board holding structure 59 is supported by the supply portion support structure 42 of the movable member 40 (shown in FIG. 5C) when the circuit board holding structure 59 is set in the movable member 40.

As shown in FIG. 9, the circuit board holding structure 59 is in a recessed shape that is open on the +Z-axis direction side (side where the grip portion 54 is located). A −K1-axis direction side of the circuit board holding structure 59 is open to receive the contact mechanism 38. The circuit board holding structure 59 includes a bottom (bottom face) 595 (shown in FIG. 11), a first side wall portion 592 and a second side wall portion 593. The bottom 595, the first side wall portion 592 and the second side wall portion 593 define the recessed shape of the circuit board holding structure 59. The first side wall portion 592 is a wall portion extended upward in the direction of gravity from a −K2-axis direction side portion of the bottom 595. The second side wall portion 593 is a wall portion extended upward in the direction of gravity from a +K2-axis direction side portion of the bottom 595. The first and the second side wall portions 592 and 593 connected with the bottom 595 are opposed to each other.

As shown in FIG. 9, the circuit board holding structure 59 includes a placement portion (placement surface) 594. The circuit board 582 is mounted on the placement portion 594. The placement portion 594 is located between the first and the second side wall portions 592 and 593. The placement portion 594 is inclined such that its lower end is located on the −K1-axis direction side of its upper end. The placement portion 594 is inclined to face in a direction including a +Z-axis direction component and a −K1-axis direction component. The placement portion 594 is located on the +Z-axis direction side of the bottom 595.

The circuit board holding structure 59 includes the first side wall portion 592 and the second side wall portion 593 that are respectively extended in the +Z-axis direction from the respective sides in the K2-axis direction of the bottom 595. As shown in FIG. 10 and FIG. 15, the first side wall portion 592 includes a groove 592*t* serving as a holding structure-side positioning element and a holding structure-side upper restriction portion 599*b*. As shown in FIG. 9 and FIG. 15, the second side wall portion 593 includes a groove 593*t* serving as a holding structure-side positioning element and a holding structure-side upper restriction portion 599*a*.

As shown in FIG. 15, the holding structure-side upper restriction portion 599*a* (or 599*b*) is an end face on the upper side of the second side wall portion 593 (or the first side wall portion 592) in the direction of gravity. When the electrical connection structure 582 is connected with the apparatus-side terminals 381 of the electrical connection unit 38 (shown in FIG. 5C), the holding structure-side upper restriction portion 599*a* abuts on the apparatus-side upper restriction portion 377*a* (shown in FIG. 6M), while the holding structure-side upper restriction portion 599*b* abuts on the apparatus-side upper restriction portion 377*b* (shown in FIG. 6M). This configuration restricts the upward motion of the circuit board holding structure 59 in the direction of gravity.

As shown in FIG. 13, the two grooves 592*t* and 593*t* are provided on the respective sides in the K2-axis direction with the circuit board 582 placed therebetween. The two grooves 592*t* and 593*t* are respectively formed in an approximately rectangular parallelepiped shape. In the process of connecting the liquid container 50 with the printer 10, the circuit board holding structure 59 is first supported by the board support structure 48 (shown in FIG. 5C). This configuration roughly positions the circuit board holding structure 59 and the circuit board 582 relative to the apparatus-side terminals 381 (shown in FIG. 5C). When the movable member 40 of the mounting/demounting unit 30 shown in FIG. 5C is moved in the −K1-axis direction, the apparatus-side board positioning structure 385 shown in FIG. 5B enters the groove 593*t* of the circuit board holding structure 59 (shown in FIG. 13), while the apparatus-side board positioning structure 384 shown in FIG. 5B enters the groove 592*t* of the circuit board holding structure 59 (shown in FIG. 13). This configuration determines the final positions of the circuit board holding structure 59 and the circuit board 582 relative to the apparatus-side terminals 381.

As shown in FIG. 17E, in the mounted state of the liquid container 50, the second contact-side positioning structure 385 of the contact mechanism 38 (shown in FIG. 5B) is inserted into the groove 593*t* (second groove 5930. The groove 593*t* includes a top face 593*ta*, a side face 593*tb*, a base end face 593*tc* and a bottom face 593*td*. The top face 593*ta* and the bottom face 593*td* are opposed to each other in the Z-axis direction. The top face 593*ta* is located on the +Z-axis direction side, and the bottom face 593*td* is located on the −Z-axis direction side. The side face 593*td* forms a +K2-axis direction side face of the groove 593*t*. The base end face 593*tc* forms a +K1-axis direction side face of the groove 593*t*.

As shown in FIG. 17F, in the mounted state of the liquid container 50, the first contact side positioning structure 384 of the contact mechanism 38 (shown in FIG. 5B) is inserted into the groove 592*t* (first groove 5920. The groove 592*t* has the same configuration as that of the groove 593*t*. The groove 592*t* includes a top face 592*ta*, a side face 592*tb*, a base end face 592*tc* and a bottom face 592*td*. The top face 592*ta* and the bottom face 592*td* are opposed to each other in the Z-axis direction. The top face 592*ta* is located on the +Z-axis direction side, and the bottom face 592*td* is located on the −Z-axis direction side. The side face 592*td* forms a −K2-axis direction side face of the groove 592*t*. The base end face 592*tc* forms a +K1-axis direction side face of the groove 592*t*.

When the circuit board 582 comes into contact with the electrical connection structure 382 (shown in FIG. 5B) to be electrically connected with the electrical connection structure 382, the circuit board 582 is positioned relative to the electrical connection structure 382 in the first direction (K1 axis direction) and in directions (Z-axis direction and K2-axis direction) intersecting with the first direction as described below.

When the liquid container 50 is set in the movable member 40 and is pressed in the connecting direction (in the −K1-axis direction), the apparatus-side board positioning structures 384 and 385 (shown in FIG. 6P and FIG. 6Q) start insertion into the grooves 592*t* and 593*t*. This causes the first restriction element 385*a* (shown in FIG. 6T) to abut on the top face 593*ta* (shown in FIG. 17E), while causing the first restriction element 384*a* (shown in FIG. 6U) to abut on the top face 592*ta* (shown in FIG. 17F). This restricts the motion of the circuit board holding structure 59 in the +Z-axis direction and thereby achieves positioning in the +Z-axis direction. This also causes the fourth restriction element 385*d* (shown in FIG. 6T) to abut on the bottom face 593*td* (shown in FIG. 17E), while causing the fourth restriction element 384*d* (shown in FIG. 6U) to abut on the bottom face 592*td* (shown in FIG. 17F). This restricts the motion of the circuit board holding structure 59 in the −Z-axis direction and thereby achieves positioning in the −Z-axis direction. Additionally, this causes the second restriction element 385*b* (shown in FIG. 6T) to abut on the side face 593*tb* (shown in FIG. 17E), while causing the second restriction element 384*b* (shown in FIG. 6U) to abut on the side face 592*tb* (shown in FIG. 17F). This restricts the motion of the circuit board holding structure 59 in the K2-axis direction and thereby achieves positioning in the K2-axis direction.

Further pressing the liquid container 50 in the connecting direction (−K1-axis direction) causes the third restriction element 385*c* (shown in FIG. 6T) to abut on the base end face 593*tc* (shown in FIG. 17E), while causing the third restriction element 384*c* (shown in FIG. 6U) to abut on the base end face 592*tc* (shown in FIG. 17F). This restricts the motion of the circuit board holding structure 59 in the first direction (in the −K1-axis direction) and thereby achieves positioning in the first direction. This configuration enables the circuit board 582 and the electrical connection structure 382 to come into contact with each other with high accuracy at predetermined positions.

As shown in FIG. 11, the restriction element 597 is provided on the bottom 595. The restriction element 597 is a projection protruded outward (in the −Z-axis direction) from the bottom 595. The restriction element 597 abuts on the apparatus-side restriction element 489 of the movable member 40 (shown in FIG. 6K), so as to restrict the motion of the circuit board holding structure 59 in the opposite direction (+K1 axis direction) opposite to the first direction (−K1-axis direction).

As shown in FIG. 17B, a boss groove 584 is formed on a +Z-axis direction side upper end 586 of the circuit board 582, and a boss hole 585 is formed on a −Z-axis direction side lower end 587 of the circuit board 582. The circuit board 582 is fixed to the placement portion 594 using the boss groove 584 and the boss hole 585.

As shown in FIGS. 17B and 17C, the circuit board 582 includes a liquid container-side terminal group 580 provided on a surface 582*fa* and a storage device 583 provided on a rear face 582*fb*. The surface 582*fa* and the rear face 582*fb* are planes.

The liquid container side terminal group 580 consists of nine terminals 581A to 581I. The storage device 583 stores, for example, information regarding the liquid container 50 (for example, the remaining amount of ink and the color of ink).

As shown in FIG. 17B, the nine liquid container-side terminals 581A to 581I are respectively formed in an approximately rectangular shape and are arranged in two lines Ln1 and Ln2 at different positions in the Z-axis direction. The lines Ln1 and Ln2 are parallel to the K2-axis direction.

The liquid container-side terminals 581A to 581I respectively have contacts cp arranged in their centers to come into contact with the corresponding apparatus-side terminals 381A to 381I (shown in FIG. 6V). The above lines Ln1 and Ln2 may be regarded as lines formed by a plurality of the contacts cp. When there is no need to distinguish among the nine liquid container-side terminals 581A to 581I, these are expressed by a reference sign "581".

As shown in FIG. 17D, in the mounted state of the liquid container 50, the surface 582*fa* with the plurality of contacts cp placed thereon is inclined such that the lower end 587 is located on the first direction side (on the −K1-axis direction side or connecting direction side) of the upper end 586. A plane (contact plane) TP defined by the plurality of contacts cp is inclined such that the lower side is located on the first direction side of the upper side. The surface 582*fa* and the plane TP are inclined to face in a direction including a +Z-axis direction component (upward component in the direction of gravity) and a −K1-axis direction component (first direction component).

A-6. Method of Mounting Liquid Container 50 to Mounting/Demounting Unit 30

Figure 18:
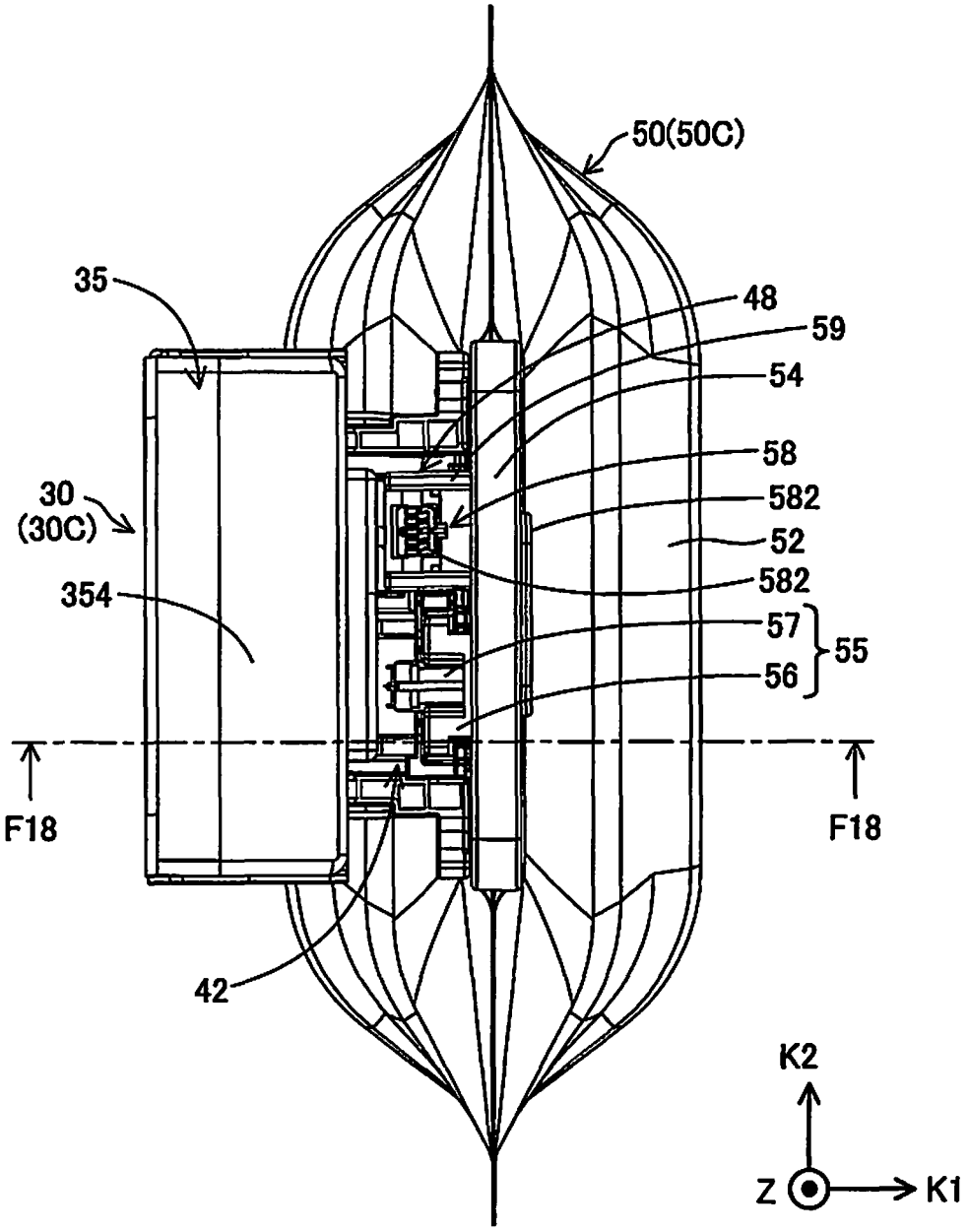
FIG. 18 is a diagram illustrating the state that the liquid container is set in the mounting/demounting unit.
Figure 19:
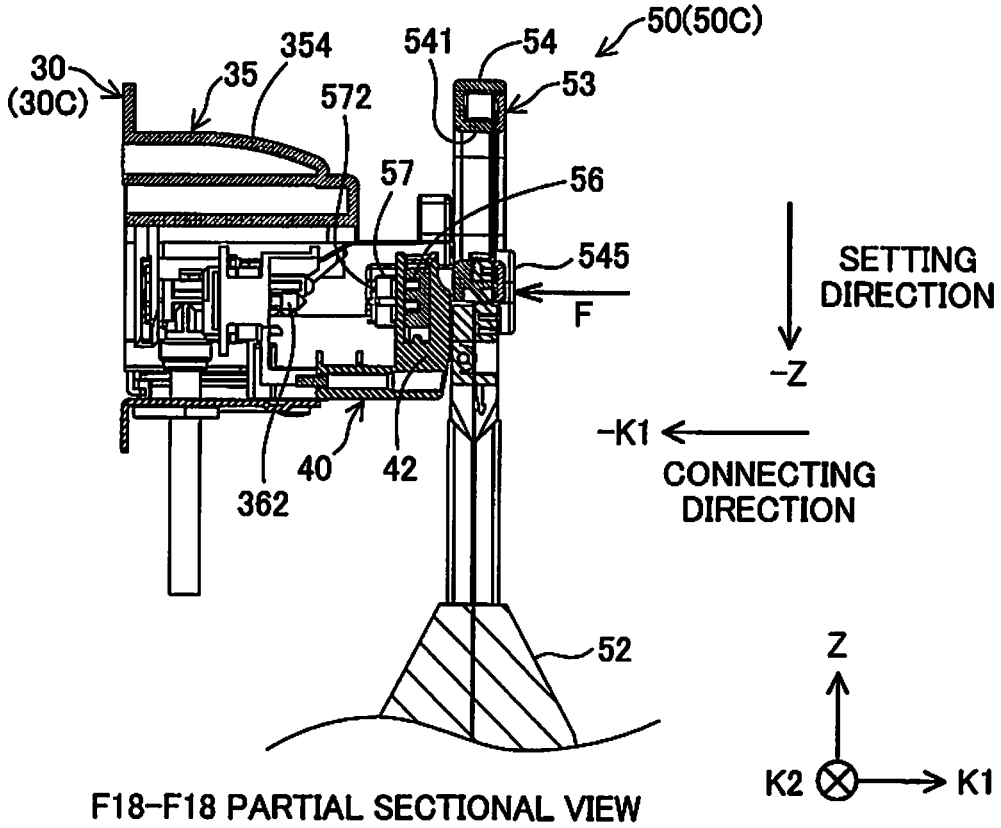
FIG. 19 is an F18-F18 partial sectional view of FIG. 18.
Figure 20:
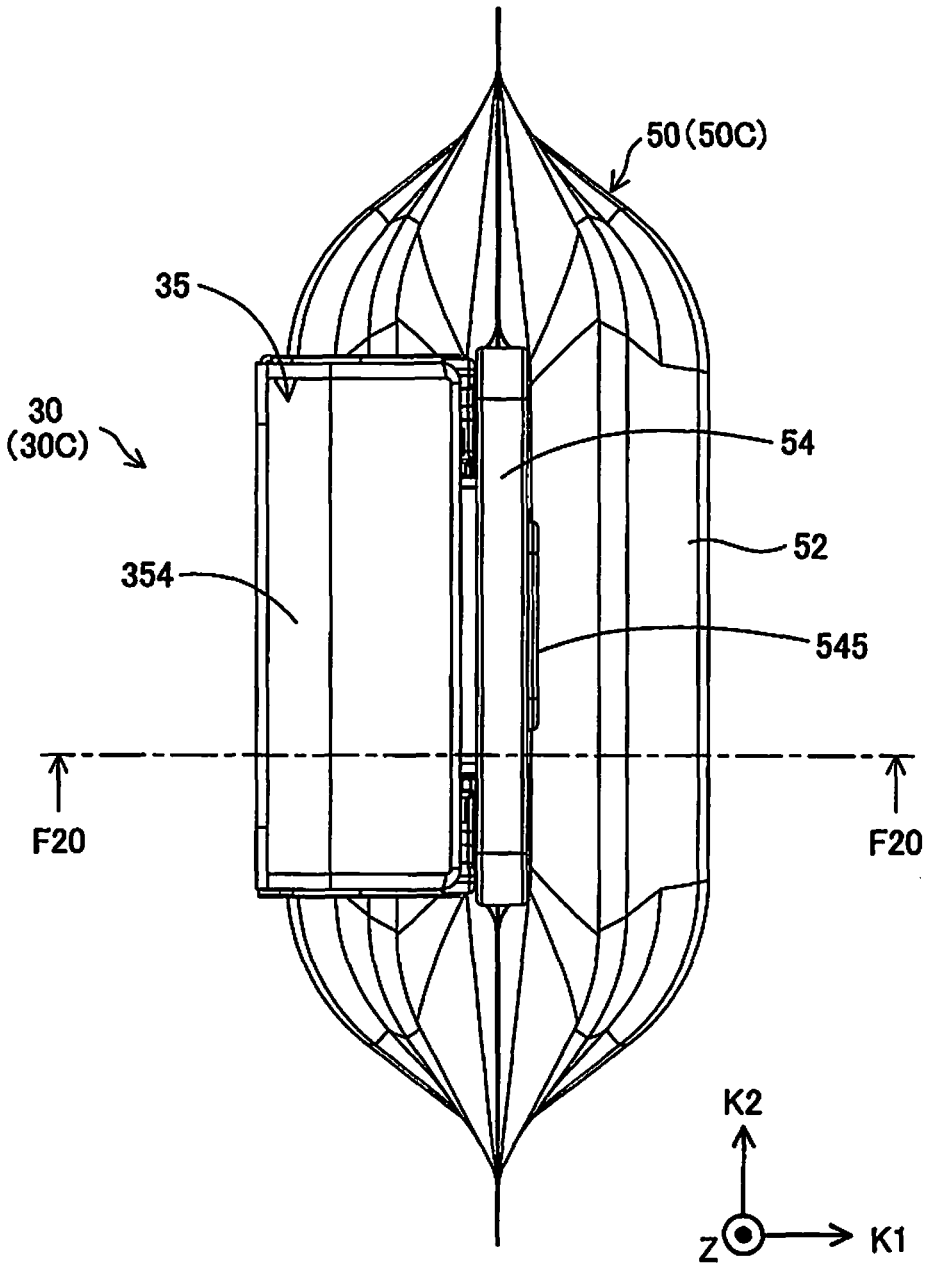
FIG. 20 is a diagram illustrating the state that the liquid container is mounted to the mounting/demounting unit.
Figure 21:
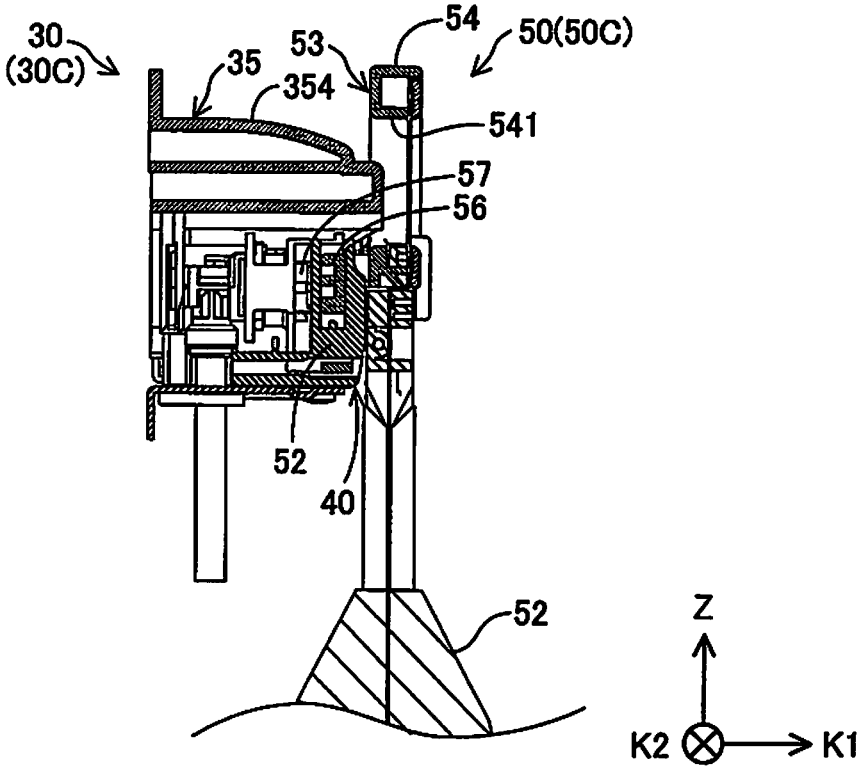
FIG. 21 is an F20-F20 partial sectional view of FIG. 20.

FIG. 18 is a diagram illustrating the state that the liquid container 50 is set in the mounting/demounting unit 30. FIG. 19 is an F18-F18 partial sectional view of FIG. 18. FIG. 20 is a diagram illustrating the state that the liquid container 50 is mounted to the mounting/demounting unit 30. FIG. 21 is an F20-F20 partial sectional view of FIG. 20. The state of the mounting/demounting unit 30 shown in FIG. 18 and FIG. 19 is the first state like the state of FIG. 5. The state of the mounting/demounting unit 30 shown in FIG. 20 and FIG. 21 is the second state like the state of FIG. 6.

As shown in FIG. 19, the liquid container 50 is mounted to the mounting/demounting unit 30 by two operations, i.e., operation of moving the liquid container 50 in a setting direction (setting operation or first operation) and operation of moving the liquid container 50 in a connecting direction (connecting operation or second operation). The setting direction is a direction including a downward component in the direction of gravity (−Z-axis direction component). According to this embodiment, the setting direction is downward in the direction of gravity. The connecting direction is a direction including a horizontal direction component (K1-axis direction component). According to this embodiment, the connecting direction is the −K1-axis direction (first direction) that is the horizontal direction.

When the mounting/demounting unit 30 is in the first state, the user sets the liquid container 50 in the movable member 40 of the mounting/demounting unit 30. More specifically, the user holds the grip portion 54 in such an orientation that the operation member 53 is located above the liquid container body 52 in the direction of gravity. As shown in FIGS. 18 and 19, the user places the container body-side support structure 56 of the liquid container 50 in the supply portion support structure 42, while placing the circuit board holding structure 59 in the board support structure 48.

After setting the liquid container 50 in the movable member 40, as shown by an arrow F in FIG. 19, the user presses the pressed portion 545 in the −K1-axis direction. This moves the liquid container 50 and the movable member 40 in the connecting direction (−K1-axis direction).

As shown in FIG. 21, when the mounting/demounting unit 30 is in the second state, the liquid introduction portion 362 (shown in FIG. 19) is inserted into (connected with inside of) the liquid supply portion 57. In the second state, the terminal 581 of the circuit board 582 (shown in FIG. 13) come into contact with the apparatus-side terminals 381 of the electrical connection structure 382 (shown in FIG. 5B), so that the circuit board 582 and the electrical connection structure 382 are electrically connected. In the mounted state shown in FIG. 21, the protective member 354 is located above the electrical connection structure 582 of the liquid container 50 to cover the upper portion of (above) the electrical connection structure 582. In the state of FIG. 21, the electrical connection structure 582 is located on the +K2-axis direction side of the liquid supply portion 57.

The above expression of "in the process of connecting the liquid container 50 with the mounting/demounting unit 30 (printer 10)" denotes at least part of a time period from the time when the user holds the operation member 53 and starts the setting operation to the time when connection of the liquid container 50 with the printer 10 is completed by the connecting operation. According to this embodiment, part of the time period is a time period from the time when the liquid container 50 is set in the movable member 40 and is slightly moved in the connecting direction to the time when the connection is completed. As shown in FIGS. 18 to 21, the movable member 40 supports the liquid container 50 such that the liquid supply portion 57 of the liquid container 50 is located above the liquid container body 52 in the direction of gravity (on the +Z-axis direction side).

A-7 Connecting Timings of Respective Components

Figure 22:
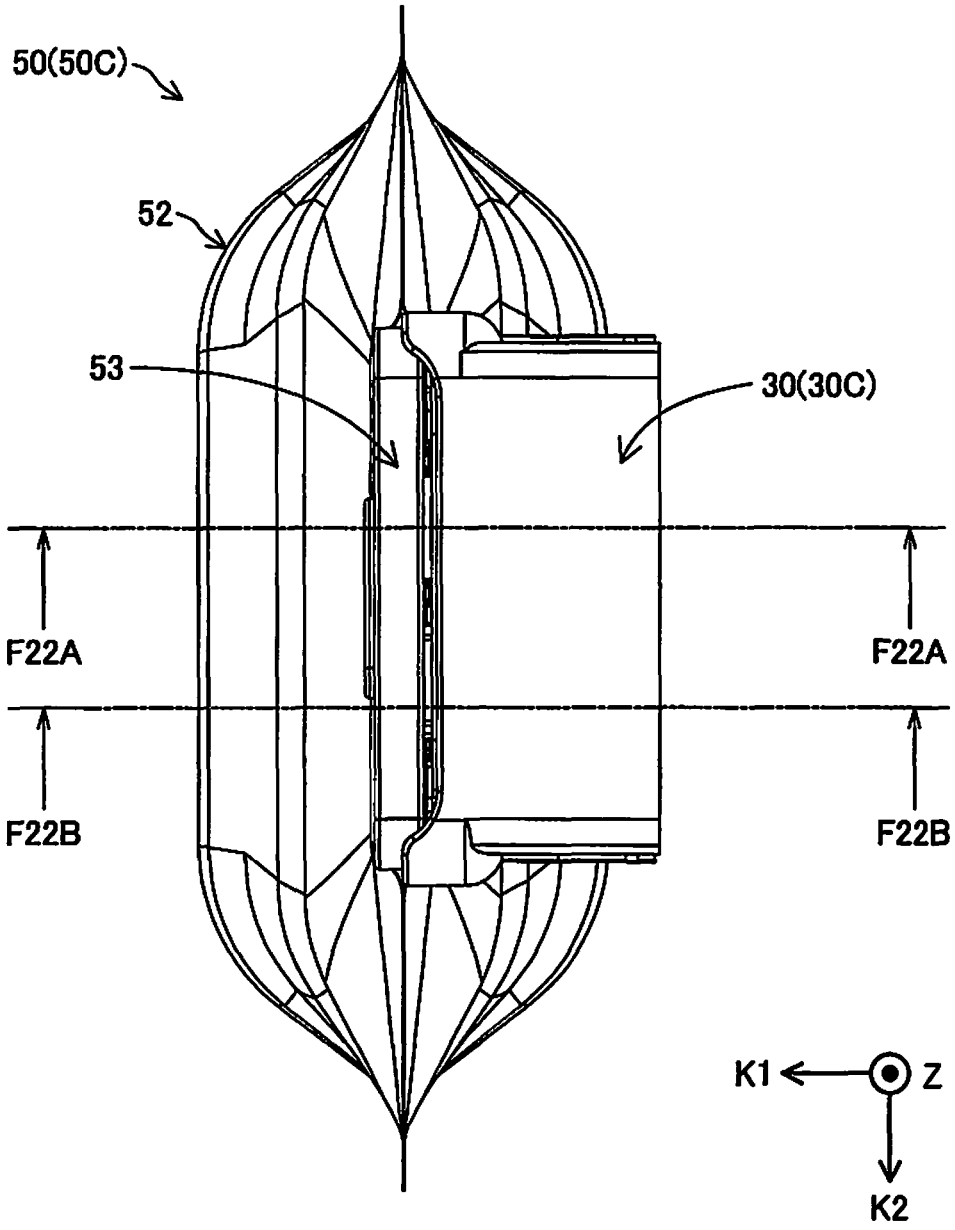
FIG. 22 is a first diagram illustrating connection timing.
Figure 23:
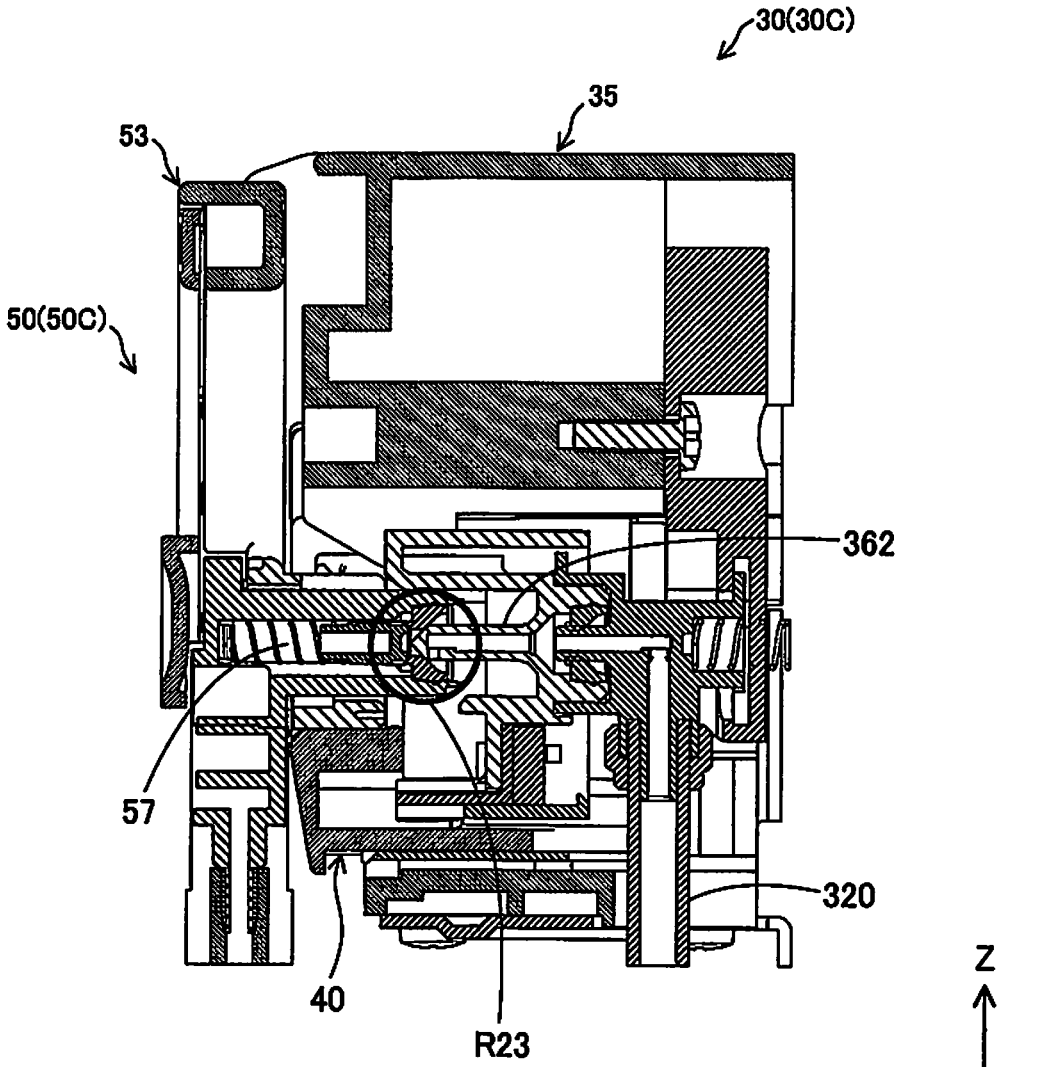
FIG. 23 is an F22A-F22A partial sectional view of FIG. 22.
Figure 24:
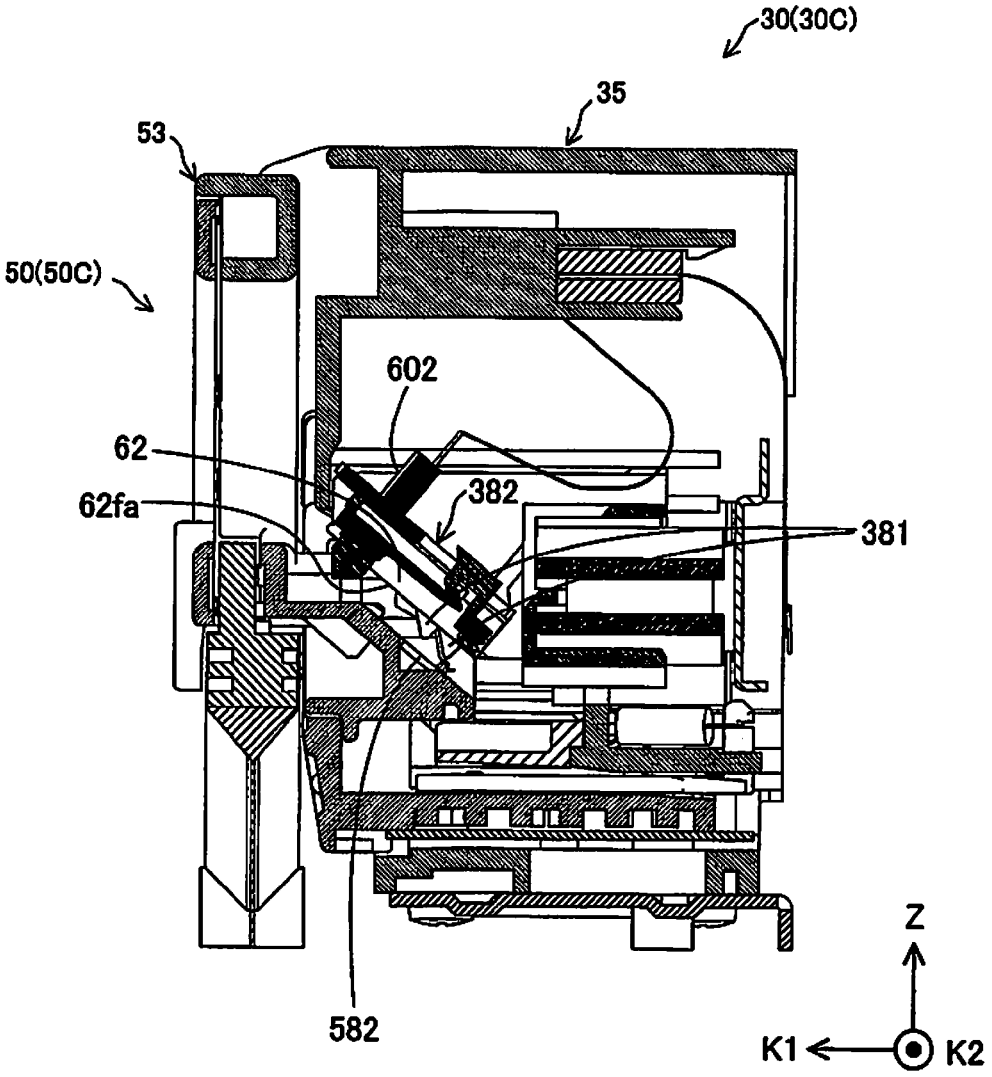
FIG. 24 is an F22B-F22B partial sectional view of FIG. 22.
Figure 25:
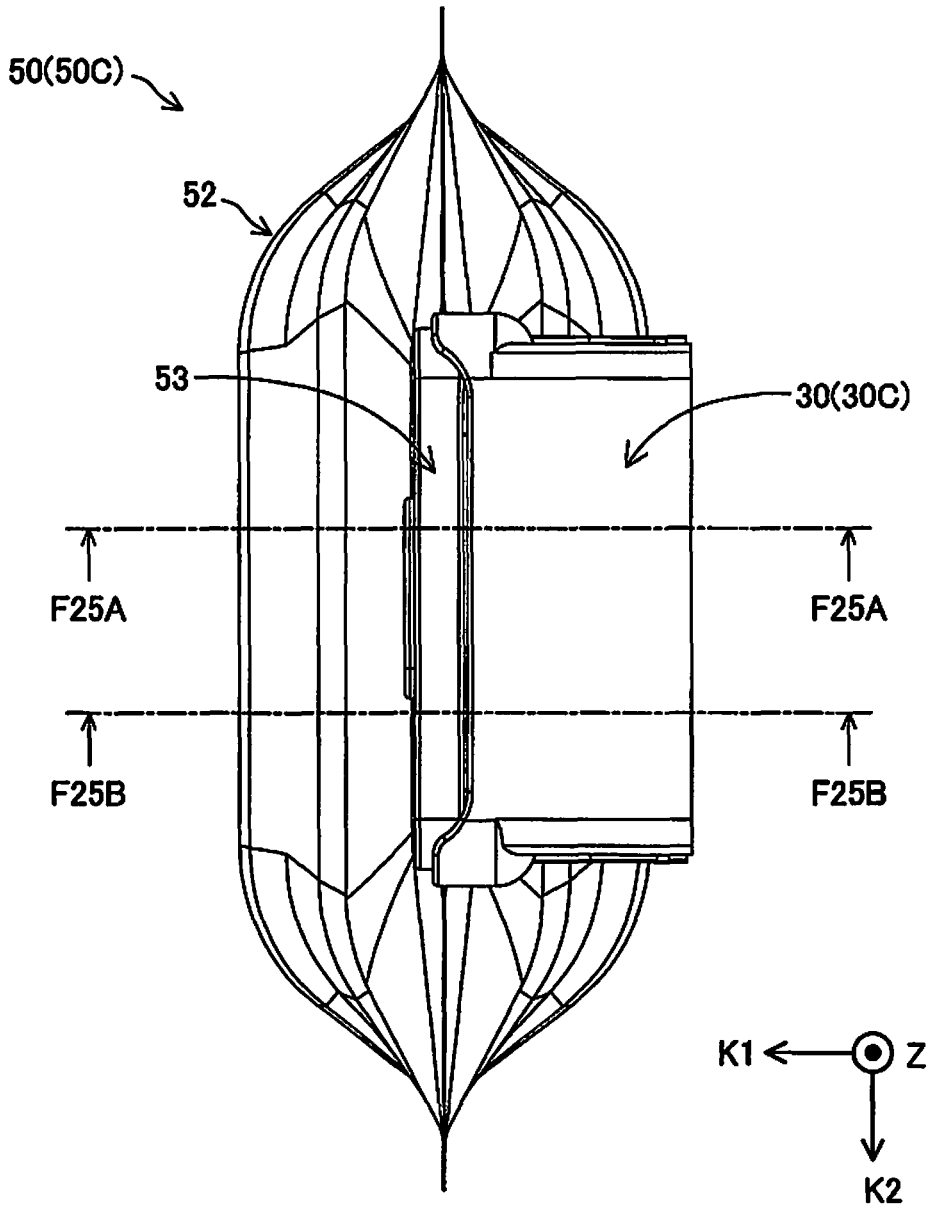
FIG. 25 is a second diagram illustrating connection timing.
Figure 26:
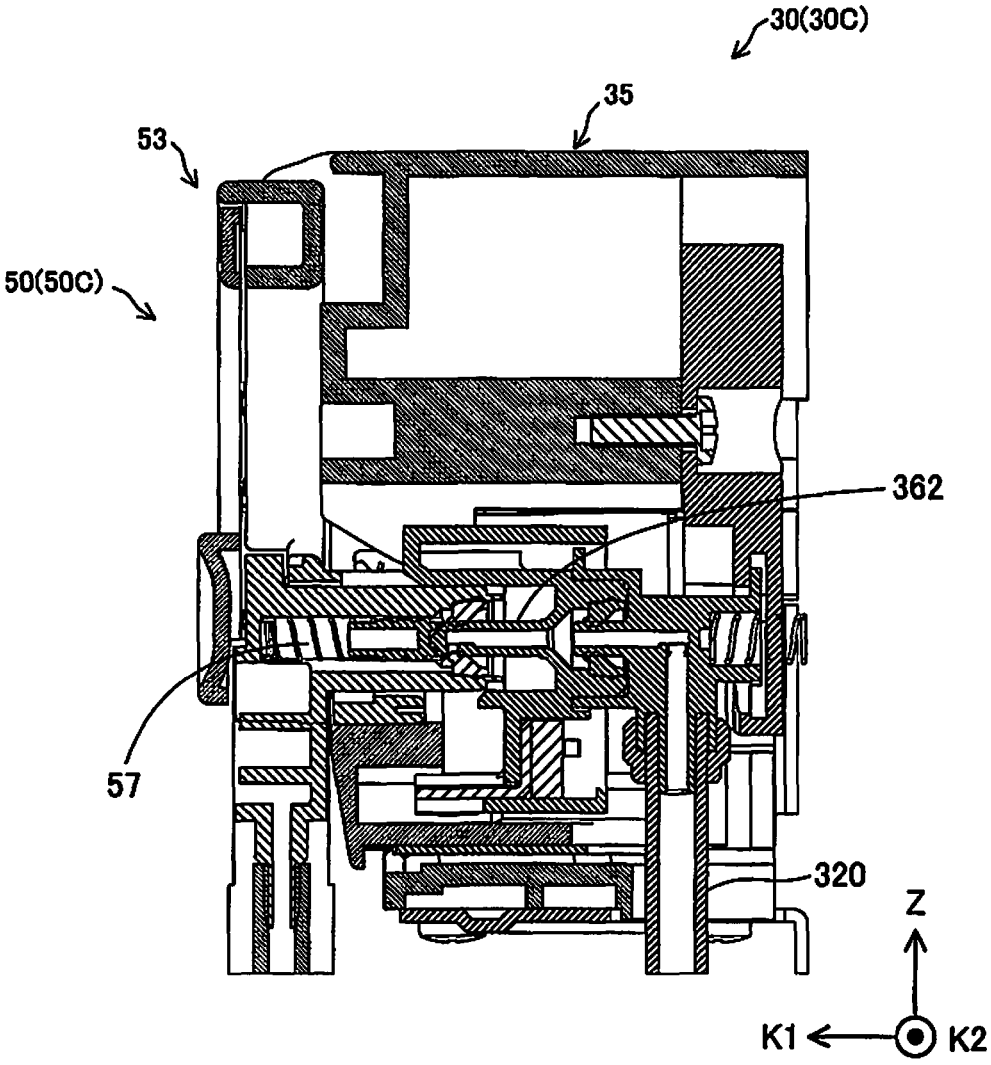
FIG. 26 is an F25A-F25A partial sectional view of FIG. 25.
Figure 27:
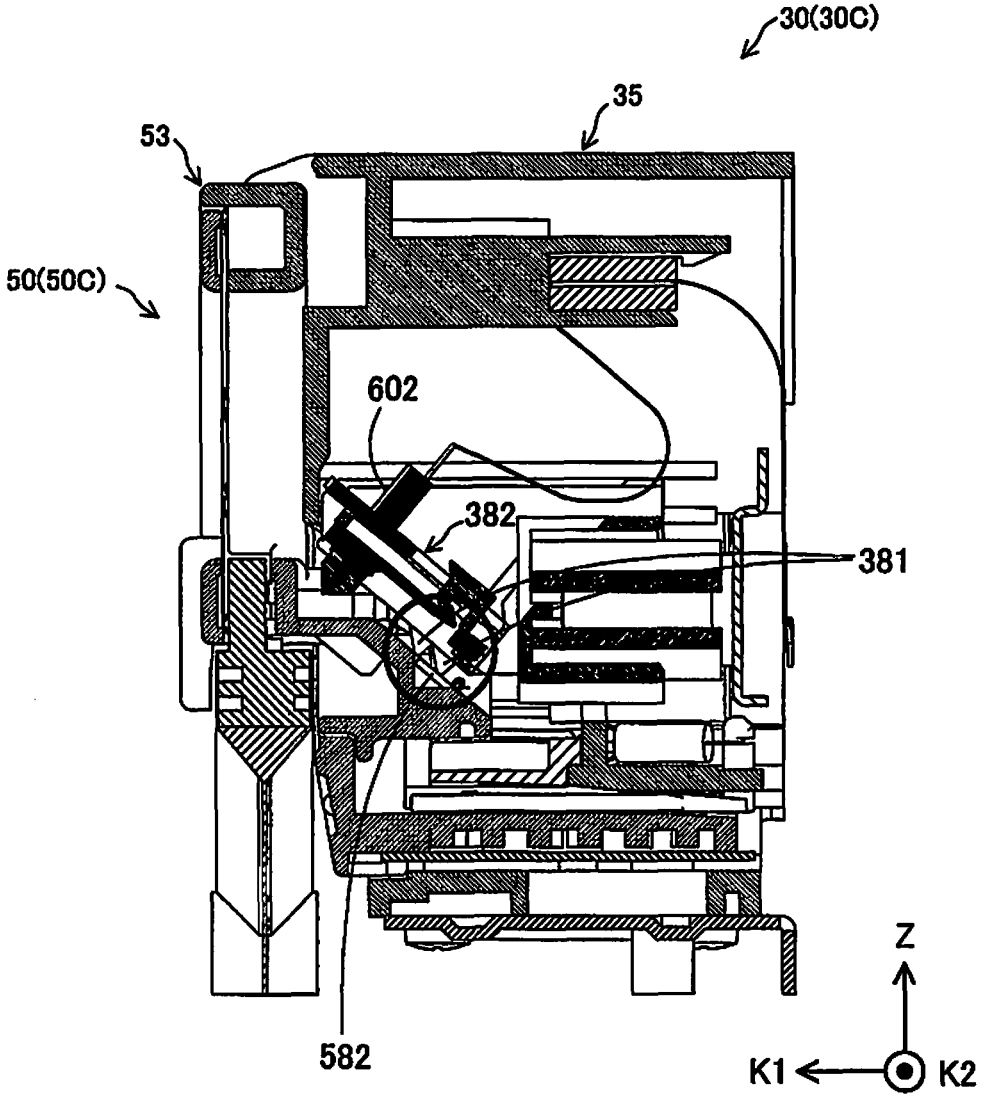
FIG. 27 is an F25B-F25B partial sectional view of FIG. 25.

FIG. 22 is a first diagram illustrating connection timing. FIG. 23 is an F22A-F22A partial sectional view of FIG. 22. FIG. 24 is an F22B-F22B partial sectional view of FIG. 22. FIG. 25 is a second diagram illustrating connection timing. FIG. 26 is an F25A-F25A partial sectional view of FIG. 25. FIG. 27 is an F25B-F25B partial sectional view of FIG. 25. FIG. 22 is a first diagram prior to completion of mounting the liquid container 50. FIG. 25 is a second diagram prior to completion of mounting the liquid container 50.

As shown in FIGS. 23 and 24, pressing the liquid container 50 in the connecting direction (−K1-axis direction or first direction) causes the liquid supply portion 57 to start connecting with the liquid introduction portion 362, before causing the circuit board 582 (more specifically, the terminals 581 of the circuit board 582) to start connecting (coming into contact) with the apparatus-side terminals 381. For the purpose of better understanding, an area where the liquid supply portion 57 starts connecting with the liquid introduction portion 362 is shown by a reference sign "R23" in FIG. 23.

As shown in FIGS. 26 and 27, further pressing the liquid container 50 in the connecting direction causes the terminals 581 of the circuit board 582 to start coming into contact with the apparatus-side terminals 381.

A-8. Relationship of Respective Components of Printer 10 and Liquid Container 50

A-8-1. Supporting in Connecting

Figure 28:
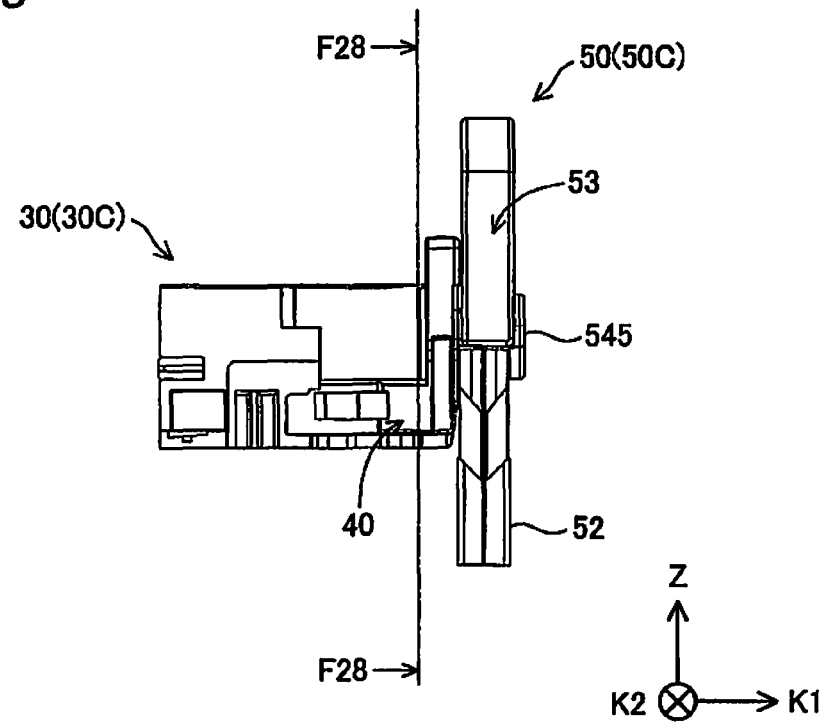
FIG. 28 is a side view illustrating the state that the liquid container is set in the movable member.
Figure 29:
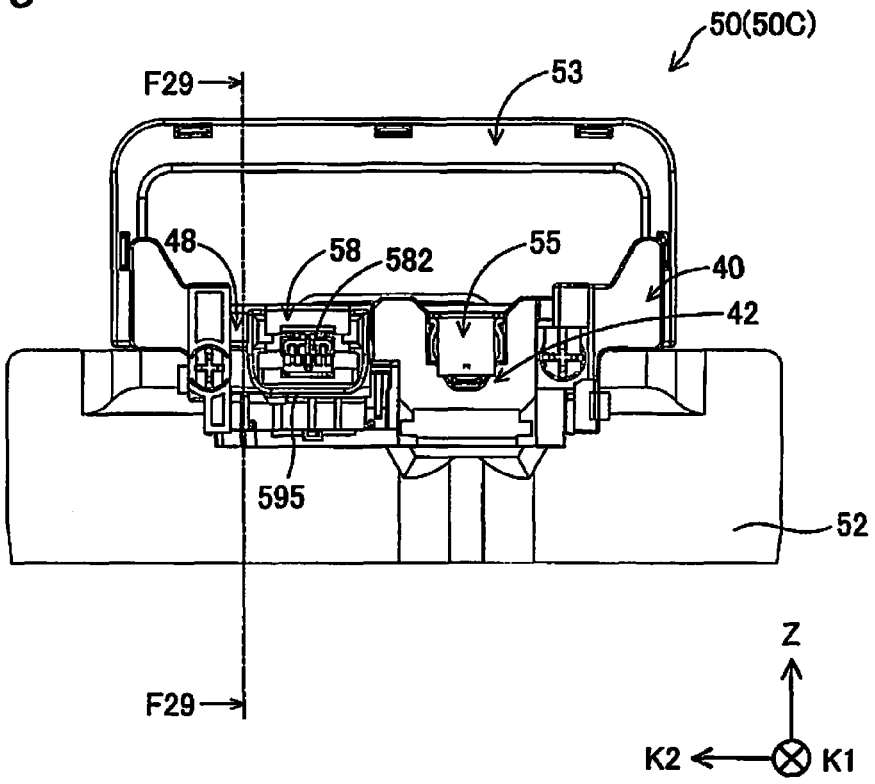
FIG. 29 is a front view illustrating the state that the liquid container is set in the movable member.
Figure 30:
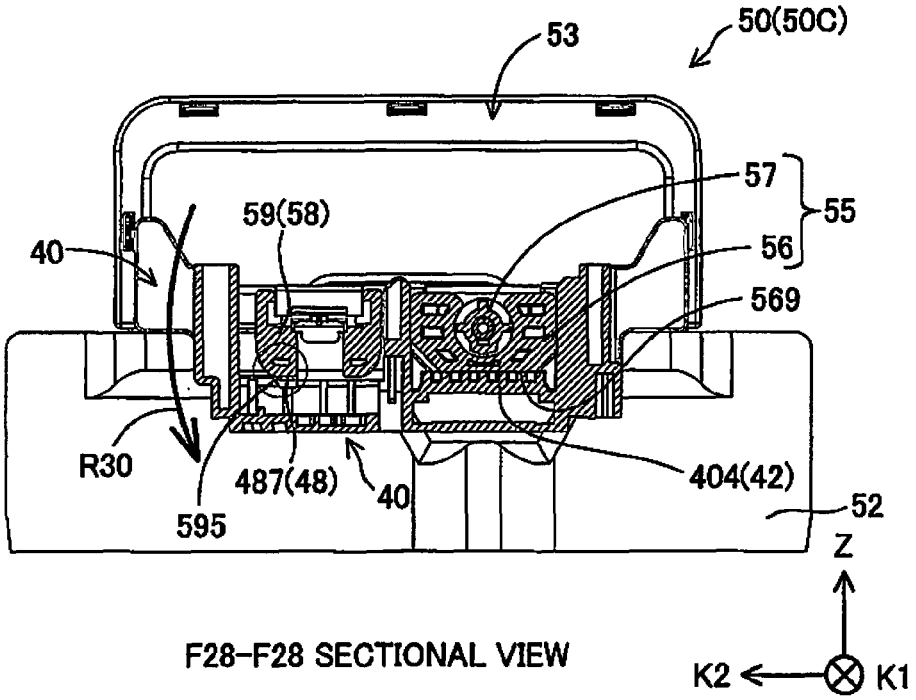
FIG. 30 is an F28-F28 sectional view of FIG. 28.
Figure 31:
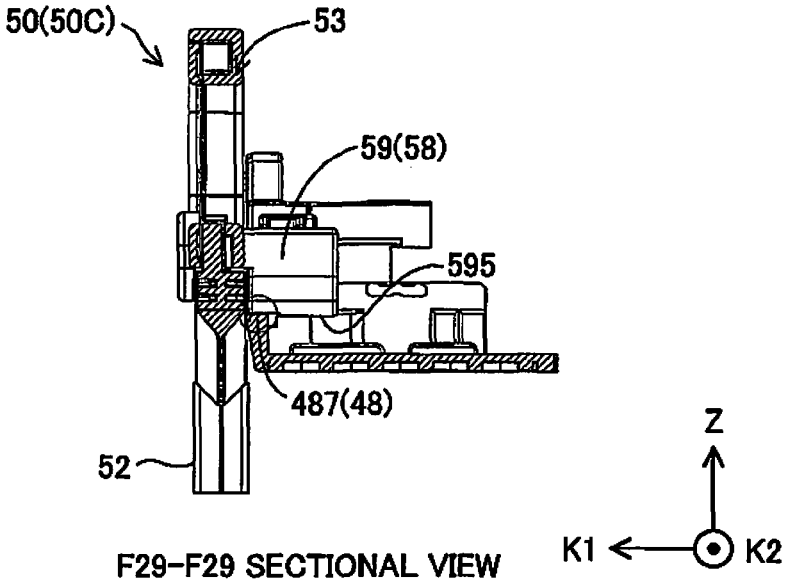
FIG. 31 is an F29-F29 sectional view of FIG. 29.
Figure 32:
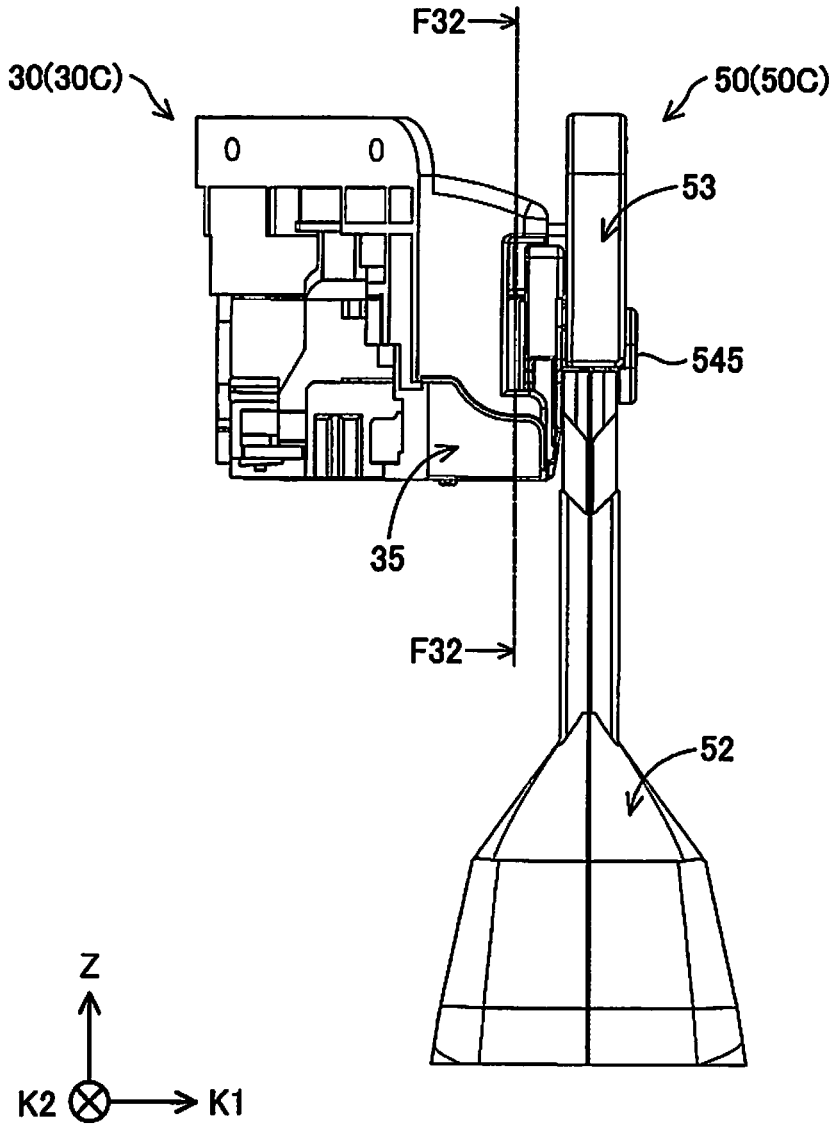
FIG. 32 is a side view illustrating the state that mounting of the liquid container to the mounting/demounting unit is completed.
Figure 33:
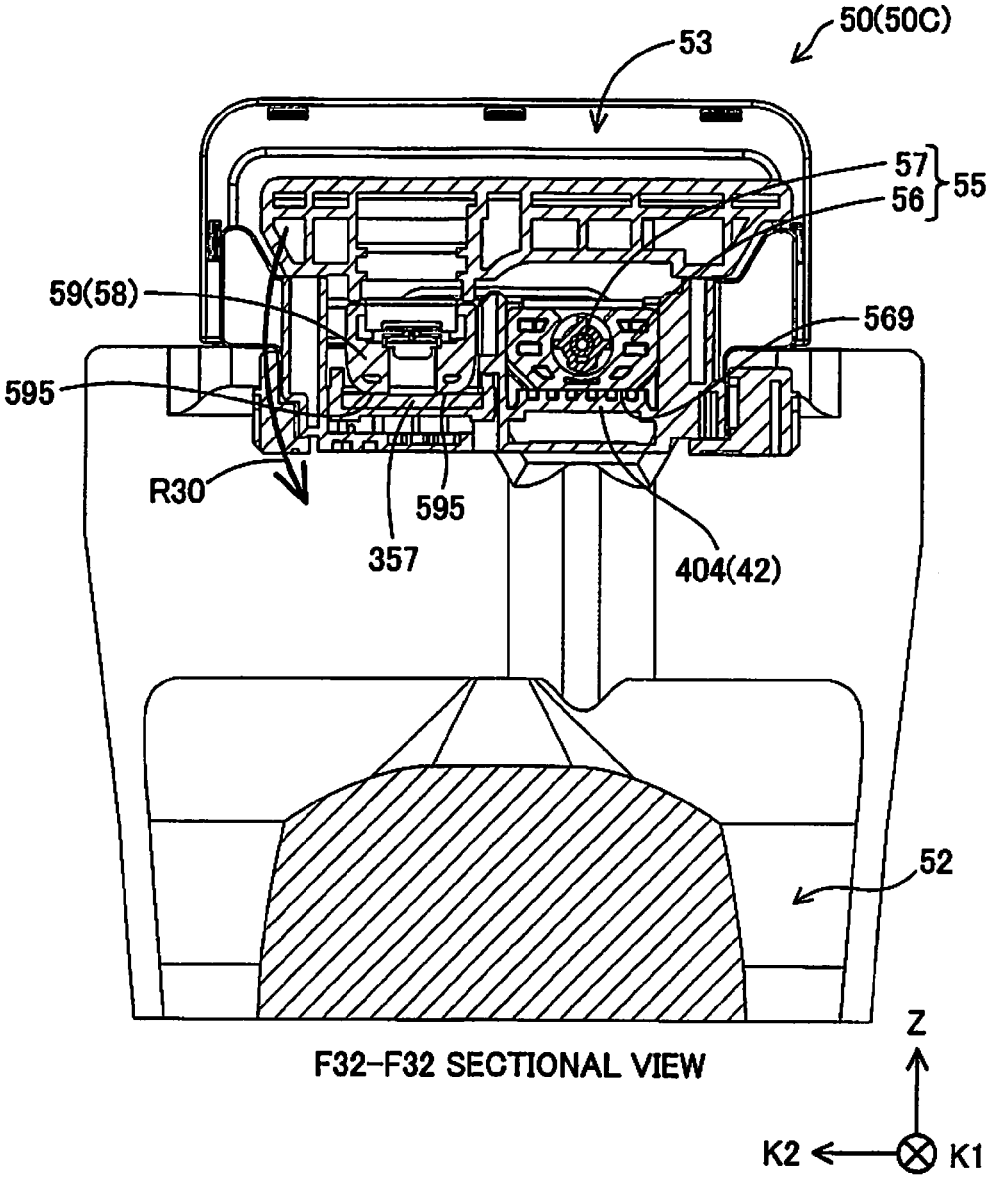
FIG. 33 is an F32-F32 sectional view of FIG. 32.

FIG. 28 is a side view illustrating the state that the liquid container 50 is set in the movable member 40 included in the mounting/demounting unit 30. FIG. 29 is a front view illustrating the state that the liquid container 50 is set in the movable member 40 included in the mounting/demounting unit 30. FIG. 30 is an F28-F28 sectional view of FIG. 28. FIG. 31 is an F29-F29 sectional view of FIG. 29. FIG. 32 is a side view illustrating the state that mounting (connection) of the liquid container 50 to (with) the mounting/demounting unit 30 is completed. FIG. 33 is an F32-F32 sectional view of FIG. 32. The state of the mounting/demounting unit 30 shown in FIG. 28 is the first state like the state of FIG. 5. The state of the mounting/demounting unit 30 shown in FIG. 32 is the second state like the state of FIG. 6.

As shown in FIG. 30, in the state that the liquid container 50 is set in the movable member 40, the liquid supply unit 55 and the substrate unit 58 support the liquid container body 52 such that the liquid supply unit 55 and the substrate unit 58 are located above the liquid container body 52 in the direction of gravity (on the +Z-axis direction side). As shown in FIG. 30, a bottom 569 of the container body-side support structure 56 abuts on the third support surface 404 of the supply portion support structure 42. This restricts the downward motion of the liquid container 50 in the direction of gravity (in the −Z-axis direction). This configuration supports the −K2-axis direction side of the liquid container body 52.

As shown in FIG. 33, as in the state that the liquid container 50 is set in the movable member 40, in the state that the liquid container 50 is connected with the mounting/demounting unit 30 (in the mounted state), the liquid supply unit 55 and the substrate unit 58 support the liquid container body 52 such that the liquid supply unit 55 and the substrate unit 58 are located above the liquid container body 52 in the direction of gravity (on the +Z-axis direction side). More specifically, the bottom 595 of the circuit board holding structure 59 abuts on a bottom 357 of the stationary member 35. This restricts the downward motion of the liquid container 50 in the direction of gravity (in the −Z-axis direction). The bottom 569 of the container body-side support structure 56 abuts on the third support surface 404 of the supply portion support structure 42. This restricts the downward motion of the liquid container 50 in the direction of gravity (in the −Z-axis direction). The liquid supply unit 55 and the substrate unit 58 restrict the downward motion of the liquid container 50 in the direction of gravity in this manner and support the liquid container 50. The circuit board holding structure 59 starts abutting on the bottom 357 of the stationary member 35 during a time period from the time when the liquid container 50 is set in the movable member 40 and is moved in the connecting direction to the time when connection is completed.

As shown in FIGS. 30 and 33, duration rotation in the direction of an arrow R30, the bottom 595 of the circuit board holding structure 59 abuts on an apparatus-side rotation restriction element 487 of the movable member 40. This restricts rotation of the circuit board holding structure 59 about the liquid supply portion 57 in the direction of the arrow R30. The bottom 595 is thus also called rotation restriction element 595.

A-8-2. Positioning of Liquid Supply Portion 57 and Liquid Introduction Portion 362

Figure 34:
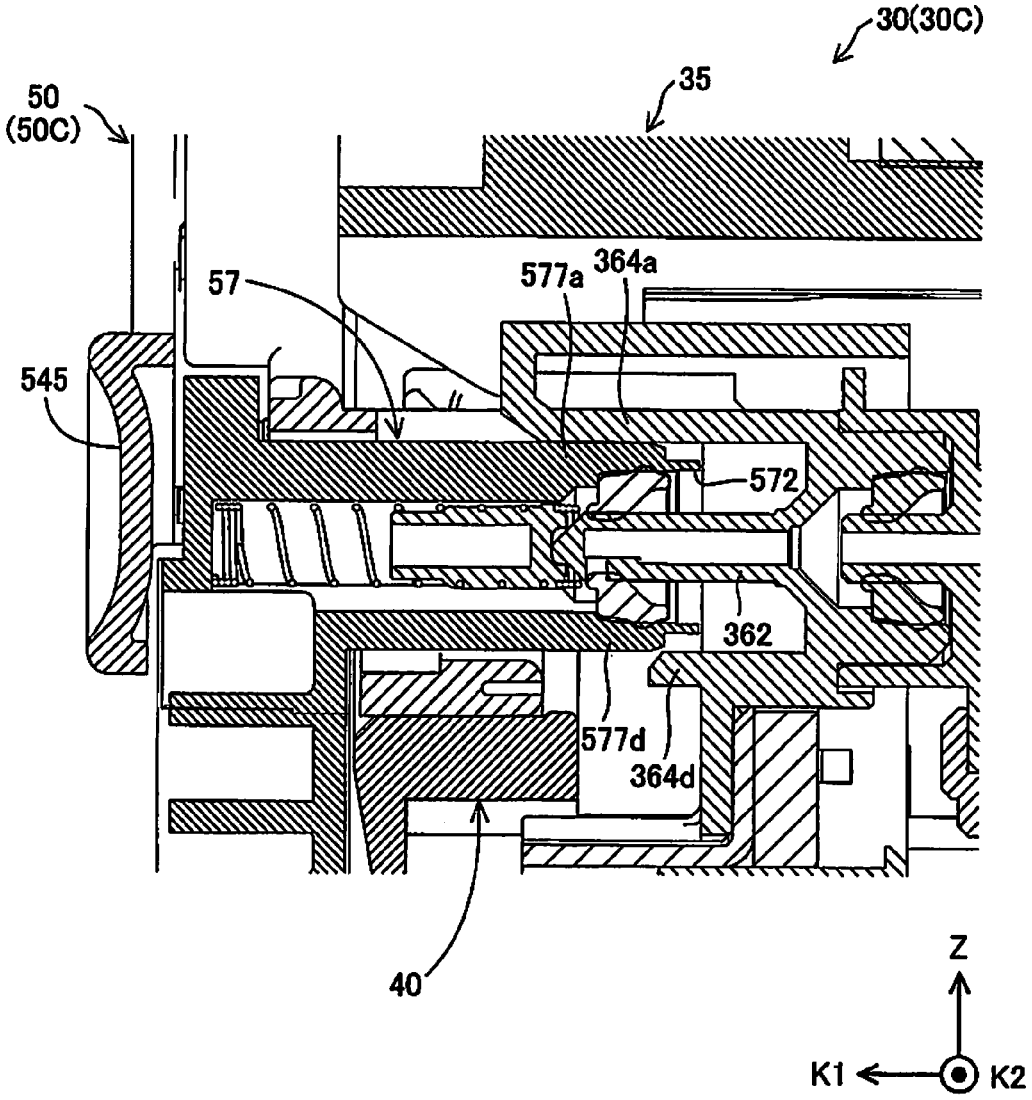
FIG. 34 is an F25A-F25A partial enlarged view of FIG. 25.
Figure 35:
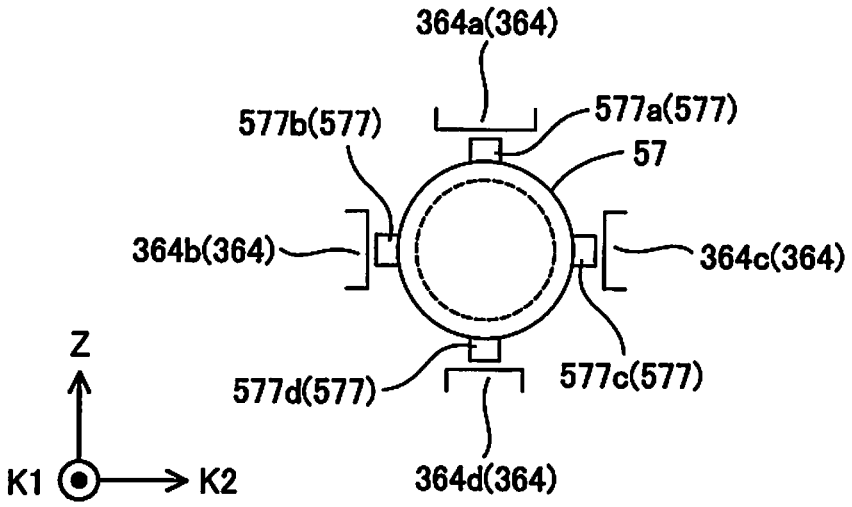
FIG. 35 is a diagram illustrating positioning.

FIG. 34 is an F25A-F25A partial enlarged view of FIG. 25. FIG. 35 is a diagram illustrating positioning.

As shown in FIG. 34, for example, when the liquid supply portion 57 is located above the designed position of the liquid introduction portion 362 in the direction of gravity, the first supply portion positioning structure 364*a* abuts on the first container-side positioning structure 577*a*, so as to position the liquid supply portion 57 in the +Z-axis direction.

As shown in FIG. 35, in the process of connecting the liquid container 50 with the mounting/demounting unit 30, the positioning structures 577 provided around the liquid supply portion 57 enter inside of the positioning structures 364 provided around the liquid introduction portion 362. When the liquid supply portion 57 is misaligned relative to the liquid introduction portion 362, the positioning structure 577 abuts on the supply portion positioning structure 364, so as to finely adjust the position of the liquid supply portion 57 relative to the liquid introduction portion 362. Accordingly the positioning structures 577 and the supply portion positioning structures 364 are members serving to position the liquid supply portion 57 relative to the liquid introduction portion 362 in a direction intersecting with the connecting direction (−K1-axis direction).

A-9. Details of Liquid Introduction Mechanism 36 and Displacement Mechanism (Aligning) of Liquid Introduction Portion 362

Figure 36:
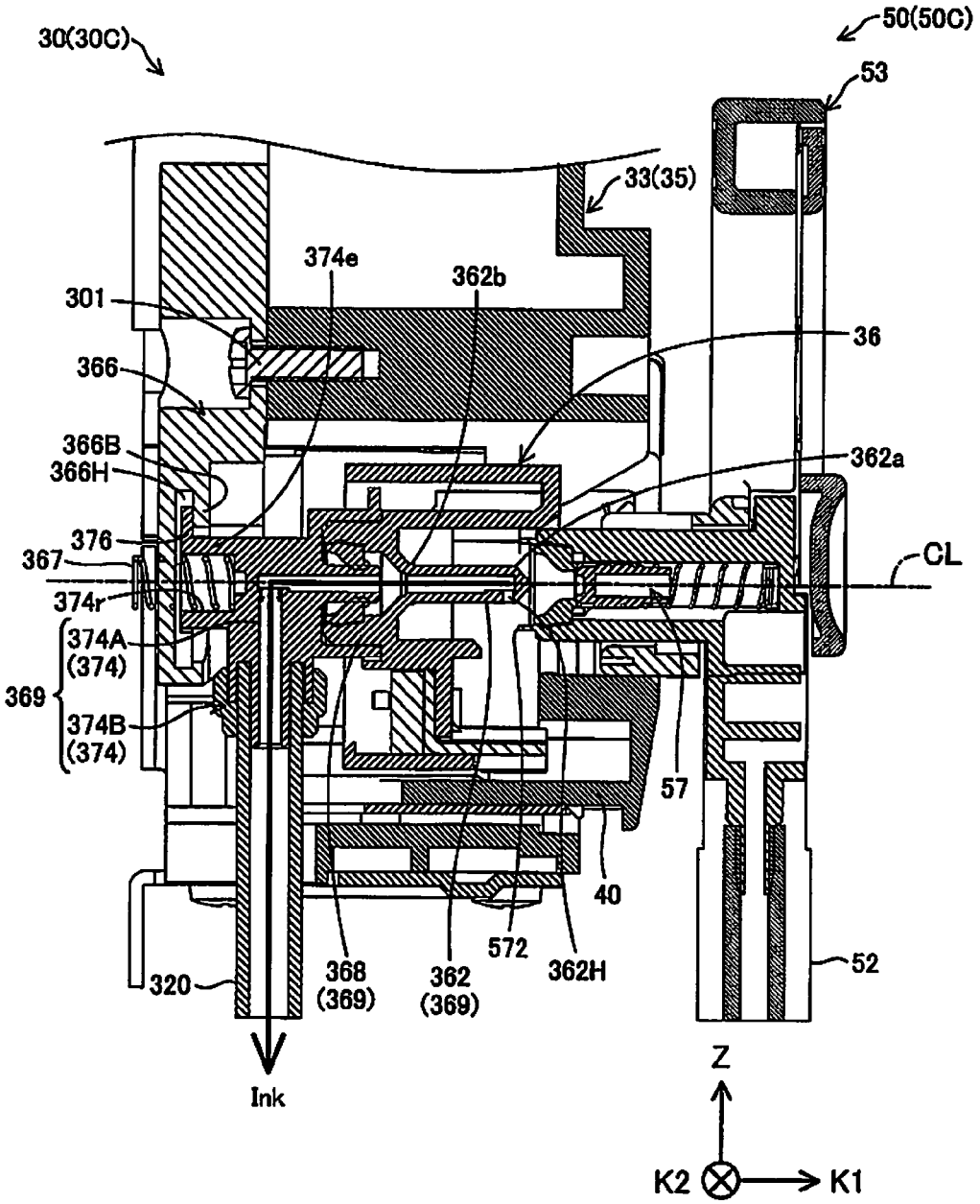
FIG. 36 is an F5B-F5B partial sectional view of FIG. 5B.
Figure 37:
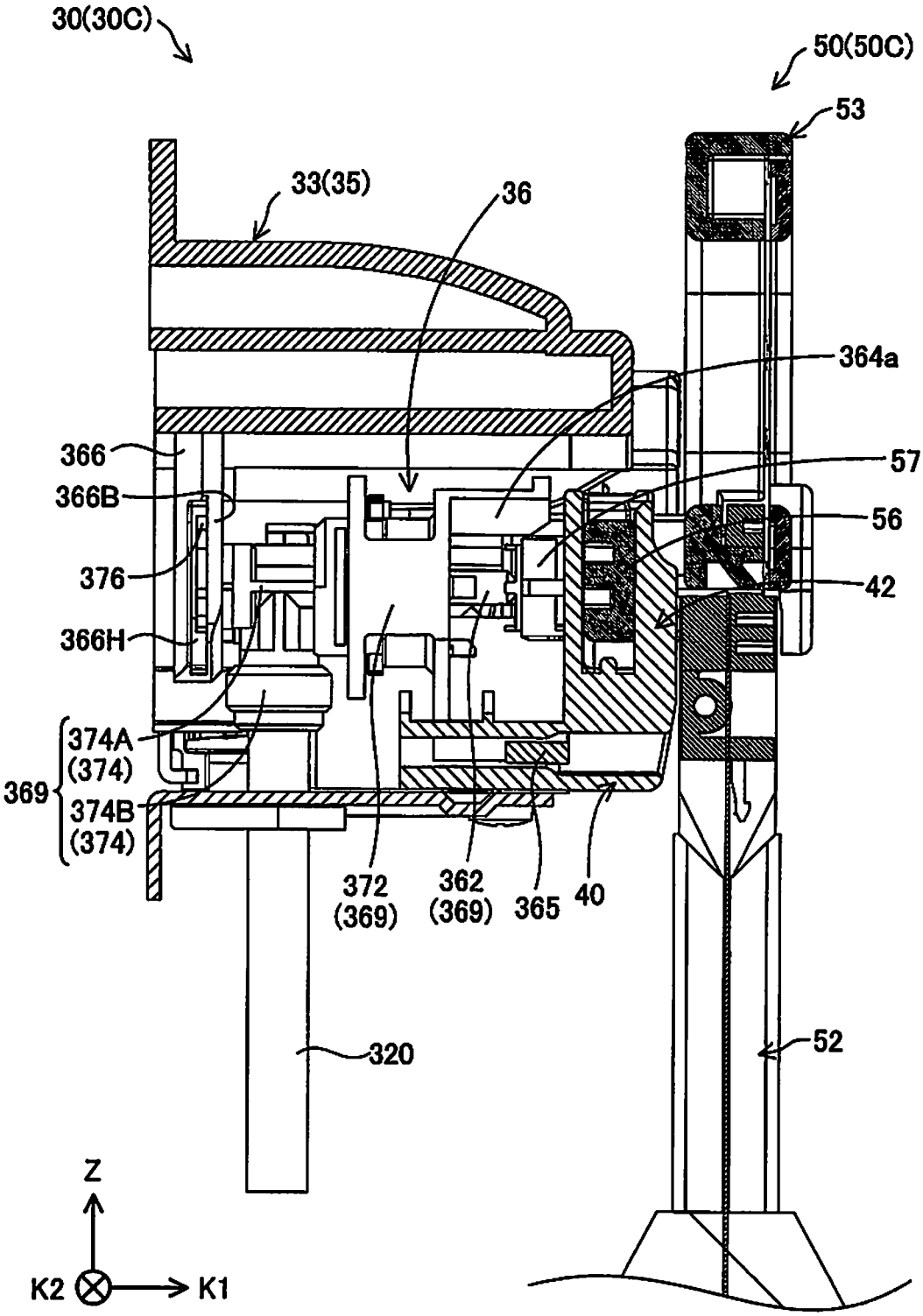
FIG. 37 is a diagram illustrating a liquid introduction portion viewed from a −K2-axis direction side.
Figure 38:
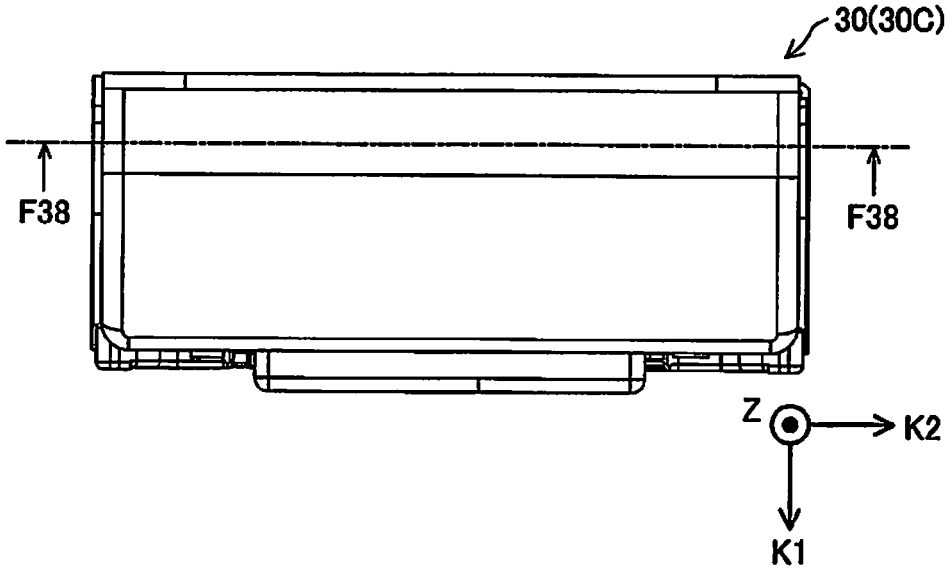
FIG. 38 is a top view illustrating the mounting/demounting unit.
Figure 39:
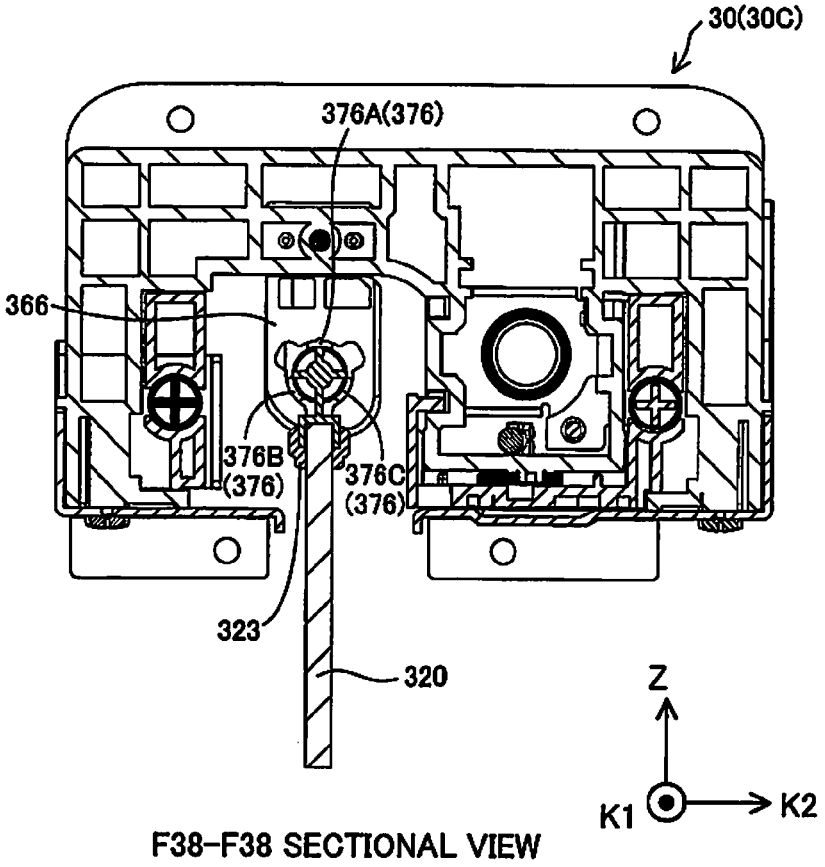
FIG. 39 is an F38-F38 sectional view.
Figure 40:
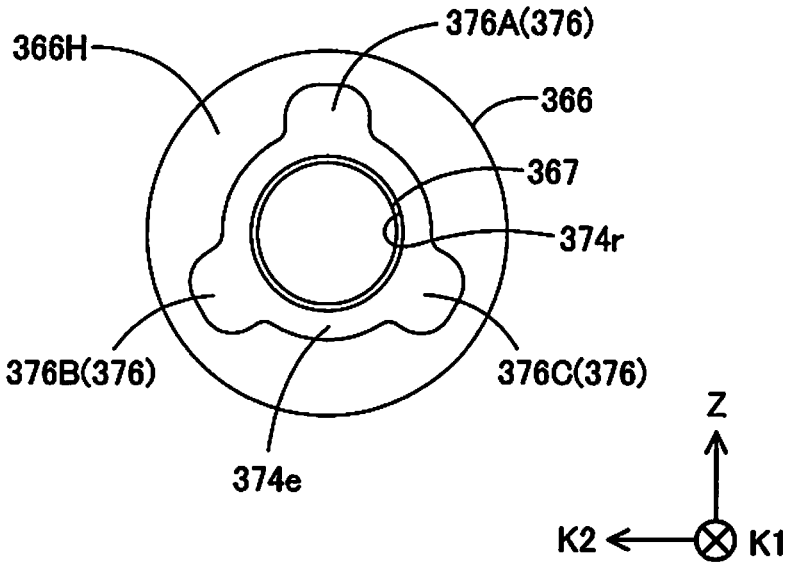
FIG. 40 is a diagram illustrating a displacement mechanism.

FIG. 36 is an F5B-F5B partial sectional view of FIG. 5B. FIG. 37 is a diagram illustrating the liquid introduction portion 362 viewed from the −K2-axis direction side. FIG. 38 is a top view illustrating the mounting/demounting unit 30. FIG. 39 is an F38-F38 sectional view. FIG. 40 is a diagram illustrating a displacement mechanism. The liquid container 50 is also illustrated in FIG. 36 and FIG. 37 for the purpose of better understanding.

As shown in FIG. 36 and FIG. 37, the liquid introduction mechanism 36 includes a liquid flow portion 369 configured to form a flow path through which ink contained in the liquid container 50 is flowed to the printer 10. The liquid flow portion 369 includes the liquid introduction portion 362, the liquid introduction main body 368 and a connecting flow path portion 374 arranged in this sequence from the upstream side in the flow direction of ink from outside toward the printer 10. In the description below, the "upstream side" and the "downstream side" are defined on the basis of the flow direction of ink from outside (liquid container 50) toward the printer 10. The liquid flow portion 369 forms a flow path parallel to the center axis CT on the upstream side and forms a downward flow path in the direction of gravity on the downstream side. The liquid flow portion 369 may be regarded as the "liquid introduction portion 362".

A liquid introducing hole 362H is formed on an upstream side end of the liquid introduction portion 362 and causes ink from outside to be flowed into a flow path in the liquid introduction portion 362. A downstream side end of the liquid introduction portion 362 is connected with the liquid introduction main body 368. The liquid introduction portion 362 and the liquid introduction main body 368 form a flow path parallel to a center axis CL. The liquid introduction main body 368 may be regarded as part of the liquid introduction portion 362. In this sense, the liquid introduction main body 368 forms a downstream side end of the liquid introduction portion 362.

An upstream side end of the connecting flow path portion 374 is connected with the liquid introduction main body 368, and a downstream side end is connected with the liquid flow tube 320. The connecting flow path portion 374 forms a bent flow path. More specifically, the connecting flow path portion 374 forms a flow path parallel to the center axis CL and a downward flow path in the direction of gravity. The connecting flow path portion 374 includes a flow path forming portion 374A configured to form a flow path and a connection structure 374B configured to join the liquid flow tube 320 with the flow path forming portion 374A in the airtight manner. The flow path forming portion 374A and the connection structure 374B are formed by two-color molding. This configuration enables the flow path forming portion 374A and the connection structure 374B to be readily formed by using different materials.

The liquid flow portion 369 (liquid introduction portion 362) is insert molded in the state that one end of the liquid flow tube 320 is inserted into the connection structure 374B of the liquid flow portion 362. More specifically, the connection structure 374B and the flow path forming portion 374A are molded components, and the liquid flow tube 320 is an insert component. More specifically, after the flow path forming portion 374A and the liquid flow tube 320 are connected, the connection structure 374B is injection molded to cover the periphery of the connecting region. Insert molding of the liquid flow tube 320 in the liquid flow portion 369 enables the connecting region to be made airtight by the connection structure 374B. This configuration reduces the possibility that ink is leaked outside from the connecting region between the liquid flow tube 320 and the liquid flow portion 369. In the configuration that the liquid flow tube 320 is connected with the connection structure 374B and is fixed by means of a spring, there is a possibility that a portion fixed by the spring creeps to be cracked and cause leakage of the liquid. The liquid supply device 20 of this configuration, however, reduces the possibility of such leakage of the liquid. The other end (not shown) of the liquid flow tube 320 that is located on the printer 10-side is also insert molded in the state that the other end is inserted into a connection structure.

As described above, the liquid flow portion 369 has an upstream-side introduction portion that includes a leading edge (upstream side end) 362*a* that is to be connected with the liquid lead-out portion 57 and forms a flow path parallel to the first direction (−K1-axis direction). The liquid flow portion 369 also has a downstream-side introduction portion that includes a downstream side end that is to be connected with the liquid flow tube 320 and is extended from the upstream-side introduction portion downward in the direction of gravity (in the −Z-axis direction). The liquid flow portion 369 includes the downstream-side introduction portion that is extended in the direction intersecting with the first direction (downward in the direction of gravity). This configuration suppresses size expansion of the liquid supply device 20 in the first direction.

As shown in FIG. 36, a recess 374*r* serving as a spring receiver to receive the other end of the coil spring 367 is formed on the opposite side of the connecting flow path portion 374 (connection structure base end 374*e*) that is opposite to the side where the liquid introduction main body 368 is located in the direction parallel to the center axis CL (center axis CL direction). One end of the coil spring 367 abuts on the wall surface of the printer 10 (for example, the apparatus third surface 106 shown in FIG. 2). The coil spring 367 presses the liquid flow portion 369 toward the leading edge 362*a* of the liquid introduction portion 362 (in the +K1-axis direction or in the direction toward the liquid supply portion 57). With regard to the liquid introduction portion 362, a direction from the leading edge 362*a* toward a base end 362*b* (or to the connection structure base end 374*e*) is the −K1-axis direction (connecting direction).

As shown in FIG. 36 and FIG. 40, the connection structure base end 374*e* includes restriction elements 376 that are protruded outward in a plane direction perpendicular to the center axis CL direction. As shown in FIG. 36, the restriction elements 376 are placed in an inner housing space 366H of the fixation structure 366. The restriction elements 376 abut on a wall portion 366B configured to define and form the inner housing space 366H. This configuration restricts the motion of the liquid flow portion 369 toward the leading edge 362*a* by the coil spring 367.

As shown in FIG. 40, three restriction elements 376 are provided at approximately fixed intervals in the circumferential direction of the connection structure base end 374*e* having an approximately circular section. More specifically, the restriction elements 376 include a first restriction element 376A, a second restriction element 376B and a third restriction element 376C as shown in FIGS. 39 and 40. The restriction elements 376 are arranged with some backlash (clearance) relative to the wall portion configured to define and form the inner housing space 366H in a direction perpendicular to the center axis CL direction (K1-axis direction) (direction parallel to the plane defined by the Z-axis direction and the K2-axis direction). The liquid flow portion 369 is accordingly configured to be displaceable by the coil spring 367 and the fixation structure 366 fixed to the stationary member 35 in the direction intersecting with the first direction (−K1-axis direction) (direction parallel to the plane defined by the Z-axis direction and the K2-axis direction).

A-10. Displacement Mechanism of Movable Member 40

Figure 41:
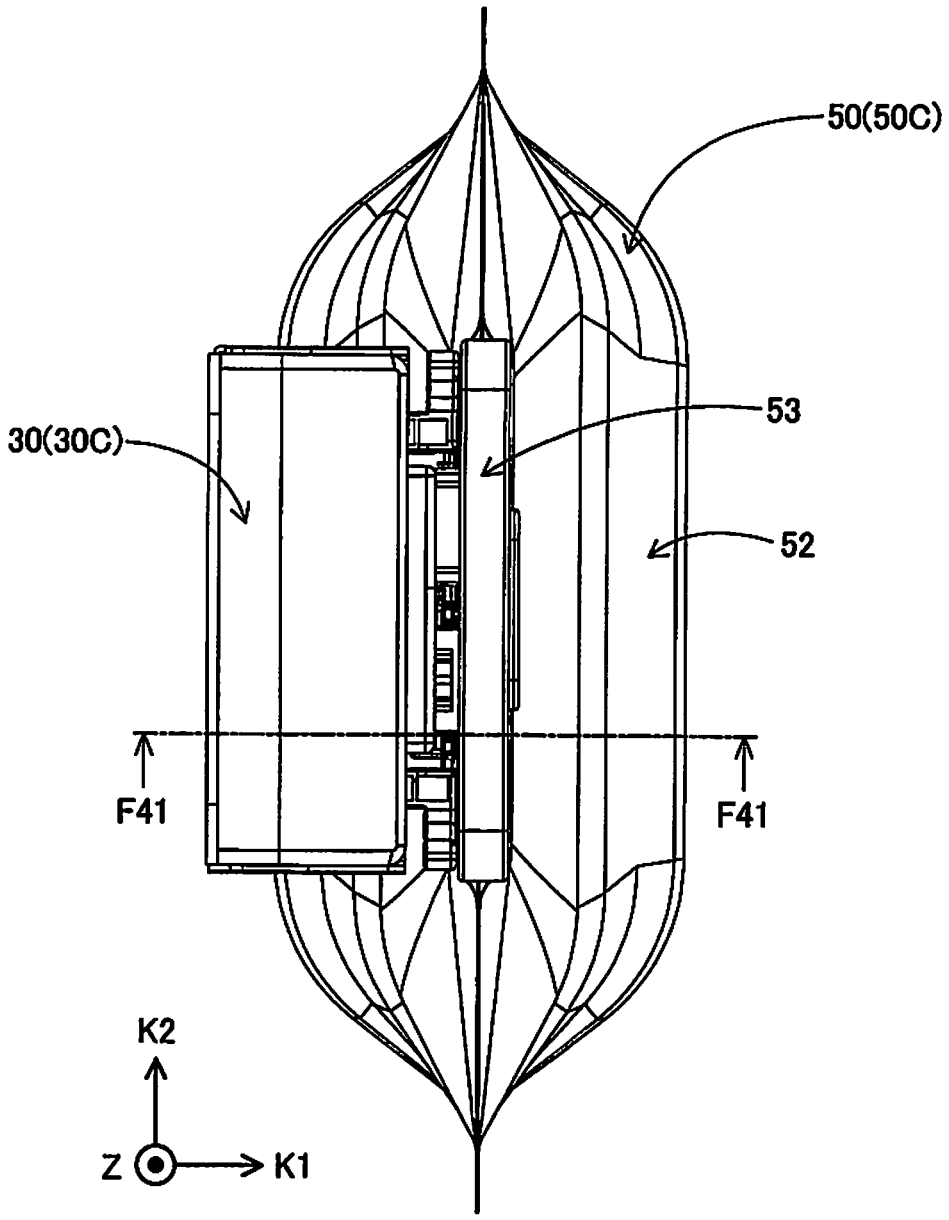
FIG. 41 is a top view illustrating the mounting/demounting unit and the liquid container.
Figure 42:
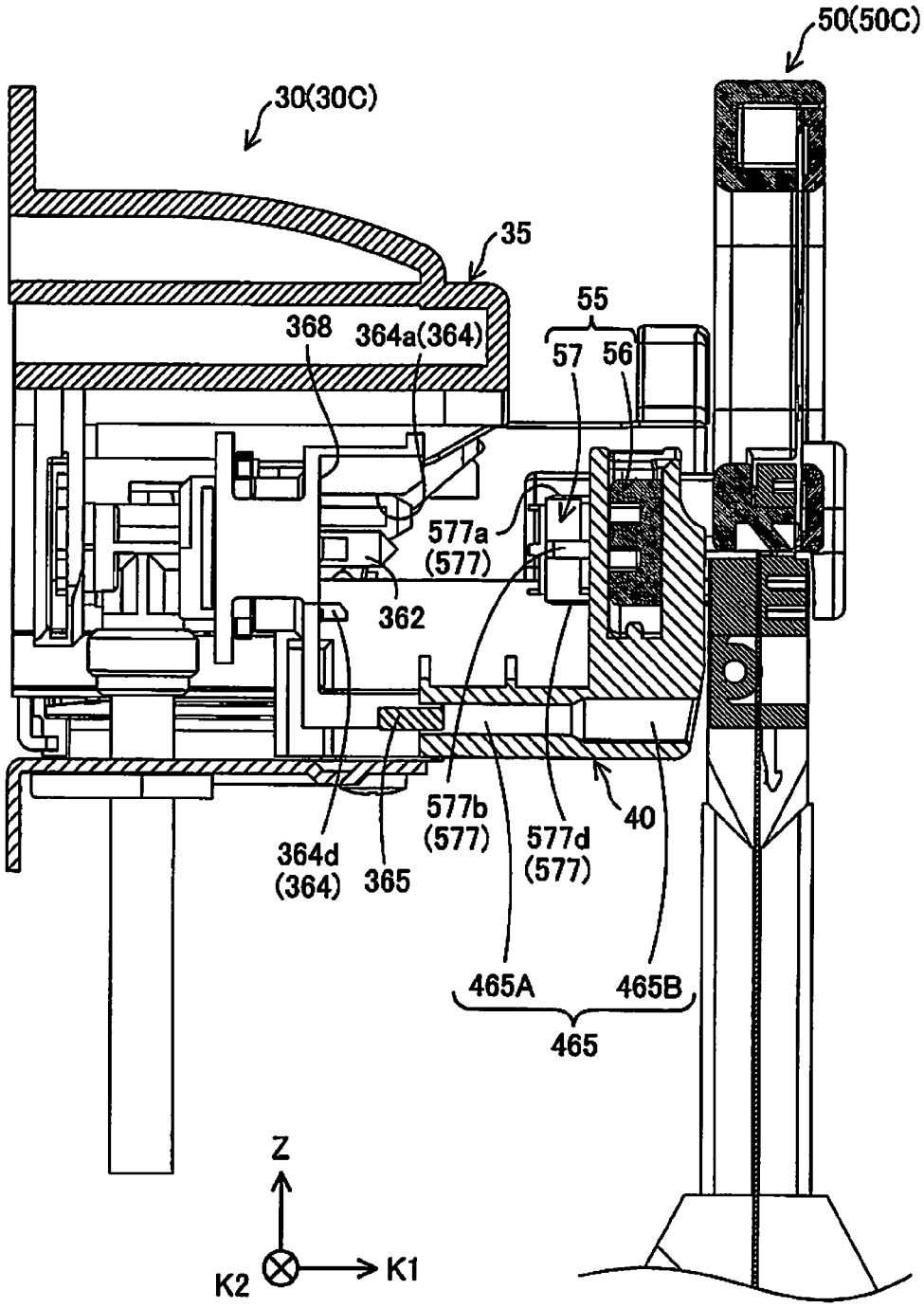
FIG. 42 is a first diagram corresponding to an F41-F41 partial sectional view.
Figure 43:
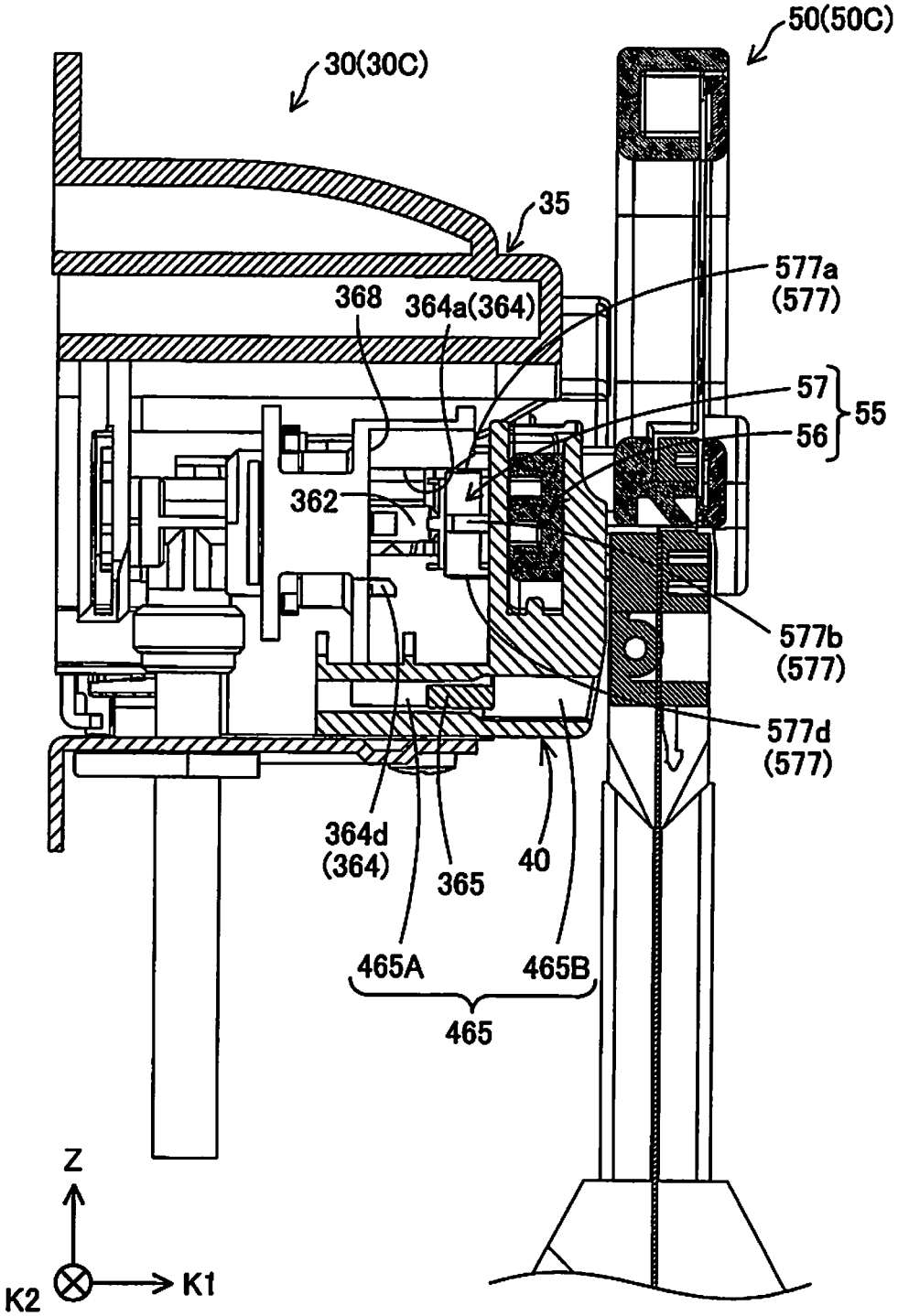
FIG. 43 is a second diagram corresponding to the F41-F41 partial sectional view.
Figure 44:
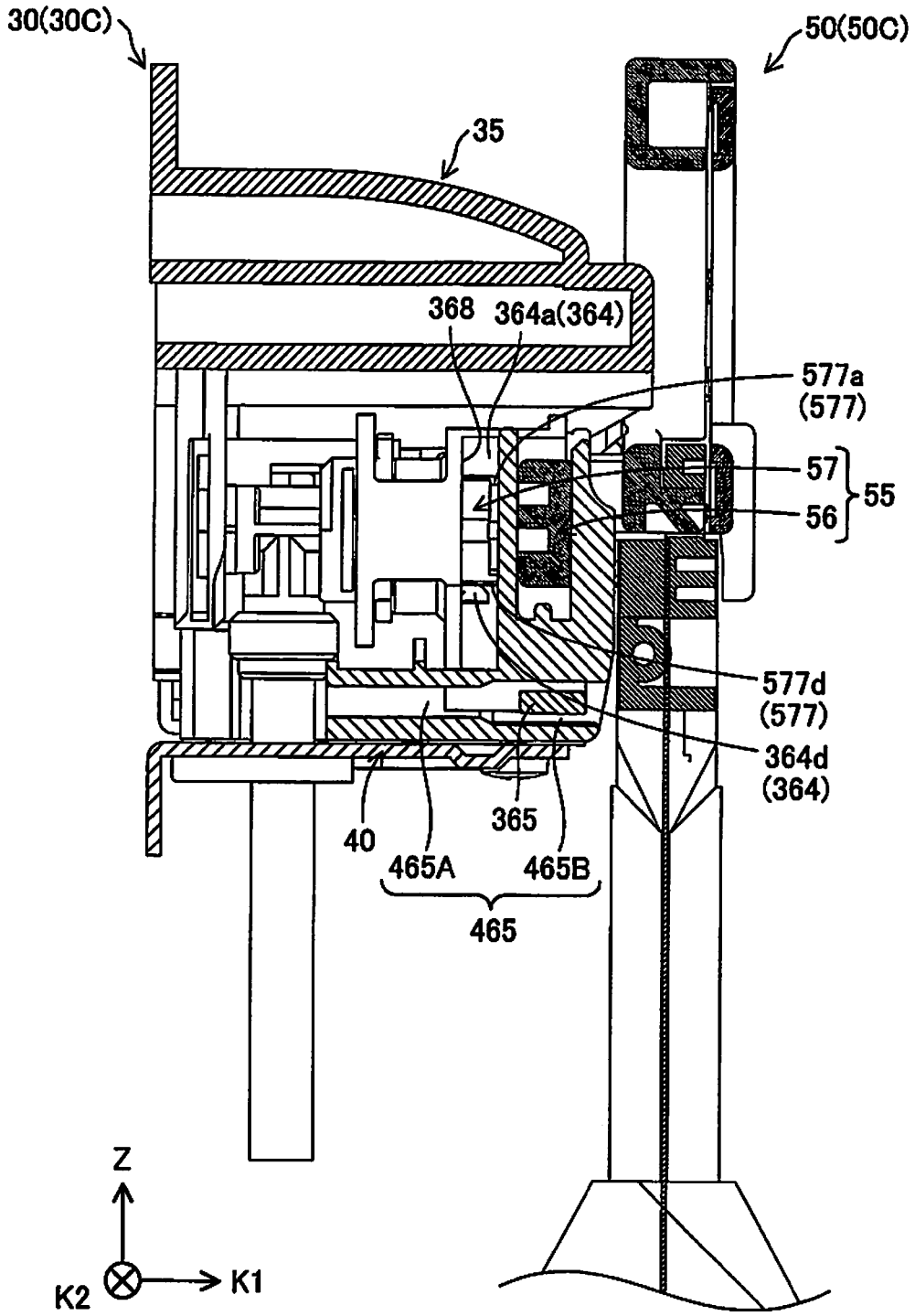
FIG. 44 is a third view corresponding to the F41-F41 partial sectional view.

FIG. 41 is a top view illustrating the mounting/demounting unit 30 and the liquid container 50. FIG. 42 is a first diagram corresponding to an F41-F41 partial sectional view. FIG. 43 is a second diagram corresponding to the F41-F41 partial sectional view. FIG. 44 is a third view corresponding to the F41-F41 partial sectional view. In FIGS. 42 to 44, the positions of the movable member 40 and the liquid container 50 are changed relative to the stationary member 35. FIG. 42 is a diagram illustrating the state that the liquid container 50 is set in the movable member 40 in the first state that the movable member 40 is protruded outward relative to the stationary member 35. FIG. 43 is a diagram illustrating the state that the movable member 40 is pressed in the connecting direction (−K1-axis direction) and causes the liquid supply portion 57 to start connecting with the liquid introduction portion 362. FIG. 44 is a diagram illustrating the mounted state of the liquid container 50.

As shown in FIG. 42, the movable member 40 includes the guiding portion 465 in which the guide structure 365 of the liquid introduction main body 368 is inserted. The guiding portion 465 includes a first guiding portion 465A and a second guiding portion 465B. The first guiding portion 465A is located on the first direction (−K1-axis direction) side of the second guiding portion 465B. The second guiding portion 465B is connected with the first guiding portion 465A. The second guiding portion 465B has a greater length in the direction of gravity (Z-axis direction) than the first guiding portion 465A. Accordingly, as shown in FIG. 42 and FIG. 44, a clearance between the second guiding portion 465B and the guide structure 365 in the direction of gravity is larger than a clearance between the first guiding portion 465A and the guide structure 365 in the direction of gravity.

As shown in FIG. 42, in the state that the movable member 40 is protruded most outward (+K1-axis direction) relative to the stationary member 35, part of the guide structure 365 is placed in the first guiding portion 465A. When the movable member 40 is pressed inward (in the first direction or −K1-axis direction) from the state shown in FIG. 42, the liquid supply portion 57 starts connecting with the liquid introduction portion 362 as shown in FIG. 43. At the start of connection, the guide structure 365 reaches the boundary between the first guiding portion 465A and the second guiding portion 465B. Further pressing the movable member 40 inward completes the connection of the liquid supply portion 57 with the liquid introduction portion 362 as shown in FIG. 44.

As described above, the guide structure 365 is located in the first guiding portion 465A for a time period from the time when the liquid container 50 is set in the movable member 40 to the time when the liquid supply portion 57 starts connecting with the liquid introduction portion 362 (as shown in FIGS. 42 and 43). The guide structure 365 is located in the second guiding portion 465B for a time period from the time when the liquid supply portion 57 starts connecting with the liquid introduction portion 362 to the time when the connection is completed (as shown in FIG. 43 and FIG. 44). The guiding portion 465 of the movable member (first support assembly) 40 accordingly supports the liquid supply portion (liquid lead-out portion) 57 such that a side of the liquid supply portion 57 far from the liquid introduction portion 362 (first side) is displaceable by a greater degree in the direction intersecting with the first direction (in the Z-axis direction) than a side near to the liquid introduction portion 362 (second side). The "far side" is the supply connecting portion 573 (shown in FIG. 9) that is the other end of the liquid supply portion 57, and the "near side" is the liquid supply port 572 (shown in FIG. 9) that is one end of the liquid supply portion 57.

The configuration of the guide structure 365 and the guiding portion 465 serving as the displacement mechanism facilitates positioning of the liquid supply portion 57 relative to the liquid introduction portion 362 at the start of connection of the liquid supply portion 57 with the liquid introduction portion 362, and reduces restriction of the motion of the liquid supply portion 57 immediately before completion of the connection compared with that at the start of connection. This ensures smooth connection of the liquid supply portion 57 with the liquid introduction portion 362. Prior to a start of connection, setting a small backlash enables the liquid supply portion 57 to be positioned with high accuracy relative to the liquid introduction portion 362. After a start of connection, on the other hand, setting a large backlash enables the liquid introduction portion 362 to readily follow the motion of the liquid supply portion 57.

In addition to the above configuration, the guiding portion 465 of the movable member (first support assembly) 40 may be configured to support the liquid supply portion (liquid lead-out portion) 57 such that the side of the liquid supply portion 57 far from the liquid introduction portion 362 is displaceable by a greater degree in the K2-axis direction than the side near to the liquid introduction portion 362. This additional configuration may be implemented by, for example, making a clearance between the second guiding portion 465B and the guide structure 365 in the K2-axis direction larger than a clearance between the first guiding portion 465A and the guide structure 365 in the K2-axis direction.

A-11. Advantageous Effects

According to the embodiment described above, as shown in FIG. 19, the first support assembly 40 supports the liquid lead-out portion 57 such as to locate the liquid lead-out portion 57 above the liquid container body 52 in the direction of gravity and such as to move the liquid lead-out portion 57 along the first direction (−K1-axis direction) intersecting with the direction of gravity (Z-axis direction). This configuration reduces the possibility of failed connection of the liquid lead-out portion 57 with the liquid introduction portion 362 by the interference of the liquid container body 52. According to the embodiment described above, as shown in FIG. 35, the positioning structures 364 are arranged around the liquid introduction portion 362. This configuration enables the liquid lead-out portion 57 to be positioned relative to the liquid introduction portion 362 in the direction intersecting with the first direction (−K1-axis direction) (direction parallel to the plane defined by the Z-axis direction and the K2-axis direction). This ensures smooth connection of the liquid lead-out portion 57 with the liquid introduction portion 362.

According to the above embodiment, as shown in FIGS. 36, 39 and 40, the second support structure 366 supports the liquid introduction portion 362 such that the liquid introduction portion 362 is displaceable in the direction intersecting with the first direction. This configuration enables the liquid introduction portion 362 to be displaced following the motion of the liquid lead-out portion 57 in the process of connecting the liquid introduction portion 362 with the liquid lead-out portion 57. This ensures smoother connection of the liquid lead-out portion 57 with the liquid introduction portion 362.

According to the above embodiment, as shown in FIG. 36, the liquid introduction portion 362 is pressed by the coil spring 367 in the direction toward the liquid lead-out portion 57. This configuration reduces the possibility that the liquid lead-out portion 57 is dropped off from the liquid introduction portion 362 in the mounted state of the liquid container 50. In other words, this configuration reduces the possibility of failed connection of the liquid introduction portion 362 with the liquid lead-out portion 57.

According to the above embodiment, as shown in FIG. 36, the liquid introduction mechanism 36 including the liquid supply connection structure 362 (liquid introduction portion 362) is supported by the outer wall (for example, the apparatus third surface 106 shown in FIG. 4) via the fixation structure 366 and the stationary member 35. This configuration facilitates connection of the liquid container 50 with the liquid supply connection structure 362, compared with the configuration that the liquid supply connection structure 362 is placed inside of the printer 10. This configuration also suppresses size expansion of the printer 10 and provides a large space for the liquid container 50 placed therein, compared with the configuration that the liquid supply connection structure 362 is placed inside of the printer 10. This provides the large capacity of the liquid container body 52 of the liquid container 50 and accordingly enables a large amount of liquid to be contained in the liquid container 50. This configuration shortens the flow path of ink from the liquid container 50 to the printer 10 (liquid supply passage), compared with the external configuration that the liquid container 50 is placed at a location away from the printer 10. This accordingly shortens a time period required for the ink contained in the liquid container 50 to reach the printer 10. This also suppresses the ink component from being vaporized through the liquid supply passage to change the properties of ink. This additionally reduces the flow resistance in the liquid supply passage and thereby reduces the power required for supplying ink from the liquid container 50 to the printer 10 (for example, the power of a pump used to suck ink).

According to the above embodiment, as shown in FIG. 6A and FIG. 6J, the contact mechanism 38 including the apparatus-side electrical connection structure 382 is supported by the outer wall (for example, the apparatus third surface 106 shown in FIG. 4) via the sheet metal 323 and the stationary member 35. This configuration facilitates connection of the apparatus-side electrical connection structure 382 with the container-side electrical connection structure 582 (circuit board 582), compared with the configuration that the apparatus-side electrical connection structure 382 is placed inside of the printer 10.

According to the above embodiment, as shown in FIG. 5B, the liquid supply connection structure 362 and the apparatus-side electrical connection structure 382 are arranged side by side in the K2-axis direction. More specifically, the liquid supply connection structure 362 and the apparatus-side electrical connection structure 382 are arranged adjacent to each other in the K2-axis direction. In other words, the liquid supply connection structure 362 and the apparatus-side electrical connection structure 382 are arranged next to each other such as to be visible simultaneously for the user. The user can thus simultaneously observe the liquid supply connection structure 362 and the apparatus-side electrical connection structure 382 and connect the corresponding portions (the liquid lead-out portion 57 and the circuit board 582) of the liquid container 50. This improves the operability in mounting the liquid container 50 to the printer 10. The term "adjacent" in the description hereof means that two members are arranged next to each other but do not necessarily adjoin to each other. Accordingly the two members may not be in contact with each other.

According to the above embodiment, as shown in FIG. 5A, the liquid supply device 20 includes the liquid container holder 22 that has the bottom face 27 and the openable and closable top. Even if ink is leaked out from the liquid supply connection structure 362 during attachment or detachment of the liquid supply portion 57 to or from the liquid supply connection structure 362, the leaked ink is accumulated on the bottom face 27. This reduces the possibility that the outside of the liquid supply device 20 is stained with ink. The top of the liquid container holder 22 is opened and closed only when needed, for example, for mounting and demounting the liquid container 50 to and from the printer 10. The liquid container 50 is accordingly protected by the liquid container holder 22 in the ordinary state, for example, during use of the printer 10. This reduces the possibility that the liquid container 50 is damaged. The liquid supply connection structure 362 is placed inside of the liquid container holder 22. This reduces the possibility that the liquid supply connection structure 362 is damaged.

According to the above embodiment, as shown in FIG. 10 and FIG. 18, the holding structure 59 supports the container-side electrical connection structure 582 to be located above the liquid container body 52 (on the upper side in the direction of gravity) when the liquid container 50 is connected with the printer 10. Even in the state that the liquid container body 52 hangs down in the direction of gravity by the dead weight (in the free state), the holding structure 59 supports the container-side electrical connection structure 582, such as to locate the container-side electrical connection structure 582 in the designed range. This configuration ensures favorable electrical connection between the container-side electrical connection structure 582 and the apparatus-side electrical connection structure 382.

According to the above embodiment, as shown in FIG. 17D, the contact plane TP is inclined such that the lower side is located on the first direction side (−K1-axis direction side) of the upper side. The surface 62*fa* of the terminal holder 62 is accordingly inclined such that the upper side is protruded more than the lower side in the opposite direction (+K1-axis direction) to the first direction as shown in FIG. 24. In other words, the surface 62*fa* of the terminal holder 62 is arranged to cover over the contacts cp of the circuit board 582. This configuration reduces the possibility that impurity such as dust adheres to the electrical connection structure 382 (for example, the surface 62*fa* or the apparatus-side terminals 381). This accordingly ensures more favorable electrical connection between the container-side electrical connection structure 582 and the apparatus-side electrical connection structure 382.

According to the above embodiment, as shown in FIG. 6K and FIG. 11, the holding structure 59 includes the restriction element 597 that abuts on the first support assembly 40 so as to restrict the motion of the holding structure 59 in the opposite direction (+K1-axis direction) to the first direction. In the mounted state, an external force in the +K1-axis direction may be applied to the holding structure 59 of the liquid container 50. This external force may be, for example, the pressing force of the coil spring 387 shown in FIG. 6J or the elastic force of the apparatus-side terminals 381 shown in FIG. 6V. Applying such an external force in the +K1-axis direction to the holding structure 59 is likely to move the holding structure 59 in the +K1-axis direction and cut off the electrical connection between the container-side electrical connection structure 582 and the apparatus-side electrical connection structure 382. The restriction element 597, however, serves to restrict the motion of the holding structure 59 in the +K1-axis direction and thereby stably maintains the electrical connection between the container-side electrical connection structure 582 and the apparatus-side electrical connection structure 382.

According to the above embodiment, as shown in FIG. 30 and FIG. 33, the holding structure 59 includes the rotation restriction element 595 that abuts on the first support assembly 40 so as to restrict rotation of the holding structure 59 in the direction of the arrow R30. This configuration restricts rotation of the holding structure 59 and thereby further stably maintains the electrical connection between the container-side electrical connection structure 582 and the apparatus-side electrical connection structure 382.

According to the above embodiment, as shown in FIG. 6A, the printer 10 includes the first support assembly 40 and the stationary member 35 to which the electrical connection unit 38 including the liquid introduction portion 362 and the apparatus-side electrical connection structure 382 is attached. As shown in FIG. 6R, the apparatus-side electrical connection structure 382 is attached such as to be displaceable in the direction intersecting with the first direction (−K1-axis direction) (direction parallel to the plane defined by the Z-axis direction and the K2-axis direction). As shown in FIG. 17E and FIG. 17F, the holding structure 59 is configured to be connectable with the apparatus-side electrical connection structure 382 to which the container-side electrical connection structure 582 is attached in a displaceable manner. The holding structure 59 has the grooves 593*t* and 592*t* configured to receive the apparatus-side board positioning structures 384 and 385 (shown in FIG. 6T) of the electrical connection unit 38 as shown in FIG. 17E and FIG. 17F. This configuration allows the apparatus-side electrical connection structure 382 to be displaced following the motion of the holding structure 59 in the process of connecting the container-side electrical connection structure 582 with the apparatus-side electrical connection structure. This ensures favorable electrical connection between the container-side electrical connection structure 582 and the apparatus-side electrical connection structure 382.

According to the above embodiment, as shown in FIG. 17E and FIG. 17F, the holding structure 59 of the liquid container 50 abuts on the apparatus-side board positioning structures 384 and 385 (shown in FIG. 6T) in the process of connecting the container-side electrical connection structure 582 with the apparatus-side electrical connection structure 382. This configuration positions the container-side electrical connection structure 582 relative to the apparatus-side electrical connection structure 382 and thereby ensures favorable electrical connection between the apparatus-side electrical connection structure 382 and the container-side electrical connection structure 582. This configuration, for example, makes the apparatus-side electrical connection structure 382 and the container-side electrical connection structure 582 unlikely to be affected by the load of a downward component in the direction of gravity generated by the dead weight of the liquid container body 52. This reduces the possibility of failed electrical connection between these connection structures 382 and 582.

According to the above embodiment, as shown in FIG. 13, the holding structure-side positioning elements 592*t* and 593*t* are provided on the respective sides with the container-side electrical connection structure 582 placed therebetween. As shown in FIG. 6T, the apparatus-side board positioning structures 384 and 385 are provided on the respective sides with the apparatus-side terminals 381 of the apparatus-side electrical connection structure 382 placed therebetween. This configuration reduces the possibility that the container-side electrical connection structure 582 (or the apparatus-side electrical connection structure 382) is inclined, compared with the configuration that has only the holding structure-side positioning elements 592*t* and 593*t* (or has only the apparatus-side board positioning structures 384 and 385) provided only one of the container-side or the apparatus-side.

According to the above embodiment, as shown in FIG. 15, the holding structure 59 includes the holding structure-side upper restriction portions 599*a* and 599*b*. As shown in FIG. 6M, the fixation structure 37 includes the apparatus-side upper restriction portions 377*a* and 377*b*. When the container-side electrical connection structure 582 is connected with the apparatus-side electrical connection structure 382, the holding structure-side upper restriction portions 599*a* and 599*b* of the holding structure 59 abut on the apparatus-side upper restriction portions 377*a* and 377*b* of the fixation structure 37. This restricts the upward motion of the holding structure 59 in the direction of gravity. This accordingly ensures more favorable electrical connection between the container-side electrical connection structure 582 and the apparatus-side electrical connection structure 382. According to the above embodiment, such restriction starts prior to start of positioning by the apparatus-side board positioning structures 384 and 385 (shown in FIG. 6T) and the holding structure-side positioning elements 593*t* and 592*t* (shown in FIGS. 17E and 17F) of the holding structure 59. This roughly positions the apparatus-side board positioning structures 384 and 385 provided as the projections relative to the holding structure-side positioning elements 593*t* and 592*t* provided as the grooves. This accordingly enables the apparatus-side board positioning structures 384 and 385 to be securely inserted into the holding structure-side positioning elements 593*t* and 592*t*.

According to the above embodiment, the protective member (cover portion) 354 is used to cover over the apparatus-side electrical connection structure 382 as shown in FIG. 5C. This cover portion 354 is arranged to cover over the holding structure 59 and the circuit board 582 of the liquid container 50 when the container-side electrical connection structure 582 is connected with the apparatus-side electrical connection structure 382 (for example, in the mounted state). This reduces the possibility that impurity such as dust falls down from above the apparatus-side electrical connection structure 382 and adheres to the apparatus-side electrical connection structure 382. This accordingly ensures more favorable electrical connection between the container-side electrical connection structure 582 and the apparatus-side electrical connection structure 382.

A-12. Another Preferable Embodiment

Figure 45:
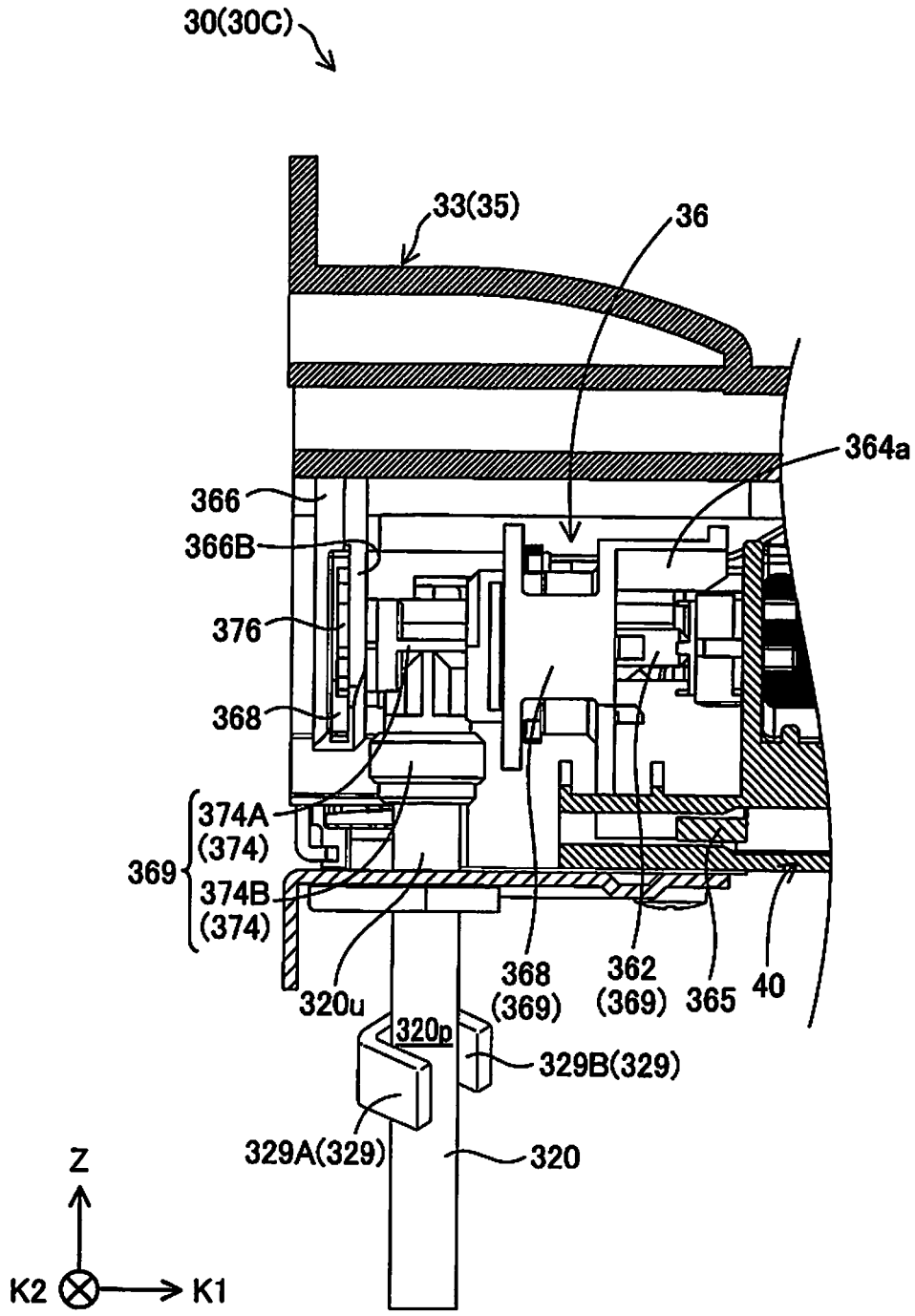
FIG. 45 is a diagram illustrating a preferable embodiment.

FIG. 45 is a diagram illustrating a preferable embodiment. The liquid supply device 20 may further include a liquid flow tube 320 and a holding member 329. The holding member 329 is configured to hold the liquid flow tube 320. According to this embodiment, the holding member 329 includes a pair of ribs 329A and 329B provided on the outer wall of the printer 10 (for example, the apparatus third surface 106 shown in FIG. 2). The liquid flow tube 320 is placed and is thereby held between the pair of ribs 329A and 329B. More specifically, the holding member 329 holds the liquid flow tube 320 such that an upstream end portion of the liquid flow tube 320 from an upstream end 320*u* to a position 320*p* where the holding member 329 is located is extended along the direction of gravity (Z-axis direction) in the flow direction of ink from the liquid introduction portion 362 to the printer 10. Accordingly the holding member 329 is located immediately below the connecting flow path portion 374.

Even in an arrangement that a downstream side of the liquid flow tube 320 is bent from its upstream end portion, this configuration enables the upstream end portion to be maintained in the shape along the direction of gravity. Even when a reaction force is produced by bending the downstream side of the liquid flow tube 320, the holding member 329 serves to receive the reaction force. For example, this reduces the possibility that another member of the liquid supply device (for example, second support structure 366) is affected by the downstream side of the liquid flow tube. In a configuration of the liquid supply device 20 without the holding member 329, bending the upstream side of the liquid flow tube 320 is likely to cause a failure in placing the restriction elements 376 at the designed positions in the second support structure 366 by the effect of the reaction force of the liquid flow tube 320. The reaction force of the liquid flow tube 320 applied to the second support structure 366 is also likely to cause deformation of the second support structure 366.

The holding member 329, however, maintains the upstream end portion of the liquid flow tube 320 in the shape along the direction of gravity. More specifically, even when the reaction force is produced in the upstream end portion by bending the downstream side of the liquid flow tube 320 from the upstream end portion, the holding member 329 receives the produced reaction force. This configuration enables the restriction elements 376 to be placed at the designed positions in the second support structure 366 with high accuracy. This enables the displacement mechanism using the second support structure 366 of the liquid flow portion 369 to work in the designed range. The holding member 329 is not limited to the ribs but may be any shape that can hold the liquid flow tube 320. For example, the holding member 329 may be a ring-shaped member. In this configuration, the liquid flow tube 320 is inserted through the ring shape.

In the embodiment, the substrate unit 58 is also called "container-side electrical connection structure 58". The circuit board holding structure 59 is also called "placement structure 59". The holding structure-side positioning elements 592*t* and 593*t* are also called "container side electrical connection structure positioning elements 592*t* and 593*t*". The holding structure-side upper restriction portions 599*a* and 599*b* are also called "container-side electrical connection structure upper restriction portions 599*a* and 599*b*".

B. Modifications

The disclosure is not limited to any of the embodiments and the examples described above but may be implemented by a diversity of other aspects without departing from the scope of the disclosure. Some of possible modifications are given below.

B-1. First Modification

In the above embodiment, the liquid container body 52 is formed from the flexible material. This is, however, not restrictive but any material may be employed to provide a liquid container body configured to contain a liquid inside thereof. For example, the liquid container body 52 may be formed partly from a flexible material or may be formed from a hard material that does not change the volume irrespective of consumption of the liquid. Forming at least part of the liquid container body 52 from the flexible material causes the volume of the liquid container body 52 to be changed with a change in amount of ink contained in the liquid container body 52.

B-2. Second Modification

In the above embodiment, as shown in FIG. 19, the connecting direction of the liquid container 50 to the mounting/demounting unit 30 is the horizontal direction (K1-axis direction). This is, however, not restrictive, but the connecting direction may be any direction including a first direction component (−K1-axis direction component). For example, the connecting direction may be a direction including a −Z-axis direction component and a −K1-axis direction component. In this modification, the movable member 40 is also moved in a direction corresponding to the connecting direction of the liquid container 50.

B-3. Third Modification

The disclosure is not limited to the inkjet printer or its liquid container 50 but is also applicable to any printing apparatus (liquid consuming apparatus) configured to eject any liquid other than ink and a liquid container configured to contain the liquid. For example, the disclosure may be applied to any of various liquid consuming apparatuses and their liquid containers given below:

(1) image recording apparatus such as a facsimile machine;

(2) color material ejection apparatus configured to eject a color material used for manufacturing color filters for an image display apparatus such as a liquid crystal display;

(3) electrode material ejection apparatus configured to eject an electrode material used for forming electrodes of, for example, an organic EL (electroluminescence) display and a field emission display (FED);

(4) liquid consuming apparatus configured to eject a bioorganic material-containing liquid used for manufacturing biochips;

(5) sample ejection apparatus used as a precision pipette;

(6) ejection apparatus of lubricating oil;

(7) ejection apparatus of a resin solution;

(8) liquid consuming apparatus for pinpoint ejection of lubricating oil on precision machines such as watches and cameras;

(9) liquid consuming apparatus configured to eject a transparent resin solution, such as an ultraviolet curable resin solution, onto a substrate in order to manufacture a hemispherical microlens (optical lens) used for, for example, optical communication elements;

(10) liquid consuming apparatus configured to eject an acidic or alkaline etching solution in order to etch a substrate or the like; and

(11) liquid consuming apparatus equipped with a liquid ejection head configured to eject a very small volume of droplets of any other liquid.

The "droplet" herein means the state of liquid ejected from the liquid consuming apparatus and may be in a granular shape, a teardrop shape or a tapered threadlike shape. The "liquid" herein may be any material ejectable from the liquid consuming apparatus. The "liquid" may be any material in the liquid phase. For example, liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The ink herein includes general water-based inks and oil-based inks, as well as various liquid compositions, such as gel inks and hot-melt inks. In an application that UV ink curable by UV radiation is contained in a liquid container body and is connected with the printer, the liquid container body is away from the placement surface. This reduces the likelihood that the UV ink is cured by transmission of heat from the placement surface to the liquid container body.

B-4. Fourth Modification

Figure 46:
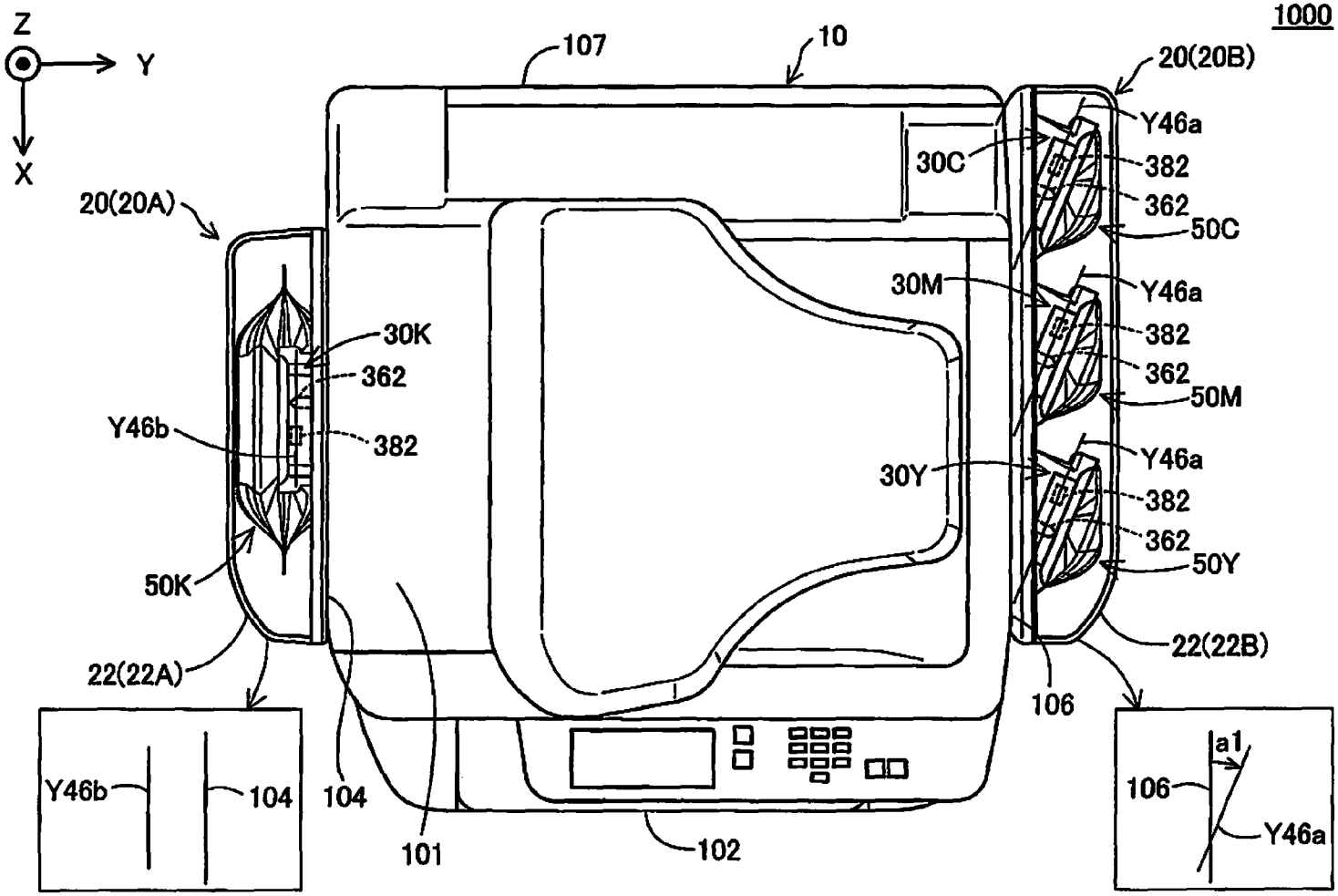
FIG. 46 is a diagram illustrating an example of preferable arrangement according to the embodiment.

FIG. 46 is a diagram illustrating an example of preferable arrangement according to the embodiment. FIG. 46 is a diagram of FIG. 1 viewed from the +Z-axis direction (vertically downward). For the purpose of better understanding, the liquid containers 50C, 50M, 50Y and 50K placed inside of the cover members 22 are also illustrated. The printer 10 further includes a top face (upper wall) 101 on the +Z-axis direction side and an apparatus fourth surface (rear face, rear wall) 107 that is opposed to the apparatus first surface 102.

The liquid containers 50C, 50M and 50Y are connected with the second liquid supply device 20B on the apparatus third surface (right side wall, first side wall) 106-side. The liquid supply connection structure 362 and the apparatus-side electrical connection structure 382 of each of the mounting/demounting units 30C, 30M and 30Y are arranged side by side in a predetermined direction Y46*a*. The liquid supply connection structure 362 and the apparatus-side electrical connection structure 382 of the mounting/demounting unit 30K are arranged side by side in a predetermined direction Y46*b*. Multiple sets of the liquid supply connection structures 362 and the apparatus-side electrical connection structures 382 are accordingly arranged on the apparatus third surface 106. The multiple sets are arranged in a direction in which the front face 102 and the rear face 107 are opposed to each other (i.e., in the X-axis direction).

The liquid container 50K is connected with the first liquid supply device 20A on the apparatus second surface (left side wall, apparatus second side wall) 104-side. The liquid container 50K has a larger capacity than those of the liquid containers 50C, 50M and 50Y and is capable of containing a larger amount of ink. The magnitude relationship of ink capacity is provided by the following configuration according to the embodiment. The length of the liquid container 50K in the predetermined direction Y46*b* (width direction, K2-axis direction in FIG. 7) is longer than the lengths of the liquid containers 50C, 50M and 50Y in the predetermined direction Y46*a* (width direction, K2-axis direction in FIG. 7). According to this embodiment, the length of the liquid container 50K in a direction (thickness direction, K1-axis direction in FIG. 7) orthogonal to the predetermined direction Y46*b* is longer than the lengths of the liquid containers 50C, 50M and 50Y in a direction (thickness direction, K1-axis direction in FIG. 7) orthogonal to the predetermined direction Y46*a*.

With regard to the clockwise direction from the apparatus third surface 106, an angle between the apparatus third surface 106 and the predetermined direction Y46*a* is defined as angle a1. The angle a1 is greater than 0 degree and smaller than 90 degrees. The predetermined direction Y46*b* is parallel to the apparatus second surface 104. Accordingly the liquid supply connection structure 362 and the apparatus-side electrical connection structure 382 supported on the apparatus second surface 104 are arranged side by side along a direction parallel to the apparatus second surface 104. When the mounting/demounting units 30C, 30M and 30Y are arranged on the apparatus second surface 104-side, with regard to the counterclockwise direction from the apparatus second surface 104, an angle a2 between the apparatus second surface 106 and the predetermined direction Y46*a* is preferably greater than 0 degree and smaller than 90 degrees.

The angle a1 or the angle a2 is greater than 0 degree and smaller than 90 degrees as described above. This configuration suppresses expansion of the width in the left-right direction (Y-axis direction) in which the apparatus second surface 104 and the apparatus third surface 106 are opposed to each other. The liquid container 50K having the larger capacity is arranged parallel to the apparatus second surface 104. This configuration provides substantially equal spaces for mounting the liquid containers 50 on the apparatus second surface 104-side and the apparatus third surface 106-side across the printer 10.

B-5. Fifth Modification

Figure 47:
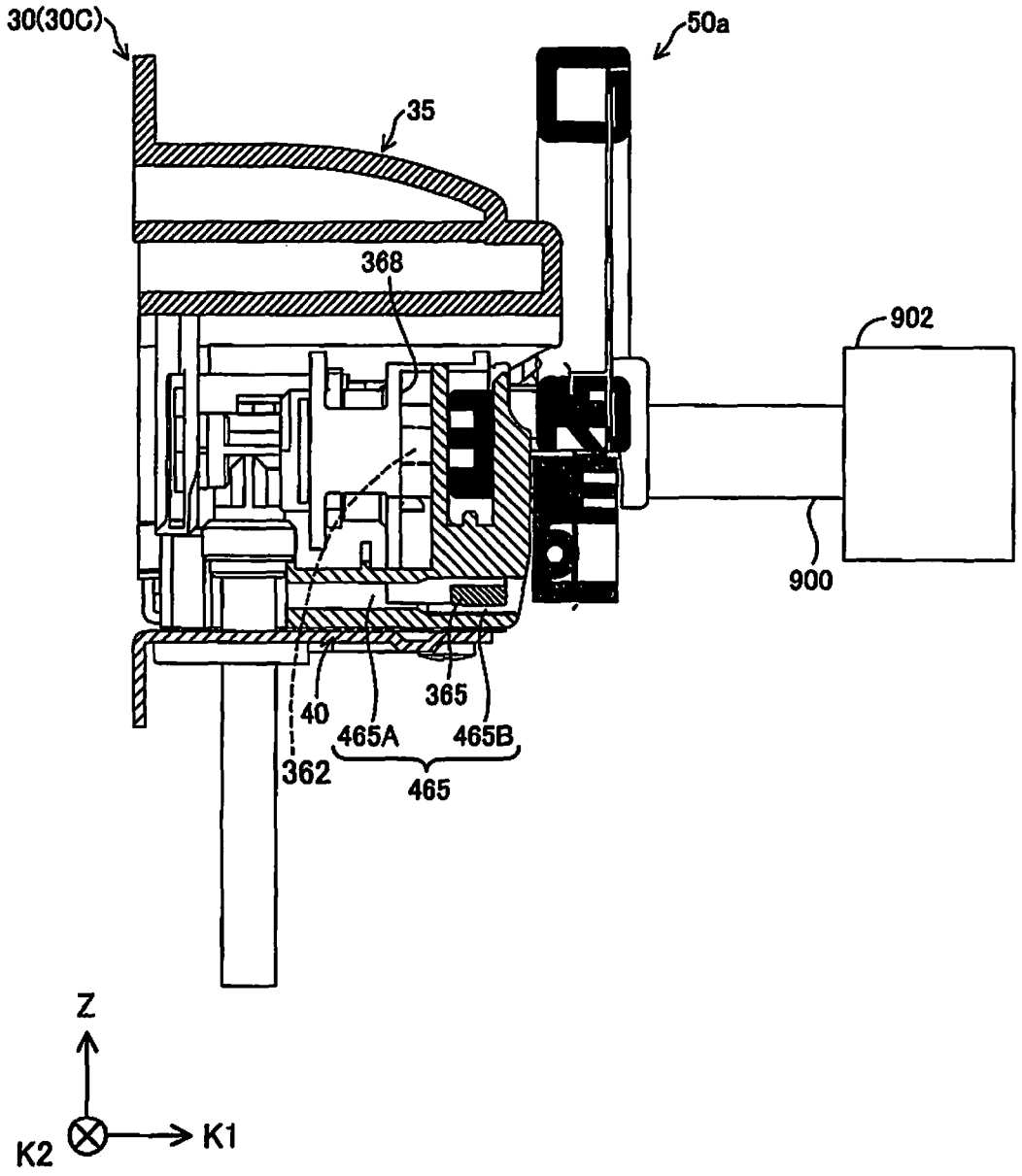
FIG. 47 is a diagram illustrating an electrical connector.

FIG. 47 is a diagram illustrating an electrical connector 50*a*. In the above embodiment, the liquid container 50 includes the liquid containing bag 52 and the liquid supply portion 57 (shown in FIG. 7 and FIG. 9). The electrical connector 50*a* may be provided with omission of the liquid containing bag 52 and the liquid supply portion 57. In other words, the electrical connector 50*a* is configured to exclude the liquid containing bag 52 and the liquid supply portion 57 from the configuration of the liquid container 50 and otherwise has the same configuration as that of the liquid container 50. In an application using this electrical connector 50*a*, ink is supplied from a tank (liquid reservoir) 902 that is placed outside to contain ink, to the printer 10 via a liquid flow tube (hose) 900 arranged to connect the tank 902 with the liquid introduction portion 362. The liquid supply tube (hose) 900 may be connected halfway in the liquid flow tube from the liquid introduction portion 362 to the liquid ejection assembly of the printer 10. The configuration of FIG. 47 provides the similar advantageous effects to those of the above embodiment. For example, the contact plane TP is inclined such that the lower side is located on the first direction side (−K1-axis direction side) of the upper side as shown in FIG. 17D. The surface 62*fa* of the terminal holder 62 is accordingly inclined such that the upper side is protruded more than the lower side in the opposite direction (+K1-axis direction) to the first direction as shown in FIG. 24. In other words, the surface 62*fa* of the terminal holder 62 is arranged to cover over the contacts cp of the circuit board 582. This configuration reduces the possibility that impurity such as dust adheres to the electrical connection structure 382 (for example, the surface 62*fa* or the apparatus-side terminals 381). This accordingly ensures more favorable electrical connection between the container-side electrical connection structure 582 and the apparatus-side electrical connection structure 382.

B-6. Sixth Modification

In the above embodiment, the container-side electrical connection structure includes the circuit board 582. This configuration is, however, not restrictive, but the container-side electrical connection structure may have any configuration that includes the contacts cp configured to come into contact with the apparatus-side electrical connection structure 382. For example, the circuit board 582 may not be provided with the storage device 583. For example, the container-side electrical connection structure 582 may include a contact of a terminal used for detection of mounting or demounting of the liquid container 50. The container-side electrical connection structure 582 may include an overall circuit board including a flexible cable, such as flexible printed circuit board (FPC). A contact configured to come into contact with the apparatus-side electrical connection structure 382 is provided on one end of this circuit board, and the other end may be connected with, for example, are reset device. This modified configuration may be employed in place of the circuit board 582 or may be employed in addition to the circuit board 582.

The disclosure is not limited to any of the embodiments, the examples and the modifications described above but may be implemented by a diversity of other configurations without departing from the scope of the disclosure. For example, the technical features of any of the embodiments, the examples and the modifications corresponding to the technical features of each of the aspects described in Summary may be replaced or combined appropriately, in order to solve part or all of the problems described above or in order to achieve part or all of the advantageous effects described above. Any of the technical features may be omitted appropriately unless the technical feature is described as essential herein.

REFERENCE SIGNS LIST

10 printer (liquid consuming apparatus), 11 recording mechanism, 16 paper feed tray, 17 paper eject tray, 20 liquid supply device, 20A first liquid supply device, 20B second liquid supply device, 22, 22A, 22B cover member (liquid container holder), 26, 26A, 26B housing space, 27 bottom face, 30, 30C, 30M, 30Y, 30K mounting/demounting unit, 32 first stationary member, 33 second stationary member, 35 stationary member, 36 liquid introduction mechanism, 37 fixation structure, 37A first partition wall, 37B second partition wall, 37S receiving space, 38 electrical connection unit (contact mechanism), 39, 39A, 39B coil spring, 40 first support assembly (movable member), 41 base portion, 41*u* bottom, 42 supply portion support structure, 46 first side face, 47 second side face, 48 board support structure, 49 bottom (bottom wall), 50, 50C, 50M, 50Y, 50K liquid container (liquid container unit), 51 container body support assembly, 51W peripheral area, 51Y peripheral area, 52, 52C, 52K liquid container body, 53 operation member, 54 grip portion, 55 liquid supply unit, 56 container body-side support structure, 57 liquid lead-out portion (liquid supply portion, flow portion), 58 substrate unit, 59 holding structure (circuit board holding structure), 62 terminal holder, 62*b* lower end, 62*u* upper end, 62*fa* surface, 70 flow path member, 99 film, 101 top face, 102 apparatus first surface (front face), 104 apparatus second surface, 106 apparatus third surface, 107 rear face, 301 screw, 302, screw, 302H through hole, 307A first mounting wall, 307B second mounting wall, 320 liquid flow tube, 323 sheet metal, 325 coil spring, 354 cover portion (protective member), 357 bottom, 362 liquid supply connection structure (liquid introduction portion), 362H liquid introducing hole, 362*a* leading edge, 362*b* base end, 364 supply portion positioning structure, 364*a* first supply portion positioning structure, 364*b* second supply portion positioning structure, 364*c* third supply portion positioning structure, 364*d* fourth supply portion positioning structure, 365 guide structure, 366 second support structure (fixation structure), 366B wall portion, 366H inner housing space, 367 coil spring, 368 liquid introduction main body, 369 liquid flow portion, 371 second mounting portion, 372 second mounting portion, 374 connecting flow path portion 374A flow path forming portion, 374B connection structure, 374*e* connection structure base end, 374*r* recess, 376 restriction element, 376A first restriction element, 376B second restriction element, 376C third restriction element, 377 first mounting portion, 377M, 377*a*, 377*b* apparatus-side upper restriction portion, 378 first mounting portion, 381 (381A-381I) apparatus-side terminal, 382 electrical connection structure (supply-side electrical connection structure, apparatus-side electrical connection structure), 384 apparatus-side board positioning structure (first contact-side positioning structure), 384*a* first restriction element, 384*b* second restriction element, 384*c* third restriction element, 384*d* fourth restriction element, 384*e* locking element, 385 second contact-side positioning structure, 385*a* first restriction element, 385*b* second restriction element, 385*c* third restriction element, 385*d* fourth restriction element, 385*e* locking element, 387 coil spring, 387A one end, 387B other end, 388 holding member, 392 support wall portion, 392*ta* top face, 393 rib, 393*ta* top face, 394 first side wall, 395 support wall portion, 396 second side wall, 402 first support surface, 403 second support surface, 404 third support surface, 406 cutout portion, 407 groove, 462 locking pawl, 465 guiding portion, 465A first guiding portion, 465B second guiding portion, 472 locking pawl, 482 first board support surface, 487 bottom support surface (apparatus-side rotation restriction element), 489 apparatus-side restriction element, 501 one end, 521 first sheet, 522 second sheet, 523 third sheet, 541 grip surface, 542 receiving space, 545 pressed portion, 546 first connecting portion, 547 second connecting portion, 548 base portion, 549 mounting portion, 550 lead-out portion, 551 valve mechanism, 552 valve seat, 554 valve element, 556 spring, 558 inner flow path, 569 bottom, 572 liquid supply port, 573 supply connecting portion, 577 positioning structure, 577*a* first container-side positioning structure, 577*b* second container-side positioning structure, 577*c* third container-side positioning structure, 577*d* fourth container-side positioning structure, 580 liquid container-side terminal group, 581 (581A-581I) liquid container-side terminal, 582 electrical connection structure (circuit board, container-side electrical connection structure), 582*fa* surface, 582*fb* rear face, 583 storage device, 584 boss groove, 585 boss hole, 586 upper end, 587 lower end, 592 first side wall portion, 592*t* holding structure-side positioning element (groove), 592*ta* top face, 592*tb* side face, 592*tc* base end face, 592*td* bottom face, 593 second side wall portion, 593*t* holding structure-side positioning element (groove), 593*ta* top face, 593*tb* side face, 593*tc* base end face, 593*td* bottom face, 594 placement portion, 595 bottom (rotation restriction element), 597 restriction element, 599*a* holding structure-side upper restriction portion, 599*b* holding structure-side upper restriction portion, 602 connector, 1000 liquid consumption system, CL center axis, TP contact plane, CT center axis, cp contact.

The invention claimed is:

1. A liquid supply device configured to supply a liquid to a liquid consuming apparatus, the liquid supply device comprising:

a liquid container configured to include a liquid supply portion and to contain the liquid therein; and a mounting/demounting unit supported on an outer wall of the liquid consuming apparatus, the mounting/demounting unit detachably mounting the liquid container, the mounting/demounting unit including a stationary member having a liquid supply connection structure that is connected with the liquid supply portion, and a movable member supported on the stationary member, the movable member being movable in a first direction which is a direction approaching the stationary member and in a second direction which is a direction away from the stationary member, wherein the movable member supports the liquid supply portion.

2. The liquid supply device according to claim 1, wherein the stationary member further has a protective member arranged to cover at least an upper portion of the liquid supply connection structure.

3. The liquid supply device according to claim 2, wherein the liquid container has a container-side electrical connection structure, and the stationary member further has an apparatus-side electrical connection structure connected with the container-side electrical connection structure.

4. The liquid supply device according to claim 3, wherein the protective member is arranged to cover at least an upper portion of the apparatus-side electrical connection structure.

5. The liquid supply device according to claim 1, wherein the liquid container has a container-side electrical connection structure, the stationary member further has an apparatus-side electrical connection structure connected with the container-side electrical connection structure.

6. The liquid supply device according to claim 5, wherein the liquid supply connection structure and the apparatus-side electrical connection structure are arranged adjacent to each other.

7. The liquid supply device according to claim 6, wherein the outer wall comprises at least one of a first side wall that forms a first side face relative to a front face of the liquid consuming apparatus and a second side wall that forms a second side face relative to the front face, and the liquid supply connection structure and the apparatus-side electrical connection structure are arranged at positions respectively visible from the front face.

8. The liquid supply device according to claim 5, wherein the liquid supply connection structure and the apparatus-side electrical connection structure are arranged side by side in a predetermined direction, the outer wall comprises at least one of a first side wall that forms a first side face relative to a front face of the liquid consuming apparatus and a second side wall that forms a second side face relative to the front face, wherein the first side wall is a right side wall and the second side wall is a left side wall, wherein when the liquid supply connection structure and the apparatus-side electrical connection structure are supported on the right side wall, an angle a1 between the right side wall and the predetermined direction is greater than 0 degree and is smaller than 90 degrees in a clockwise direction from the right side wall in a vertically downward view of the liquid consuming apparatus, and when the liquid supply connection structure and the apparatus-side electrical connection structure are supported on the left side wall, an angle a2 between the left side wall and the predetermined direction is greater than 0 degree and is smaller than 90 degrees in a counterclockwise direction from the left side wall in the vertically downward view of the liquid consuming apparatus.

9. The liquid supply device according to claim 8, wherein in the vertically downward view of the liquid consuming apparatus, multiple sets of the liquid supply connection structures and the apparatus-side electrical connection structures are arranged on one wall out of the right side wall and the left side wall at the angle a1 or at the angle a2 in a direction in which the front face and a rear face of the liquid consuming apparatus are opposed to each other, the liquid supply connection structure and the apparatus-side electrical connection structure are provided on the other wall out of the right side wall and the left side wall to be arranged side by side along a direction parallel to the other wall, and the liquid container connected with the liquid supply connection structure and the apparatus-side electrical connection structure supported on the other wall has a larger capacity than capacities of the liquid containers connected with the multiple sets of the liquid supply connection structures and the apparatus-side electrical connection structures supported on the one wall.

10. The liquid supply device according to claim 1, further comprising:

a liquid container holder attached to the outer wall and configured to place the liquid container therein, wherein the liquid container holder has a bottom face and an openable and closable top.

11. The liquid supply device according to claim 1, wherein the first direction is a straight direction in which the liquid container is connected to the liquid consuming apparatus, and the second direction is a straight direction in which the liquid container is removed from the liquid consuming apparatus.

12. The liquid supply device according to claim 1, wherein the liquid container includes a liquid container body to contain the liquid therein, and in a state in which the liquid supply portion is connected to the liquid supply connection structure, the liquid supply portion is positioned on one end side being an upper side in the liquid container body.

13. The liquid supply device according to claim 1, wherein the liquid container further includes a container body support assembly including the liquid supply portion, and the container body support assembly has an operation member which is gripped by a user.

14. The liquid supply device according to claim 1, wherein the mounting/demounting unit further includes a supply portion positioning structure that is arranged to surround the liquid supply connection structure about a center axis of the liquid supply connection structure, the liquid container further includes a positioning structure that is provided to surround an outer circumference of the liquid supply portion about a center axis of the liquid supply portion, and the positioning structure abuts on the supply portion positioning structure so as to position the liquid supply portion relative to the liquid introduction portion in a process of connecting the liquid container with the liquid consuming apparatus.

* * * * *